US009662874B2

(12) United States Patent
Hirano et al.

(10) Patent No.: US 9,662,874 B2
(45) Date of Patent: May 30, 2017

(54) INK SUPPLY METHOD AND INK SUPPLY DEVICE

(71) Applicant: Komori Corporation, Tokyo (JP)

(72) Inventors: Masahiro Hirano, Ibaraki (JP); Yoshihito Nakamura, Ibaraki (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 15/038,009

(22) PCT Filed: Nov. 21, 2014

(86) PCT No.: PCT/JP2014/080881
§ 371 (c)(1),
(2) Date: May 19, 2016

(87) PCT Pub. No.: WO2015/076363
PCT Pub. Date: May 28, 2015

(65) Prior Publication Data

US 2016/0288488 A1 Oct. 6, 2016

(30) Foreign Application Priority Data

Nov. 22, 2013 (JP) ..... 2013-242260

(51) Int. Cl.
*B41F 31/20* (2006.01)
*B41F 33/10* (2006.01)
(Continued)

(52) U.S. Cl.
CPC ..... *B41F 31/20* (2013.01); *B41F 31/045* (2013.01); *B41F 31/13* (2013.01); *B41F 33/10* (2013.01); *B41F 35/06* (2013.01)

(58) Field of Classification Search
CPC ..... B41F 33/0045; B41F 33/10; B41F 31/20; B41F 31/13; B41F 31/45; B41F 35/06; B41F 35/04; B41F 35/02
See application file for complete search history.

(56) References Cited

U.S. PATENT DOCUMENTS

2002/0002917 A1* 1/2002 Saito ..... B41F 33/16 101/348
2004/0000241 A1* 1/2004 Kiyohara ..... B41F 33/00 101/135
(Continued)

FOREIGN PATENT DOCUMENTS

JP S58-199155 A 11/1983
JP S58-201008 A 11/1983
(Continued)

*Primary Examiner* — David Banh
(74) *Attorney, Agent, or Firm* — Blakely Sokoloff Taylor & Zafman LLP

(57) ABSTRACT

After the end of a preceding print job, a printing press is stopped, and ink form rollers (6-1 to 6-4) of an ink roller group (6) are thrown off. After that, a printing plate (7) is exchanged with a printing plate (7') of a next print job, and a blanket (91) mounted on a blanket cylinder (9) is cleaned. The opening amounts of ink fountain keys (4-1 to **4-*n*) corresponding to the image of the printing plate (7') of the next print job are obtained. The obtained opening amounts of the ink fountain keys (4-1 to 4-*n*) are corrected by correction values of the opening amounts of the ink fountain keys (4-1 to 4-*n*) considering the influence of cleaning of the blanket (91) to obtain corrected opening amounts. In a state in which the opening amounts of the ink fountain keys (4-1 to 4-*n*) have been set to the corrected opening amounts, a corrected ink film thickness distribution corresponding to the image of the printing plate (7') of the next print job is formed on the ink roller group (6**).

15 Claims, 36 Drawing Sheets

(51) Int. Cl.

| | |
|---|---|
| ***B41F 35/06*** | (2006.01) |
| ***B41F 31/04*** | (2006.01) |
| ***B41F 31/13*** | (2006.01) |

(56) References Cited

U.S. PATENT DOCUMENTS

| | | | | |
|---|---|---|---|---|
| 2004/0177784 | A1* | 9/2004 | Yamamoto | B41F 33/0045 101/484 |
| 2009/0199730 | A1* | 8/2009 | Senoo | B41C 1/055 101/148 |
| 2013/0061769 | A1* | 3/2013 | Hirano | B41F 31/045 101/367 |
| 2013/0186290 | A1* | 7/2013 | Paul | B41F 31/045 101/348 |

FOREIGN PATENT DOCUMENTS

| | | | |
|---|---|---|---|
| JP | S58-201010 | A | 11/1983 |
| JP | H03-097564 | A | 4/1991 |
| JP | H10-016193 | A | 1/1998 |
| JP | H11-188844 | A | 7/1999 |
| JP | H 11-188850 | A | 7/1999 |
| JP | 2002-001237 | A | 1/2002 |
| JP | 2002-248738 | A | 9/2002 |
| JP | 2004-009618 | A | 1/2004 |
| JP | 2005-096085 | A | 4/2005 |
| JP | 2008-018608 | A | 1/2008 |
| JP | 2012-152961 | A | 8/2012 |
| JP | 2013-059878 | A | 4/2013 |
| JP | 2013-226715 | A | 11/2013 |

* cited by examiner

INK SUPPLY METHOD AND INK SUPPLY DEVICE

TECHNICAL FIELD

The present invention relates to an ink supply method and an ink supply device for supplying, via an ink roller group, ink supplied to an ink fountain roller to a printing plate mounted on a plate cylinder by the feed operation of an ink ductor roller.

BACKGROUND ART

FIG. 17 shows the main part of an inker (ink supply device) in a printing unit of each color of a web offset printing press. Referring to FIG. 17, reference numeral 1 denotes an ink fountain; 2, ink stored in the ink fountain 1; 3, an ink fountain roller; 4 (4-1 to **4-*n*), a plurality of ink fountain keys juxtaposed in the axial direction of the ink fountain roller 3; 5, an ink ductor roller; 6, an ink roller group; 7, a printing plate; 8, a plate cylinder on which the printing plate 7 is mounted; 9, a blanket cylinder; and 10, an impression cylinder. A blanket 91 is mounted on the blanket cylinder 9**.

This ink supply device supplies the ink 2 in the ink fountain 1 to the ink fountain roller 3 by adjusting the opening ratios of the ink fountain keys 4-1 to **4-*n*, and supplies, via the ink roller group 6, the ink supplied to the ink fountain roller 3 to the printing plate 7 by the feed operation of the ink ductor roller 5**.

An image is printed on the printing plate 7. The ink supplied to the printing plate 7 is received by the blanket 91 on the blanket cylinder 9. The ink received by the blanket 91 is transferred to printing paper (target printing material) 11 conveyed between the blanket cylinder 9 and the impression cylinder 10.

Note that ink form rollers 6-1 to 6-4 in contact with the printing plate 7 are provided at the end of the ink flow path of the ink roller group 6. Together with the ink supplied via the ink form rollers 6-1 to 6-4, dampening water stored in a fountain pan 13 is supplied to the printing plate 7 via a dampening form roller 12.

In this ink supply device, when a print job is switched, that is, when the printing plate 7 of a preceding print job is exchanged with a printing plate 7' of the next print job, the opening ratios of the ink fountain keys 4-1 to **4-*n* and the rotation amount of the ink fountain roller 3 are changed to values corresponding to the image of the printing plate 7' of the next print job, and the ink 2 in the ink fountain 1 is supplied to the exchanged printing plate 7' via the ink roller group 6. In this case, test printing is performed before final printing, and the ink supply amount is adjusted, thereby obtaining a satisfactory color tone. A desired ink film thickness distribution (the gradient of an ink film thickness) is thus formed on the ink roller group 6, the plate cylinder 8, and the blanket cylinder 9**.

However, in this ink supply device, when exchanging the printing plate 7 with the printing plate 7' and executing the next print job, the ink film thickness distribution for the printing plate 7 of the preceding print job still remains on the ink roller group 6. In this case, the ink film thickness distribution for the printing plate 7 of the preceding print job needs to be gradually changed to the ink film thickness distribution for the printing plate 7' of the next print job. Excessive ink supply amount adjustment and test printing are needed until a satisfactory color tone is obtained. This poses problems such as an increase in the preparation time before printing", an increase in working load", "a waste of printing materials", "a decrease in production efficiency", and "an increase in cost".

Hence, aiming at decreasing the numbers of times of ink supply amount adjustment and test printing until a satisfactory color tone is obtained, "ink film thickness control methods" described in patent literatures 1 and 2 have been proposed.

[Patent Literature 1 (Ink Decrease+Pre-Inking 2)]

In the ink film thickness control method described in patent literature 1, when switching a print job, the feed operation of the ink ductor roller 5 is turned off. In a state in which the printing plate 7 of the preceding print job is kept mounted, the printing press is operated to print a predetermined number of sheets (blank sheet printing). The ink in the ink supply device is thus decreased (ink decrease), and a minimum ink film thickness distribution Ma (see FIG. 18A) that is needed during printing and becomes thinner from the upstream to the downstream, that is, the ink film thickness distribution Ma corresponding to a portion of the printing plate 7 without any image is left on the ink roller group 6 (ink removing).

Next, the opening ratios of the ink fountain keys 4-1 to **4-*n*, the rotation amount of the ink fountain roller 3, and the like are set to values corresponding to the image of the printing plate 7' of the next print job. Then, in a state in which the ink form rollers 6-1 to 6-4 have been thrown off, the printing press is operated to cause the ink ductor roller 5 to perform the feed operation a predetermined number of times, thereby superimposing an ink film thickness distribution Mb (see FIG. 18B) corresponding to the image of the printing plate 7' of the next print job on the minimum ink film thickness distribution Ma remaining on the ink roller group 6** and needed during printing (pre-inking 2).

[Patent Literature 2 (Ink return to fountain+Pre-Inking 1)]

In the ink film thickness control method described in patent literature 2, when switching a print job, the opening amounts of the ink fountain keys 4-1 to **4-*n* are set to zero. In this state, the ink ductor roller 5 is caused to perform the feed operation a predetermined number of times, thereby wholly returning the ink on the ink roller group 6 to the ink fountain 1 (ink return to fountain). A state in which each roller in the ink roller group 6** does not hold ink is thus attained.

Next, the opening ratios of the ink fountain keys 4-1 to **4-*n* are set to a predetermined opening ratio (for example, 50%). In addition, the rotation amount of the ink fountain roller 3 is set to a predetermined amount (for example, 50%). Then, the ink ductor roller 5 is caused to perform the feed operation a predetermined number of times, thereby forming the minimum ink film thickness distribution Ma (see FIG. 18A) needed during printing on the ink roller group 6** (the first step of pre-inking 1).

The opening ratios of the ink fountain keys 4-1 to **4-*n*, the rotation amount of the ink fountain roller 3, and the like are set to values corresponding to the image of the printing plate 7' of the next print job. Then, in a state in which the ink form rollers 6-1 to 6-4 have been thrown off, the printing press is operated to cause the ink ductor roller 5 to perform the feed operation a predetermined number of times, thereby superimposing the ink film thickness distribution Mb (see FIG. 18B) corresponding to the image of the printing plate 7' of the next print job on the minimum ink film thickness distribution Ma formed on the ink roller group 6** and needed during printing (the second step of pre-inking 1).

In the printing press including such an ink supply device, normally, upon switching from the preceding print job to the next print job, ink for the preceding print job remains on the blanket on the blanket cylinder. Hence, to remove the ink, the blanket is cleaned by a blanket cleaning device. The blanket cleaning device, for example, presses a cleaning cloth against the blanket mounted on the blanket cylinder while making the cleaning cloth in a tense state intermittently travel between a supply shaft and a takeup shaft, and sprays a solvent to the cleaning cloth to clean the blanket while rotating the blanket cylinder (for example, see patent literature 3).

For this reason, even if an ink film thickness distribution corresponding to the image of the printing plate of the next print job is formed on the ink roller group by the above-described ink film thickness control method, and after that, the ink form rollers are thrown on, and printing is started, the ink hardly adheres to the blanket because of the influence of the solvent remaining on the blanket, and lightly printed products are produced, resulting in a waste of printing materials.

RELATED ART LITERATURE

Patent Literature

Patent Literature 1: Japanese Patent Laid-Open No. 10-16193

Patent Literature 2: Japanese Patent Laid-Open No. 11-188844

Patent Literature 3: Japanese Patent Laid-Open No. 2002-1237

Patent Literature 4: Japanese Patent Laid-Open No. 3-97564

Patent Literature 5: Japanese Patent Laid-Open No. 58-201008

Patent Literature 6: Japanese Patent Laid-Open No. 58-201010

DISCLOSURE OF INVENTION

Problem to be Solved by the Invention

The present invention has been made to solve the above-described problem, and has as its object to provide an ink supply method and ink supply device capable of preventing a lightly printed product from being produced due to the influence of a solvent remaining on a blanket and eliminating a waste of printing materials.

Means of Solution to the Problem

In order to achieve the object, according to the present invention, there is provided an ink supply method comprising the steps of cleaning the blanket mounded on the blanket cylinder after an end of a print job including adjusting an amount of ink supplied from an ink fountain to an ink fountain roller by adjusting an opening amount of an ink fountain key, supplying the ink supplied to the ink fountain roller to a printing plate via an ink roller group by a feed operation of an ink ductor roller, and supplying the ink to a blanket which is mounted on a blanket cylinder and used to transfer the ink supplied to the printing plate to a target printing material; calculating the opening amount of the ink fountain key corresponding to an image of a printing plate of a next print job; correcting the calculated opening amount of the ink fountain key with a correction value in consideration of an influence of cleaning of the blanket; and forming, on the ink roller group, a corrected ink film thickness distribution corresponding to the image of the printing plate of the next print job by performing the feed operation of the ink ductor roller a predetermined number of times in a state in which the opening amount of the ink fountain key has been set to the corrected opening amount.

In the present invention, the opening amounts of the ink fountain keys are set to opening amounts corrected by correction values for the opening amounts of the ink fountain keys considering the influence of blanket cleaning, and a corrected ink film thickness distribution corresponding to the image of the printing plate of the next print job is formed on the ink roller group. The ink is thus supplied in a little large amount, thereby preventing a lightly printed product from being produced due to the influence of a solvent remaining on the blanket.

Effect of the Invention

According to the present invention, after the end of a print job, the opening amounts the of ink fountain keys corresponding to the image of the printing plate of the next print job are corrected by the correction values of the opening amounts of the ink fountain keys considering the influence of cleaning of the blanket to obtain corrected opening amounts. In a state in which the opening amounts of the ink fountain keys have been set to the corrected opening amounts, the feed operation of the ink ductor roller is performed a predetermined number of times to form, on the ink roller group, a corrected ink film thickness distribution corresponding to the image of the printing plate of the next print job. Hence, the ink is supplied in a little large amount, thereby preventing a lightly printed product from being produced due to the influence of the solvent remaining on the blanket and eliminating a waste of printing materials.

BEST MODE FOR CARRYING OUT THE INVENTION

Figure 1:
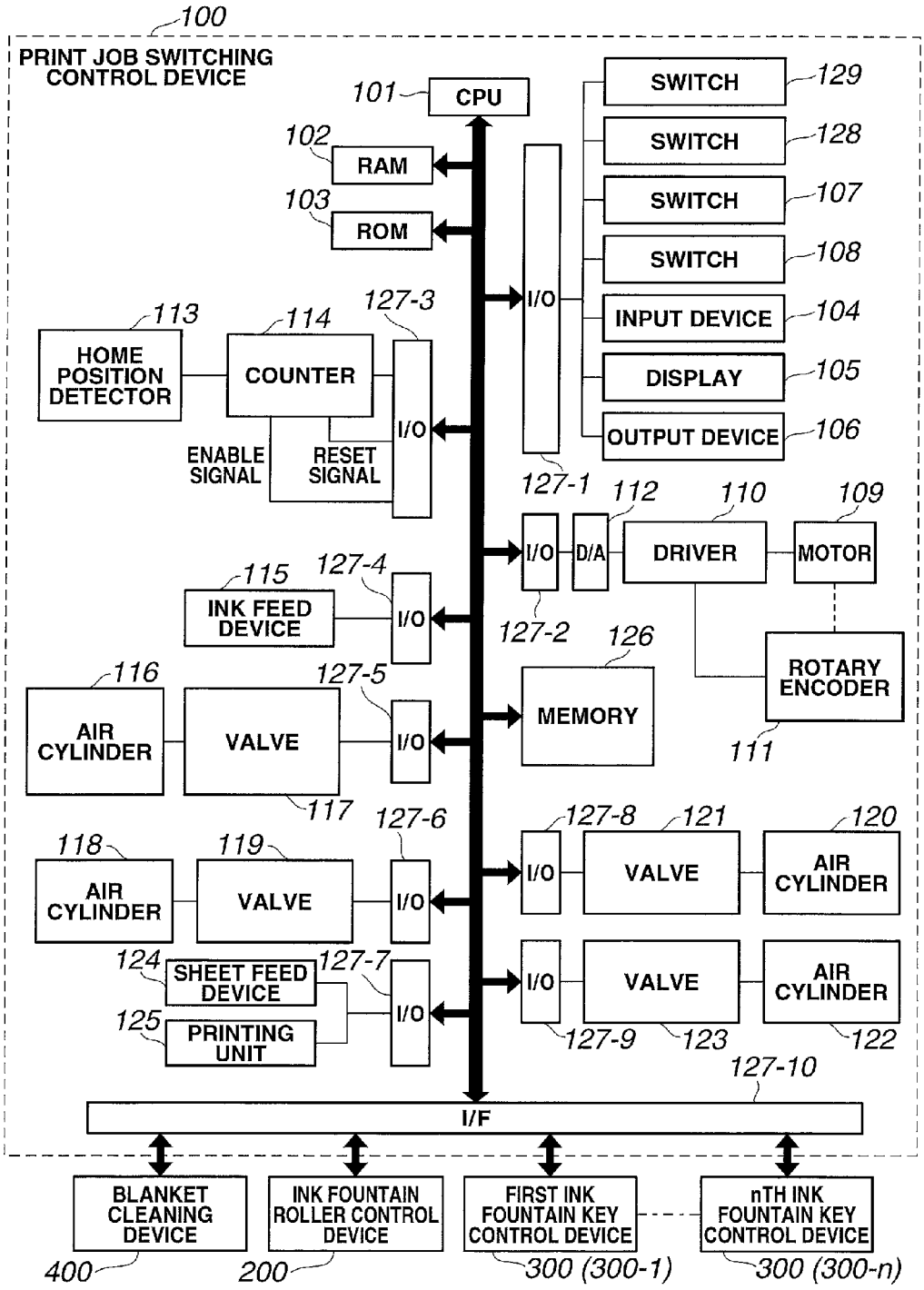
FIG. 1 is a block diagram showing an embodiment of a print job switching control device used to execute an ink supply method according to the present invention.

An embodiment of the present invention will now be described in detail with reference to the accompanying drawings. FIG. 1 is a block diagram showing an embodiment of a print job switching control device used to execute an ink supply method according to the present invention.

A print job switching control device 100 includes a CPU (Central Processing Unit) 101, a RAM (Random Access Memory) 102, a ROM (Read Only Memory) 103, an input device 104, a display 105, an output device (printer or the like) 106, a printing stop switch 107, a print job switching start switch 108, a blanket cleaning start switch 128, a blanket cleaning end switch 129, a printing press drive motor 109, a drive motor driver 110, a rotary encoder 111 for drive motor, a D/A converter 112, a printing press home position detector 113, a printing press rotation counter 114, and an ink feed device 115.

The print job switching control device 100 also includes a roller group dividing/connecting air cylinder 116, a valve 117 for roller group dividing/connecting air cylinder, a dampening form roller on/off air cylinder 118, a valve 119 for dampening form roller on/off air cylinder, an ink form roller on/off air cylinder 120, a valve 121 for ink form roller on/off air cylinder, an ink scraper blade on/off air cylinder 122, a valve 123 for ink scraper blade on/off air cylinder, a sheet feed device 124, a printing unit 125, a memory 126, and input/output interfaces (I/Os and an I/F) 127-1 to 127-10.

Figure 2:
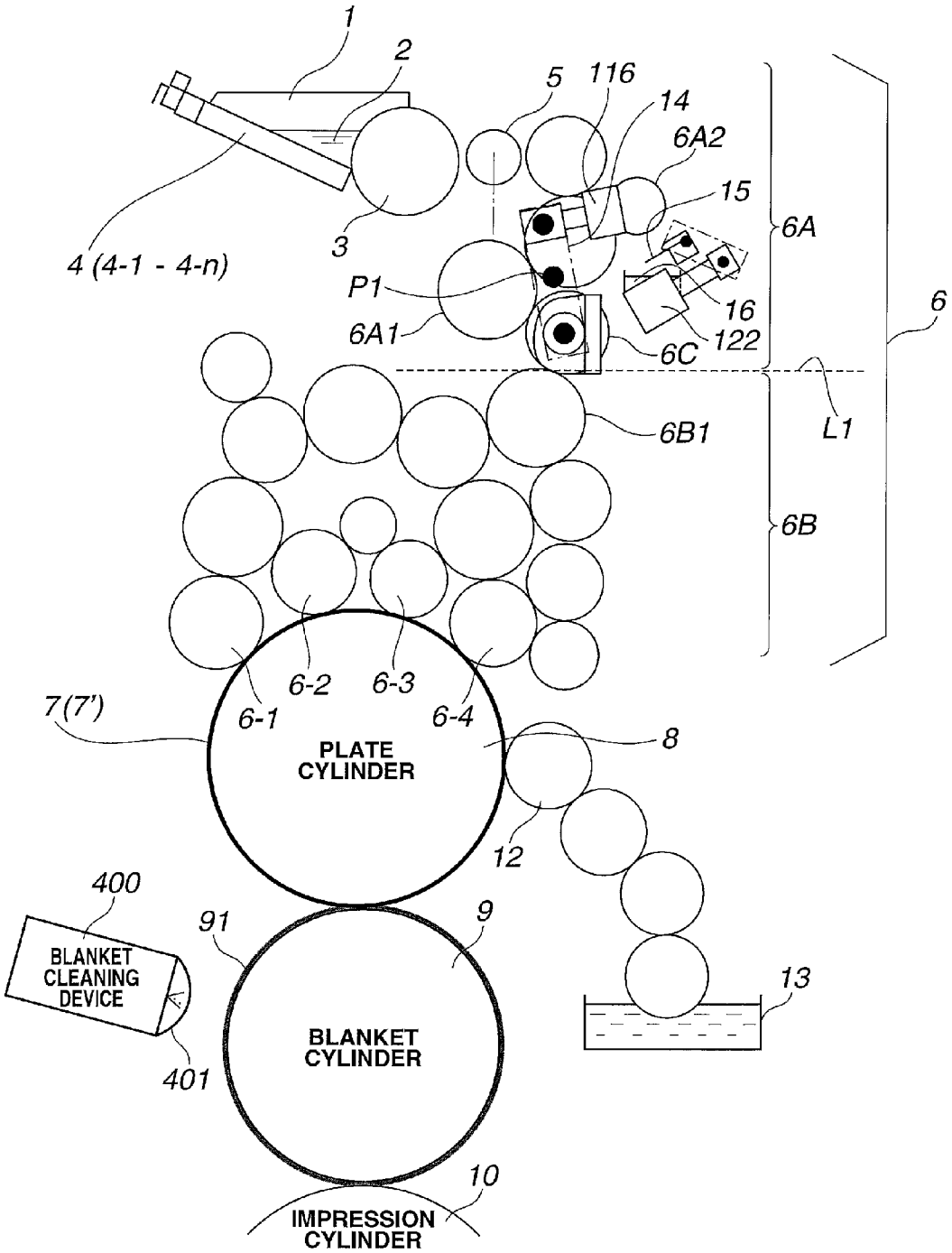
FIG. 2 is a view showing the main part of an ink supply device in a printing unit controlled by the print job switching control device (a state in which an ink roller group is connected (a state before the ink roller group is divided))
Figure 17:
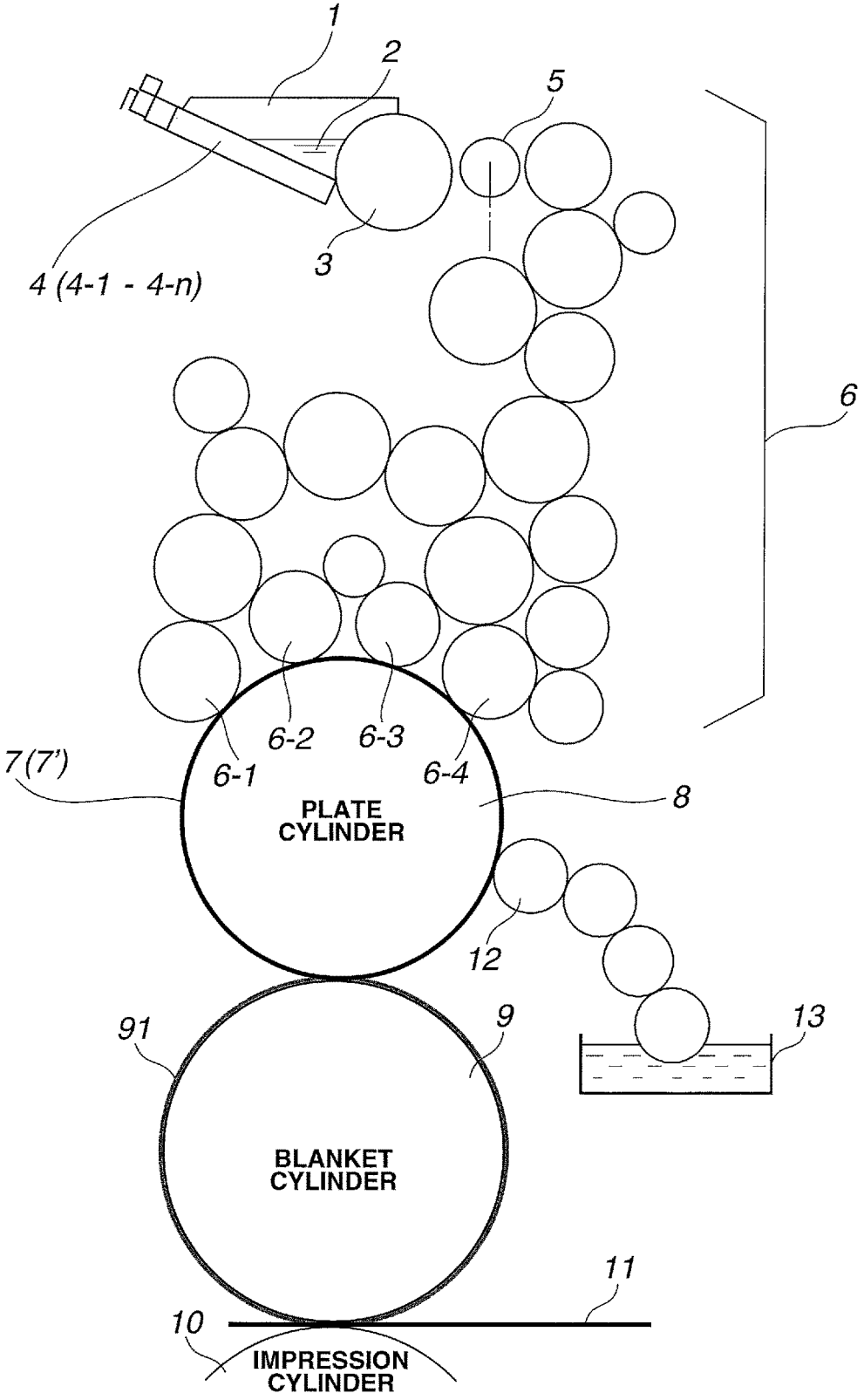
FIG. 17 is a view showing the main part of an ink supply device in a printing unit of each color of a printing press.
Figure 18A:
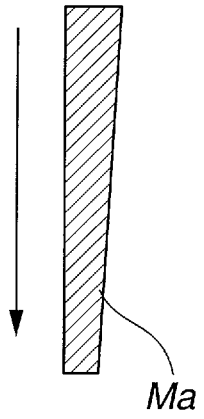
FIGS. 18A and 18B are views each showing an ink film thickness distribution formed on the ink roller group of the ink supply device.
Figure 18B:
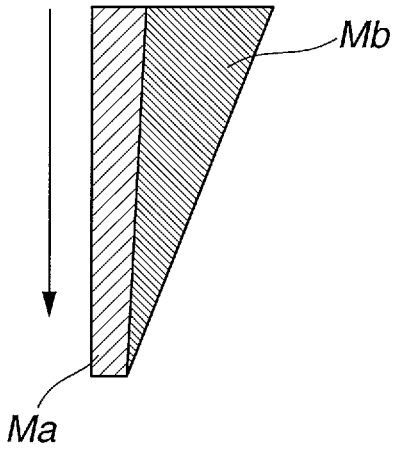

FIG. 2 is a view showing the main part of an ink supply device in each printing unit controlled by the print job switching control device 100. Referring to FIG. 2, the same reference numerals as in FIG. 17 denote the same or similar constituent elements as those described with reference to FIG. 17, and a description thereof will be omitted. In this ink supply device, an ink roller group 6 can be divided into a roller subgroup 6A on the upstream side and a roller subgroup 6B on the downstream side with respect to by a line L1 indicated by a dotted line in FIG. 2.

More specifically, a roller 6C located between the roller subgroup 6A on the upstream side and the roller subgroup 6B on the downstream side is axially supported by one end of a swing arm 14 that swings with respect to a fulcrum P1 as a pivot center. The roller group dividing/connecting air cylinder 116 is connected to the other end of the swing arm 14. Note that the swing arm 14 is indicated by an alternate long and short dashed line so as to be distinguished from other constituent elements.

In this structure, when the roller group dividing/connecting air cylinder 116 is extended (see FIG. 3), the swing arm 14 swings in the direction of an arrow A with respect to the fulcrum P1 as the pivot center. According to this swing, the outer surface of the roller 6C separates from the outer surface of a roller 6A1 located at the lowermost position of the ink flow path of the roller subgroup 6A on the upstream side. In addition, the outer surface of the roller 6C separates from the outer surface of a roller 6B1 located at the uppermost position of the ink flow path of the roller subgroup 6B on the downstream side. The ink roller group 6 is thus divided into the roller subgroup 6A on the upstream side and the roller subgroup 6B on the downstream side.

When the roller group dividing/connecting air cylinder 116 is retraced from this state, the swing arm 14 swings in the direction of an arrow B with respect to the fulcrum P1 as the pivot center. According to this swing, the outer surface of the roller 6C comes into contact with the outer surface of the roller 6A1 located at the lowermost position of the ink flow path of the roller subgroup 6A on the upstream side. In addition, the outer surface of the roller 6C comes into contact with the outer surface of the roller 6B1 located at the uppermost position of the ink flow path of the roller subgroup 6B on the downstream side (see FIG. 2). The roller subgroup 6A on the upstream side and the roller subgroup 6B on the downstream side are thus connected to restore the ink roller group 6.

The ink roller group 6 is provided with an ink scraper blade 15 that comes into contact with the outer surface of a roller 6A2 of the roller subgroup 6A on the upstream side and scrapes ink in the roller subgroup 6A on the upstream side and an ink receiver 16 that collects the ink scraped by the ink scraper blade 15. The ink scraper blade 15 is provided with the ink scraper blade on/off air cylinder 122. When scraping ink, the ink scraper blade on/off air cylinder 122 is retracted to bring the ink scraper blade 15 into contact with the outer surface of the roller 6A2 (see FIG. 4). When the ink scraper blade on/off air cylinder 122 is extended, the ink scraper blade 15 separates from the outer surface of the roller 6A2.

In the print job switching control device 100, the CPU 101 obtains various kinds of information given via the interfaces 127-1 to 127-10 and operates in accordance with a program stored in the ROM 103 while accessing the RAM 102 or the memory 126.

The rotary encoder 111 for drive motor generates a rotation pulse for each predetermined rotation angle of the printing press drive motor 109, and outputs it to the drive motor driver 110. The printing press home position detector 113 detects the home position in every rotation of the printing press, generates a home position detection signal, and outputs it to the printing press rotation counter 114.

The ink feed device 115 is provided for an ink ductor roller 5. When the ink feed device 115 is turned on, the feed operation of the ink ductor roller 5 starts. When the ink feed device 115 is turned off, the feed operation of the ink ductor roller 5 stops.

The dampening form roller on/off air cylinder 118 is provided for a dampening form roller 12. When the dampening form roller on/off air cylinder 118 is extended, the dampening form roller 12 transits to a throw-on state (a state in which the dampening form roller 12 is in contact with a printing plate 7 (7')). When the dampening form roller on/off air cylinder 118 is retracted, the dampening form roller 12 transits to a throw-off state (a state in which the dampening form roller 12 is apart from the printing plate 7 (7')).

The ink form roller on/off air cylinder 120 is provided for ink form rollers 6-1 to 6-4. When the ink form roller on/off air cylinder 120 is extended, the ink form rollers 6-1 to 6-4 transit to a throw-on state (a state in which the ink form rollers 6-1 to 6-4 are in contact with the printing plate 7 (7')). When the ink form roller on/off air cylinder 120 is retracted, the ink form rollers 6-1 to 6-4 transit to a throw-off state (a state in which the ink form rollers 6-1 to 6-4 are apart from the printing plate 7 (7')).

Figure 5A:
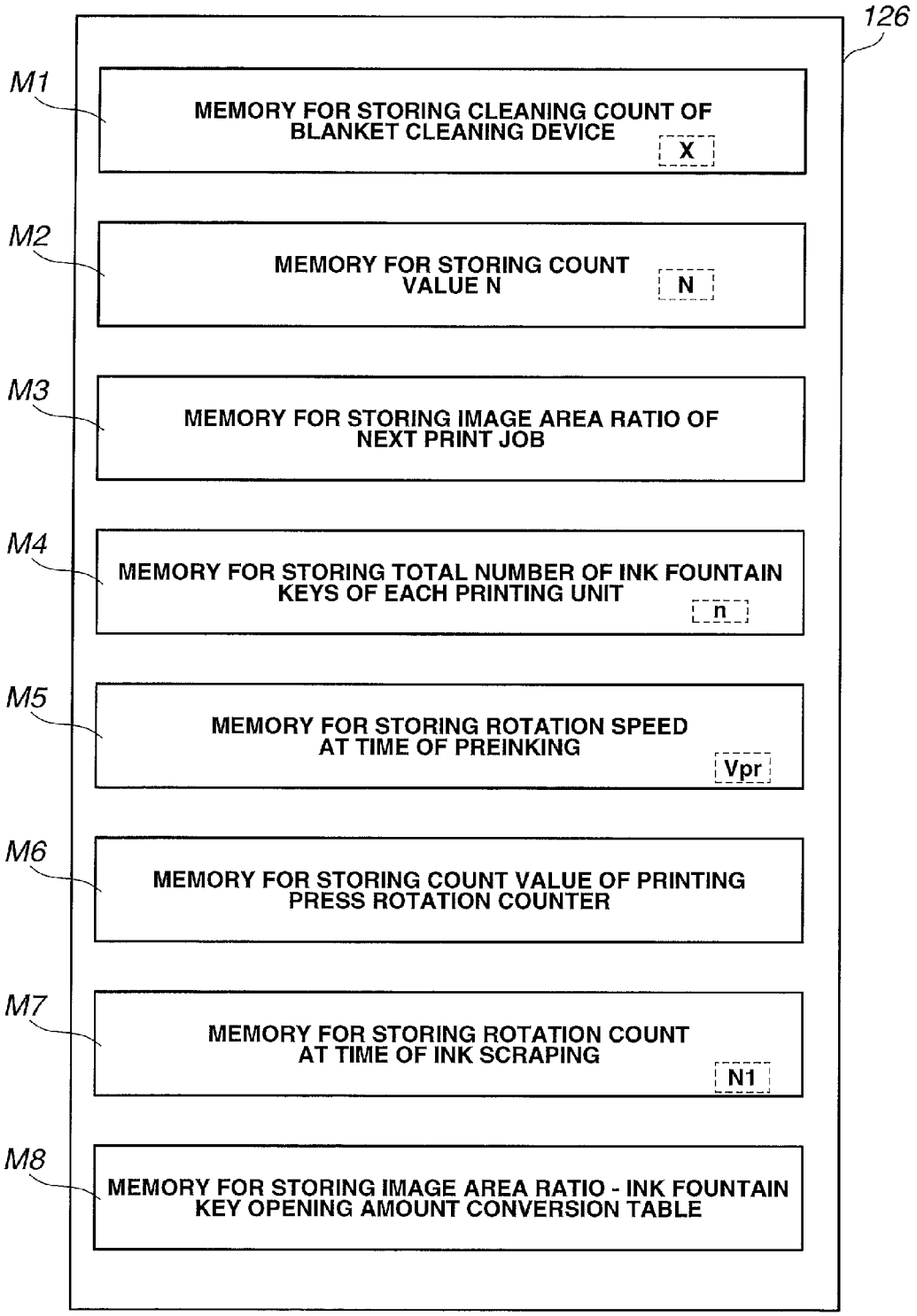
FIGS. 5A and 5B are views showing the contents of a memory in the print job switching control device.
Figure 5B:
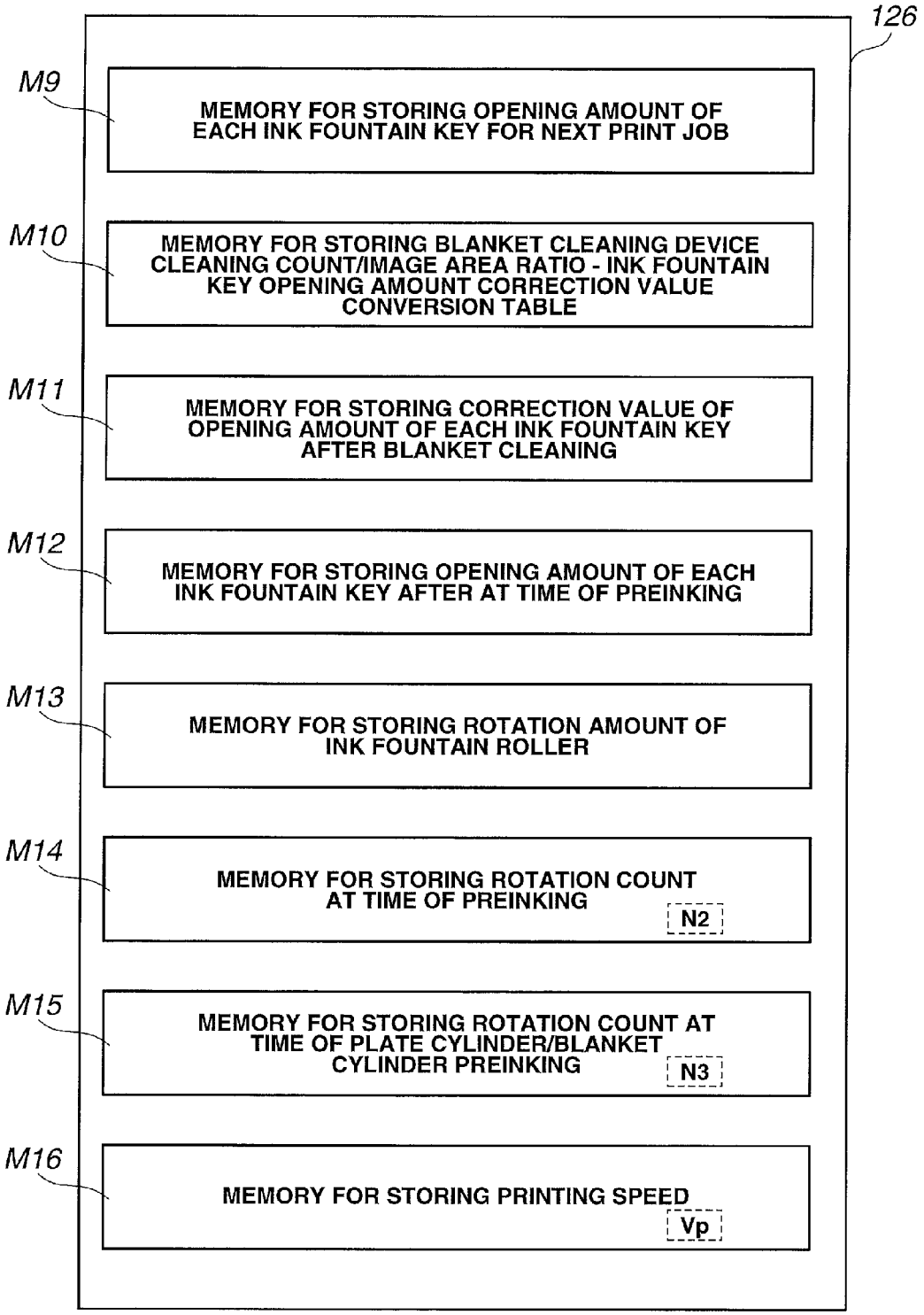

FIGS. 5A and 5B show the contents of the memory 126. The memory 126 is provided with memories M1 to M16. The memory M1 stores a cleaning count X of a blanket cleaning device (to be described later). The memory M2 stores a count value N. The memory M3 stores the image area ratio in a range of the printing plate of the next print job corresponding to each of ink fountain keys 4-1 to **4-*n*. The memory M4 stores the total number n of the ink fountain keys of each printing unit. The memory M5 stores a rotation speed Vpr of the printing press at the time of pre-inking. The memory M6 stores the count value N of the printing press rotation counter. The memory M7 stores a rotation count N1 of the printing press at the time of ink scraping. The memory M8** stores an image area ratio-ink fountain key opening amount conversion table.

The memory M9 stores the opening amounts of the ink fountain keys 4-1 to **4-*n* corresponding to the image of the printing plate of the next print job. The memory M10 stores a blanket cleaning device cleaning count/image area ratio-ink fountain key opening amount correction value conversion table. The memory M11 stores correction values of the opening amounts of the ink fountain keys 4-1 to 4-*n* after blanket cleaning. The memory M12 stores the opening amounts of the ink fountain keys 4-1 to 4-*n* at the time of pre-inking. The memory M13 stores the rotation amount of an ink fountain roller. The memory M14 stores a rotation count N2 of the printing press at the time of pre-inking. The memory M15 stores a rotation count N3 of the printing press at the time of plate cylinder/blanket cylinder pre-inking. The memory M16** stores a printing speed Vp.

Note that referring to FIG. 1, reference numeral 200 denotes an ink fountain roller control device that drives an ink fountain roller 3 in the ink supply device; 300-1 to **300-*n*, ink fountain key control devices that control the opening amounts of the ink fountain keys 4-1 to 4-*n* in the ink supply device; and 400**, a blanket cleaning device.

The blanket cleaning device 400 is provided for a blanket cylinder 9, as shown in FIG. 2. The blanket cleaning device 400 presses a cleaning cloth 401 against a blanket 91 mounted on the blanket cylinder 9 while making the cleaning cloth 401 in a tense state intermittently travel between a supply shaft and a takeup shaft, and sprays a solvent to the cleaning cloth 401 to clean the blanket 91 while rotating the blanket cylinder 9. Note that FIG. 2 does not illustrate the supply shaft, the takeup shaft, and the like.

Note that the ink fountain roller control device 200, the ink fountain key control devices 300-1 to **300-*n*, and the blanket cleaning device 400** are provided for the ink supply device of each color. In this embodiment, one ink supply device will be exemplified for the sake of simplicity. That is, the operation of one representative ink supply device will be described.

[Schematic Operation of Print Job Switching Control Device]

Before a description of the detailed operation of the print job switching control device 100, a schematic operation will be explained for easy understanding.

(1) Sheet feed is stopped, and simultaneously, printing using the printing plate 7 is stopped (a preceding print job is ended). When printing is stopped, impression-off is performed to separate the blanket cylinder 9 from a plate cylinder 8 and an impression cylinder 10. At the same time, the ink form rollers 6-1 to 6-4 are thrown off, and the dampening form roller 12 is thrown off so that they are separated from the plate cylinder 8 (see FIG. 3). In this case, an ink film thickness distribution Mc corresponding to the image of the printing plate 7 is left on the ink roller group 6, as indicated by step S1 in FIG. 6. That is, the ink film thickness distribution Mc of the preceding print job is left.

Figure 6:
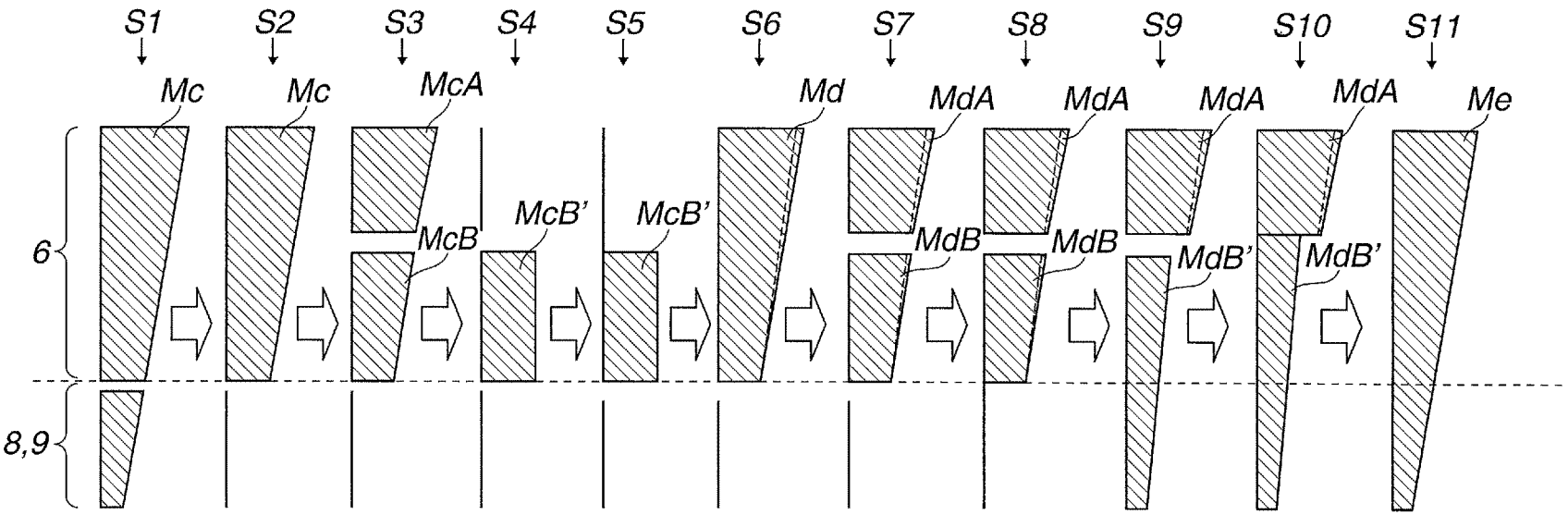
FIG. 6 is a view showing the process of forming an ink film thickness distribution for a next print job on the ink roller group, a plate cylinder, and a blanket cylinder at the time of print job switching using the print job switching control device.

(2) In the printing press stop state, the printing plate 7 mounted on the plate cylinder 8 is exchanged with the printing plate 7' of the next print job, and the blanket 91 on the blanket cylinder 9 is cleaned using a solvent (FIG. 6: step S2).

(3) The ink roller group 6 is divided into the roller subgroup 6A on the upstream side and the roller subgroup 6B on the downstream side (division at the time of removing). Accordingly, the ink film thickness distribution Mc on the ink roller group 6 is divided into an ink film thickness distribution McA on the roller subgroup 6A on the upstream side and an ink film thickness distribution McB on the roller subgroup 6B on the downstream side, as indicated by step S3 in FIG. 6.

(4) The rotation speed of the printing press is increased up to the rotation speed Vpr at the time of pre-inking. The ink scraper blade 15 is thrown on to the roller 6A2 in the roller subgroup 6A on the upstream side. In this state, the printing press is rotated constantly (the rotation count N1 at the time of ink scraping) to scrape the ink in the roller subgroup 6A on the upstream side (see FIG. 4). That is, the ink in the roller subgroup 6A on the upstream side is removed. Accordingly, the ink film thickness distribution McA on the roller subgroup 6A on the upstream side becomes almost zero, as indicated by step S4 in FIG. 6. At this time, the ink film thickness distribution on the roller subgroup 6B on the downstream side is evened by the rotation count N1 at the time of ink scraping and changes to a flat ink film thickness distribution McB'.

(5) The opening amounts of the ink fountain keys 4-1 to **4-*n* corresponding to the image of the printing plate 7' of the next print job are obtained. The obtained opening amounts of the ink fountain keys 4-1 to 4-*n* are corrected by correction values of the opening amounts of the ink fountain keys considering the influence of the solvent remaining on the blanket 91 to obtain corrected opening amounts. More specifically, the opening amounts of the ink fountain keys 4-1 to 4-*n* corresponding to the image of the printing plate 7' of the next print job are corrected in a direction to open the ink fountain keys, and the opening amounts of the ink fountain keys 4-1 to 4-*n* are set to the corrected opening amounts. In addition, the roller subgroup 6A on the upstream side and the roller subgroup 6B on the downstream side are connected to restore the ink roller group 6 (FIG. 6: step S5**).

In the state in which the rotation speed of the printing press is the rotation speed Vpr at the time of pre-inking, the ink ductor roller 5 is caused to perform the feed operation as many times as the rotation count N2 at the time of pre-inking to create a corrected ink film thickness distribution Md corresponding to the image of the printing plate 7' of the next print job on the ink roller group 6 (FIG. 6: step S6). Since the opening amounts of the ink fountain keys 4-1 to **4-*n* have been set to the corrected opening amounts, that is, the opening amounts are corrected in the direction to open the ink fountain keys, the ink film thickness distribution Md at this time is slightly thicker than the ink film thickness distribution corresponding to the image of the printing plate 7'** of the next print job.

(6) The feed operation of the ink ductor roller 5 is stopped, and the ink roller group 6 is redivided into the roller subgroup 6A on the upstream side and the roller subgroup 6B on the downstream side (division at the start of printing). Accordingly, the ink film thickness distribution Md on the ink roller group 6 is divided into an ink film thickness distribution MdA on the roller subgroup 6A on the upstream side and an ink film thickness distribution MdB on the roller subgroup 6B on the downstream side, as indicated by step S7 in FIG. 6.

(7) The ink form rollers 6-1 to 6-4 and the dampening form roller 12 are thrown on, and only the plate cylinder 8 and the blanket cylinder 9 are set in the throw-on state. That is, the ink form rollers 6-1 to 6-4 and the dampening form roller 12 are brought into contact with the plate surface of the printing plate 7', and the blanket cylinder 9 is thrown on to only the plate cylinder 8 (the feed operation is kept stopped). Accordingly, the roller subgroup 6B on the downstream side, the dampening form roller 12, the plate cylinder 8, and the blanket cylinder 9 are set in the throw-on state (FIG. 6: step S8).

(8) In this state, the printing press is rotated as many times as the rotation count N3 at the time of plate cylinder/blanket cylinder pre-inking, and the ink in the roller subgroup 6B on the downstream side is supplied to the blanket cylinder 9 and the printing plate 7' mounted on the plate cylinder 8 (FIG. 6: step S9). In this case, only the ink of the relatively thin ink film thickness distribution MdB in the roller subgroup 6B on the downstream side is supplied to the printing plate 7' and the blanket cylinder 9. This prevents the ink film thickness distribution on the printing plate 7' and the blanket cylinder 9 from becoming too thick.

Figure 7:
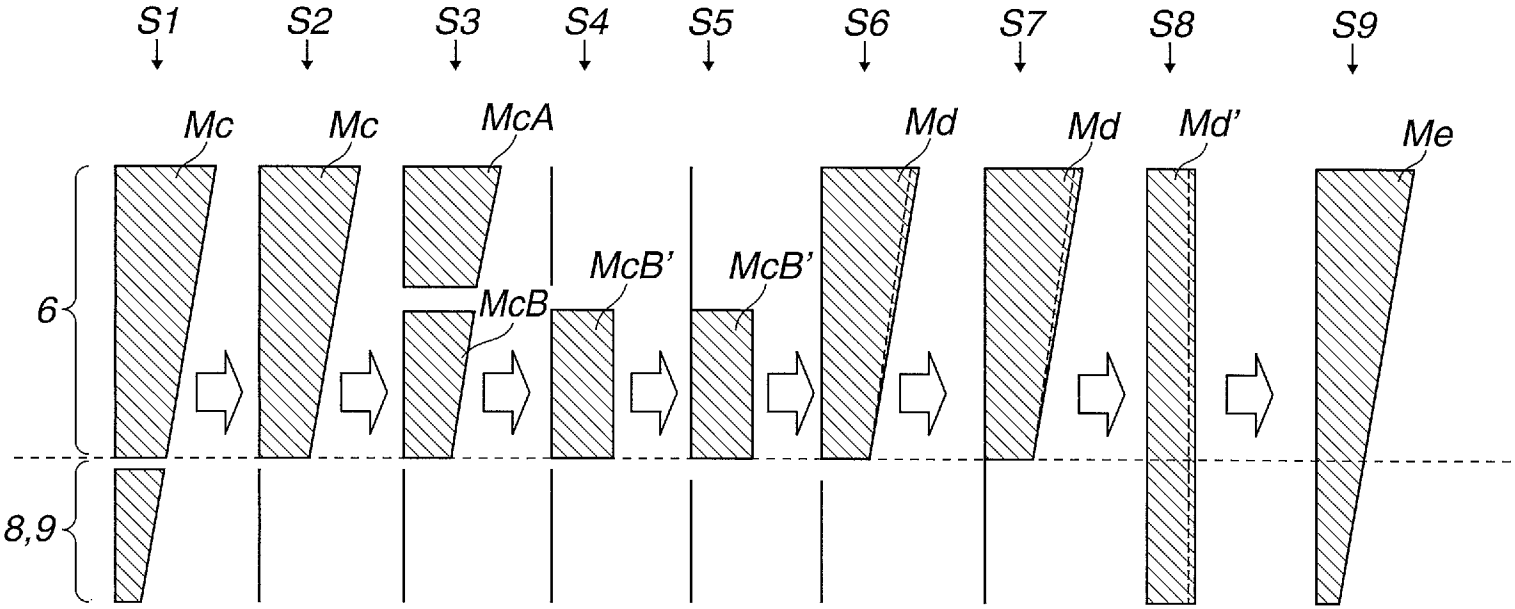
FIG. 7 is a view showing the process of forming an ink film thickness distribution corresponding to FIG. 6 in a case in which the ink film thickness distribution for the next print job is formed without dividing the ink roller group after pre-inking in the inking device.

That is, as shown in FIG. 7, after step S6 in FIG. 7 corresponding to step S6 in FIG. 6, the ink form rollers 6-1 to 6-4, the dampening form roller 12, the plate cylinder 8, and the blanket cylinder 9 may be set in the throw-on state without dividing the ink roller group 6 (FIG. 7: step S7), and the printing press may be rotated a predetermined number of times to supply the ink to the plate cylinder 8 and the blanket cylinder 9. In this case, all ink in the ink supply device is evened in the ink roller group 6, the plate cylinder 8, and the blanket cylinder 9. For this reason, an excessive amount of ink is supplied to the plate cylinder 8 and the blanket cylinder 9, and the ink film thickness distribution on the plate cylinder 8 and the blanket cylinder 9 becomes too thick (FIG. 7: step S8).

On the other hand, when the ink roller group 6 is divided into the roller subgroup 6A on the upstream side and the roller subgroup 6B on the downstream side after step S6 in FIG. 6 (FIG. 6: step S7), only the ink of the relatively thin ink film thickness distribution MdB in the roller subgroup 6B on the downstream side is supplied to the printing plate 7' and the blanket cylinder 9 (FIG. 6: step S9). This prevents the ink film thickness distribution on the printing plate 7' and the blanket cylinder 9 from becoming too thick.

(9) After that, the roller subgroup 6A on the upstream side and the roller subgroup 6B on the downstream side are thus reconnected to restore the ink roller group 6 (FIG. 6: step S10). The feed operation of the ink ductor roller 5 is performed. The blanket cylinder 9 is set in the throw-on state with respect to the impression cylinder 10 as well. That is, an impression-on state in which the plate cylinder 8, the blanket cylinder 9, and the impression cylinder 10 are in contact is obtained (see FIG. 2). Printing of the next print job is started using the printing plate 7' mounted on the plate cylinder 8.

In this case, the ink film thickness distribution (the ink film thickness distribution in final printing) at the time of printing of the next print job is created during printing. At this time, since an ink film thickness distribution MdB' in the roller subgroup 6B on the downstream side, the plate cylinder 8, and the blanket cylinder 9 is thin, the ink quickly flows from the upstream side to the downstream side, and an ink film thickness distribution Me during final printing is quickly formed on the ink roller group 6, the plate cylinder 8, and the blanket cylinder 9 (FIG. 6: step S11).

In the method shown in FIG. 7, the ink film thickness distribution on the plate cylinder 8 and the blanket cylinder 9 becomes too thick (FIG. 7: step S8). Hence, time is taken to form the ink film thickness distribution Me during final printing (FIG. 7: step S9), and much waste paper is generated. On the other hand, in this embodiment, since the ink film thickness distribution formed on the plate cylinder 8 and the blanket cylinder 9 is prevented from becoming too thick, the ink quickly flows from the upstream side to the downstream side, and the ink film thickness distribution during final printing is quickly formed on the ink roller group 6, the plate cylinder 8, and the blanket cylinder 9. Hence, after the exchange to the printing plate 7' and the start of printing of the next print job, a normal printed product is obtained in a short time.

In addition, since the ink film thickness distribution on the roller subgroup 6A on the upstream side and the roller subgroup 6B on the downstream side is corrected to be slightly thicker than the ink film thickness distribution corresponding to the image of the printing plate 7' of the next print job, a little large amount of ink is supplied to the printing plate 7' and the blanket cylinder 9 in steps S9 and S10 of FIG. 6. This can prevent a lightly printed product from being produced due to the influence of the solvent remaining on the blanket and eliminate a waste of printing materials.

Figure 8:
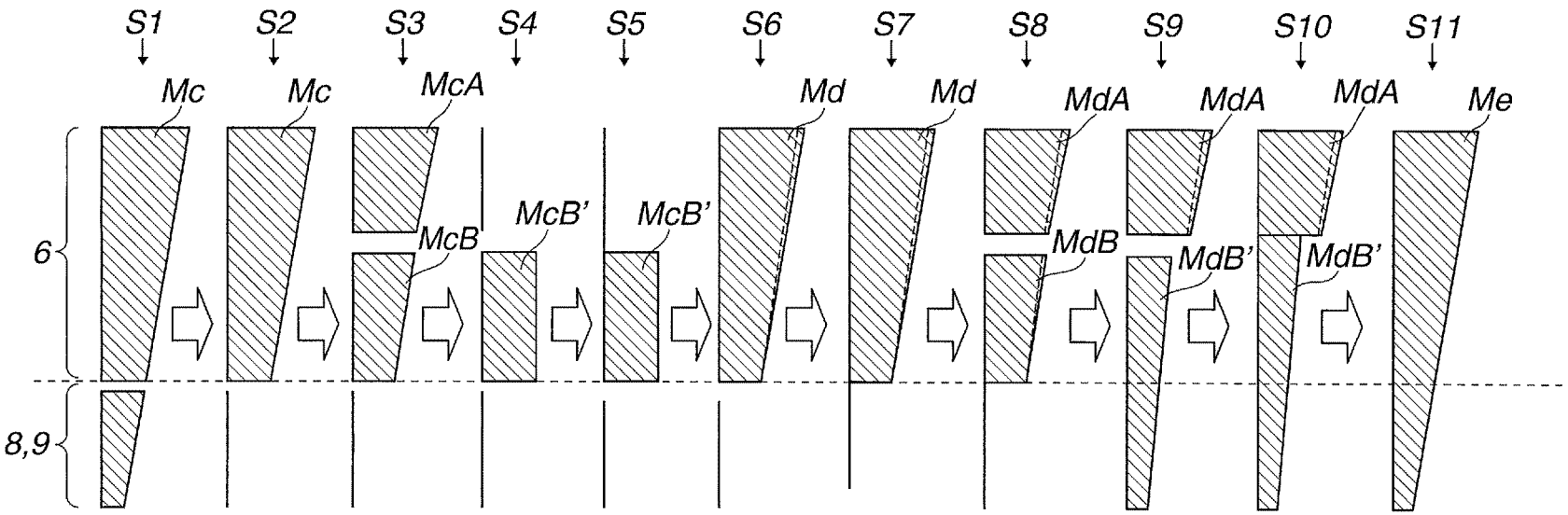
FIG. 8 is a view showing the process of forming an ink film thickness distribution corresponding to FIG. 6 in a case in which a roller subgroup on the downstream side, the plate cylinder, and the blanket cylinder are set in a throw-on state before dividing the ink roller group.

Note that in the schematic operation described with reference to FIG. 6, after the ink roller group 6 is divided into to the roller subgroup 6A on the upstream side and the roller subgroup 6B on the downstream side (FIG. 6: step S7), the roller subgroup 6B on the downstream side is set in the throw-on state with respect to the plate cylinder 8 (FIG. 6: step S8). However, as shown in FIG. 8, the roller subgroup 6B on the downstream side may be set in the throw-on state with respect to the plate cylinder 8 before the ink roller group 6 is divided into to the roller subgroup 6A on the upstream side and the roller subgroup 6B on the downstream side (FIG. 8: step S7). After that, the ink roller group 6 may be divided into the roller subgroup 6A on the upstream side and the roller subgroup 6B on the downstream side (FIG. 8: step S8).

[Detailed Operation of Print Job Switching Control Device]

Figure 9A:
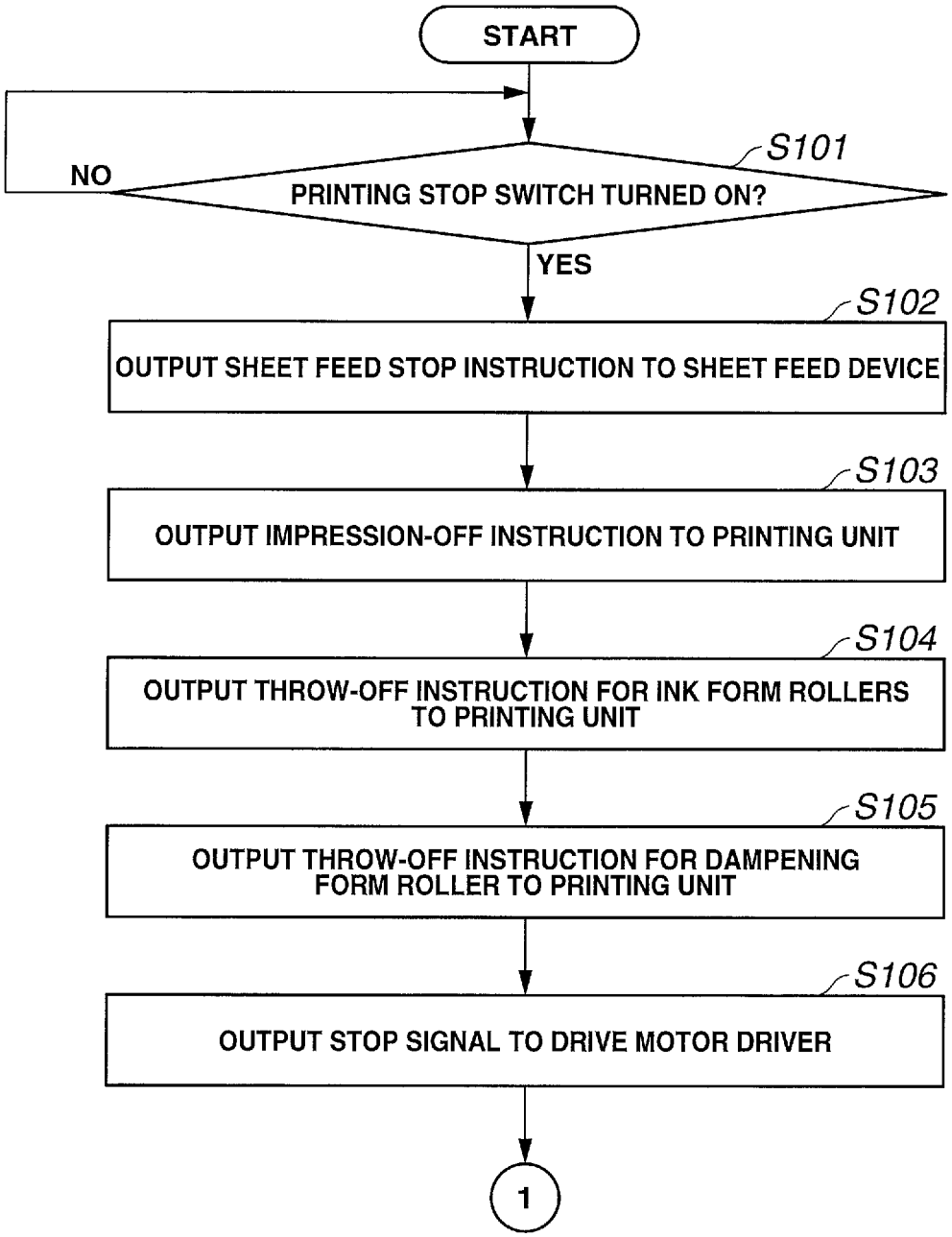
FIGS. 9A to 9O are flowcharts for explaining a detailed operation of the print job switching control device.

When switching a print job, the operator turns on the printing stop switch 107. Then, the CPU 101 confirms that the printing stop switch 107 is turned on (FIG. 9A: YES in step S101), outputs a sheet feed stop instruction to the sheet feed device 124 to stop sheet feed to the printing press (step S102), and outputs an impression-off instruction, a throw-off instruction for the ink form rollers, and a throw-off instruction for the dampening form roller to the printing unit 125 (steps S103, S104, and S105).

That is, the blanket cylinder 9 is thrown off from the plate cylinder 8 and the impression cylinder 10 based on the impression-off instruction. The ink form rollers 6-1 to 6-4 are thrown off and separated from the printing plate 7 based on the throw-off instruction for the ink form rollers. Additionally, the dampening form roller 12 is thrown off and separated from the printing plate 7 based on the throw-off instruction for the dampening form roller. The CPU 101 also outputs a stop signal to the drive motor driver 110 (step S106) to stop the drive motor 109. Accordingly, the printing press stops (FIG. 6: step S1).

[Blanket Cleaning]

Figure 9B:
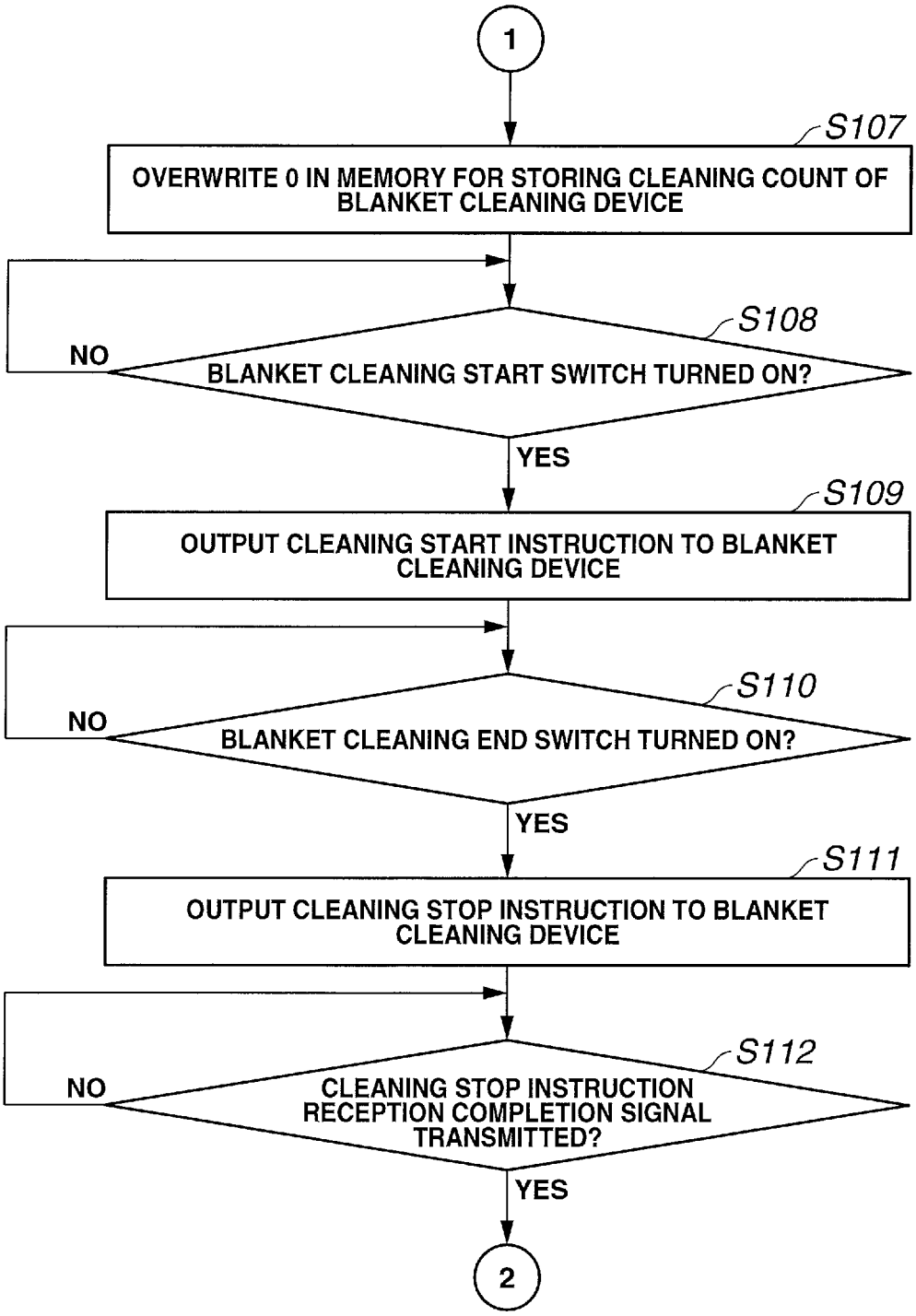

The CPU 101 sets the cleaning count X of the blanket cleaning device in the memory M1 to 0 (FIG. 9B: step S107), and waits for turning on of the blanket cleaning start switch 128 by the operator (step S108). When the blanket cleaning start switch 128 is turned on (YES in step S108), the CPU 101 outputs a cleaning start instruction to the blanket cleaning device 400 (step S109) until the blanket cleaning end switch 129 is turned on (YES in step S110).

Figure 9C:
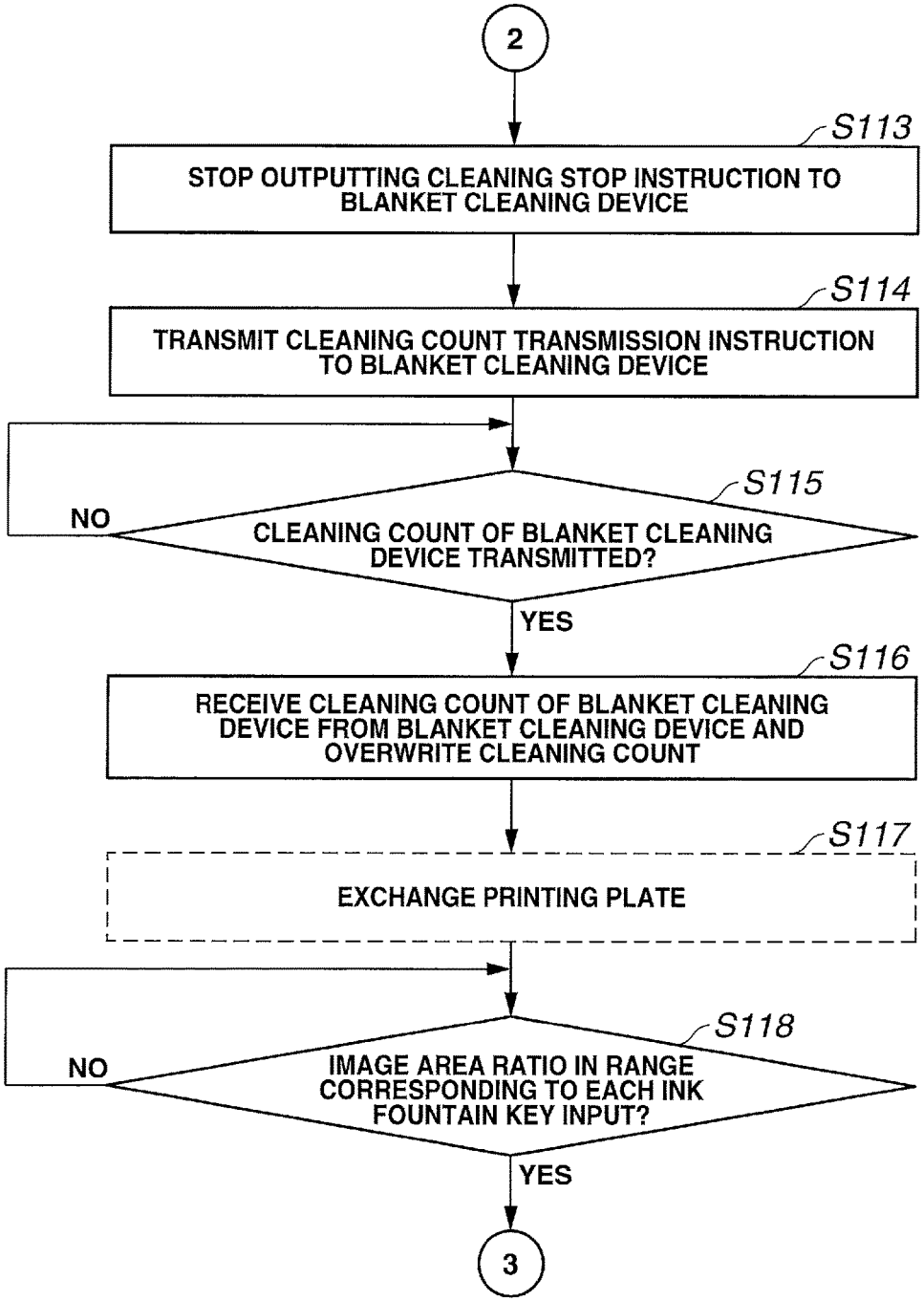

When the blanket cleaning end switch 129 is turned on (YES in step S110), the CPU 101 outputs a cleaning stop instruction to the blanket cleaning device 400 (step S111), confirms a blanket cleaning stop instruction reception completion signal sent from the blanket cleaning device 400 (YES in step S112), and stops outputting the cleaning stop instruction to the blanket cleaning device 400 (FIG. 9C: step S113).

The CPU 101 transmits a cleaning count transmission instruction to the blanket cleaning device 400 (step S114), receives the cleaning count of the blanket cleaning device sent from the blanket cleaning device 400 (step S115), and writes the cleaning count of the blanket cleaning device in the memory M1 as X (step S116). The cleaning count of the blanket cleaning device is the number of times of cleaning of the blanket 91 performed by the blanket cleaning device 400 while injecting a solvent during the time in which a cleaning start instruction is output from the CPU 101 to the blanket cleaning device 400. The operation of the blanket cleaning device 400 will be described later.

[Plate Exchange]

On the other hand, in the state in which the printing press is stopped, and the ink form rollers 6-1 to 6-4 and the dampening form roller 12 are thrown off (FIG. 6: step S1), the operator exchanges the printing plate 7 mounted on the plate cylinder 8 with the printing plate 7' of the next print job (step S117).

[Input of Image Area Ratio of Printing Plate of Next Print Job]

Next, the CPU 101 stores, in the memory M3, the image area ratios in ranges of the printing plate 7' corresponding to the ink fountain keys 4-1 to **4-*n*, which are input from the input device 104. Note that in this embodiment, to measure the image area ratios in the ranges of the printing plate 7' corresponding to the ink fountain keys 4-1 to 4-*n*, an "image area ratio measuring device" as described in patent literature 5 or 6 by the present applicant is used. An image area ratio measured using the "image area ratio measuring device" is written in a portable memory, and the portable memory with the image area ratio written in it is set in the input device 104, thereby inputting the image area ratio in the range of the printing plate 7' corresponding to each of the ink fountain keys 4-1 to 4-*n*. Note that the CPU 101 and the "image area ratio measuring device" may be connected online, and the image area ratios in the ranges of the printing plate 7' corresponding to the ink fountain keys 4-1 to 4-*n*** may directly be loaded from the "image area ratio measuring device".

Figure 9D:
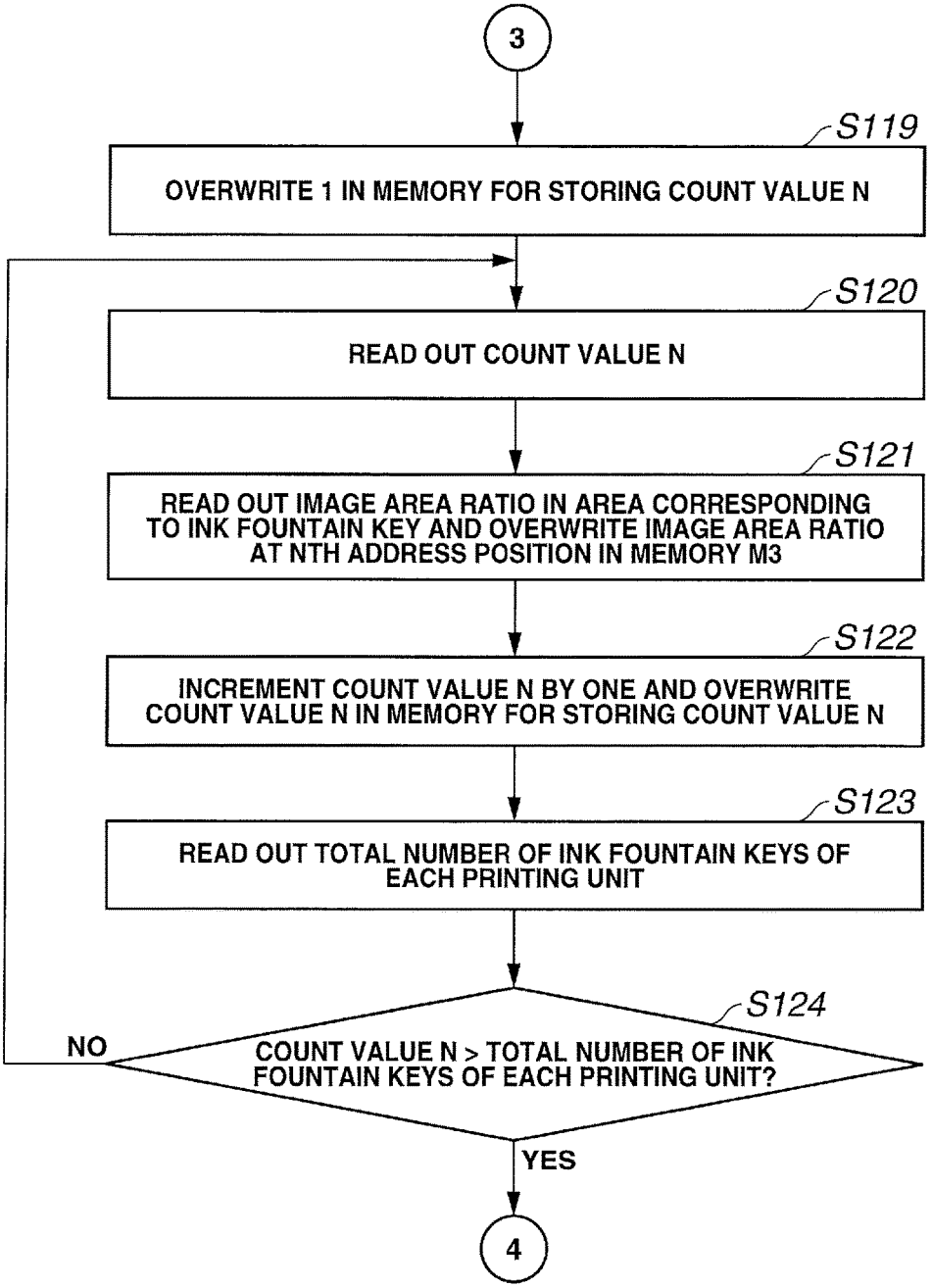

When the portable memory is set in the input device 104, that is, when the image area ratio in the range of the printing plate 7' corresponding to one of the ink fountain keys 4-1 to **4-*n* is input (YES in step S118), the CPU 101 sets the count value N in the memory M2 to 1 (FIG. 9D: step S119), reads out the count value N from the memory M2 (step S120), reads out the image area ratio in the range of the printing plate 7' corresponding to the Nth ink fountain key from the portable memory, and stores it at an address position for the Nth ink fountain key in the memory M3 (step S121**).

The count value N in the memory M2 is incremented by one (step S122), the total number n of ink fountain keys is read out from the memory M4 (step S123), and the processing operation in steps S120 to S124 is repeated until the count value N exceeds the total number n of ink fountain keys (YES in step S124). The image area ratios in the ranges of the printing plate 7' corresponding to the ink fountain keys 4-1 to **4-*n* are thus read out from the portable memory and stored in the memory M3 as the image area ratios in the ranges of the printing plate 7' of the next print job corresponding to the ink fountain keys 4-1 to 4-*n***.

[Division of Ink Roller Group]

Figure 9E:
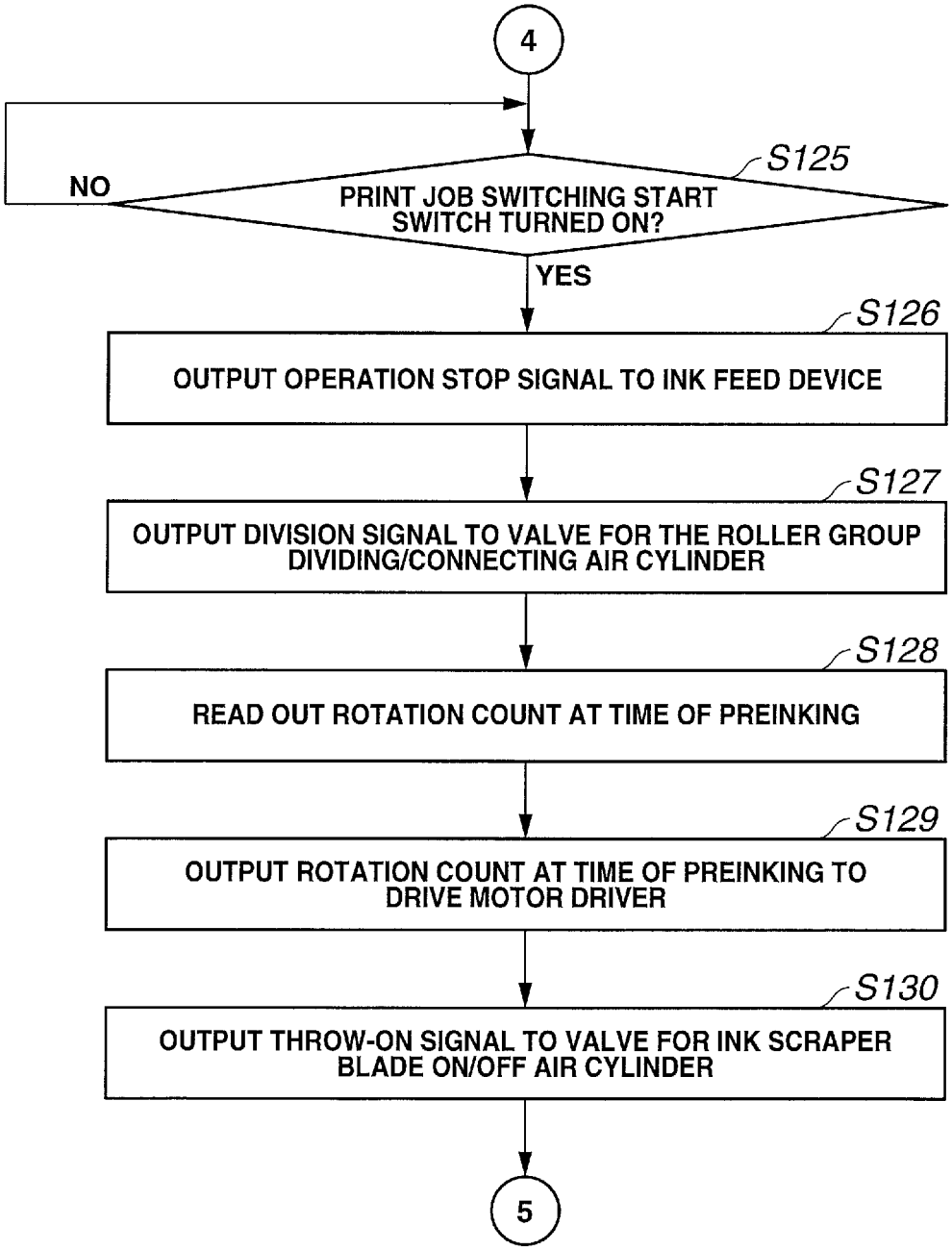

When the print job switching start switch 108 is turned on (FIG. 9E: YES in step S125), the CPU 101 outputs an operation stop signal to the ink feed device 115 (step S126) to stop the feed operation of the ink ductor roller 5. The CPU 101 outputs a division signal to the valve 117 for roller group dividing/connecting air cylinder (step S127) to divide the ink roller group 6 into the roller subgroup 6A on the upstream side and the roller subgroup 6B on the downstream side (see FIG. 3).

The ink film thickness distribution Mc on the ink roller group 6 is thus divided into the ink film thickness distribution McA on the roller subgroup 6A on the upstream side and the ink film thickness distribution McB on the roller subgroup 6B on the downstream side, as indicated by step S3 in FIG. 6.

[Ink Scraping in Roller Subgroup on Upstream Side]

Next, the CPU 101 reads out the rotation speed Vpr at the time of pre-inking from the memory M5 (step S128), and outputs the rotation speed Vpr at the time of pre-inking to the drive motor driver 110 via the D/A converter 112 (step S129). Accordingly, the printing press starts rotating, and its speed increases up to the rotation speed Vpr at the time of pre-inking.

Figure 4:
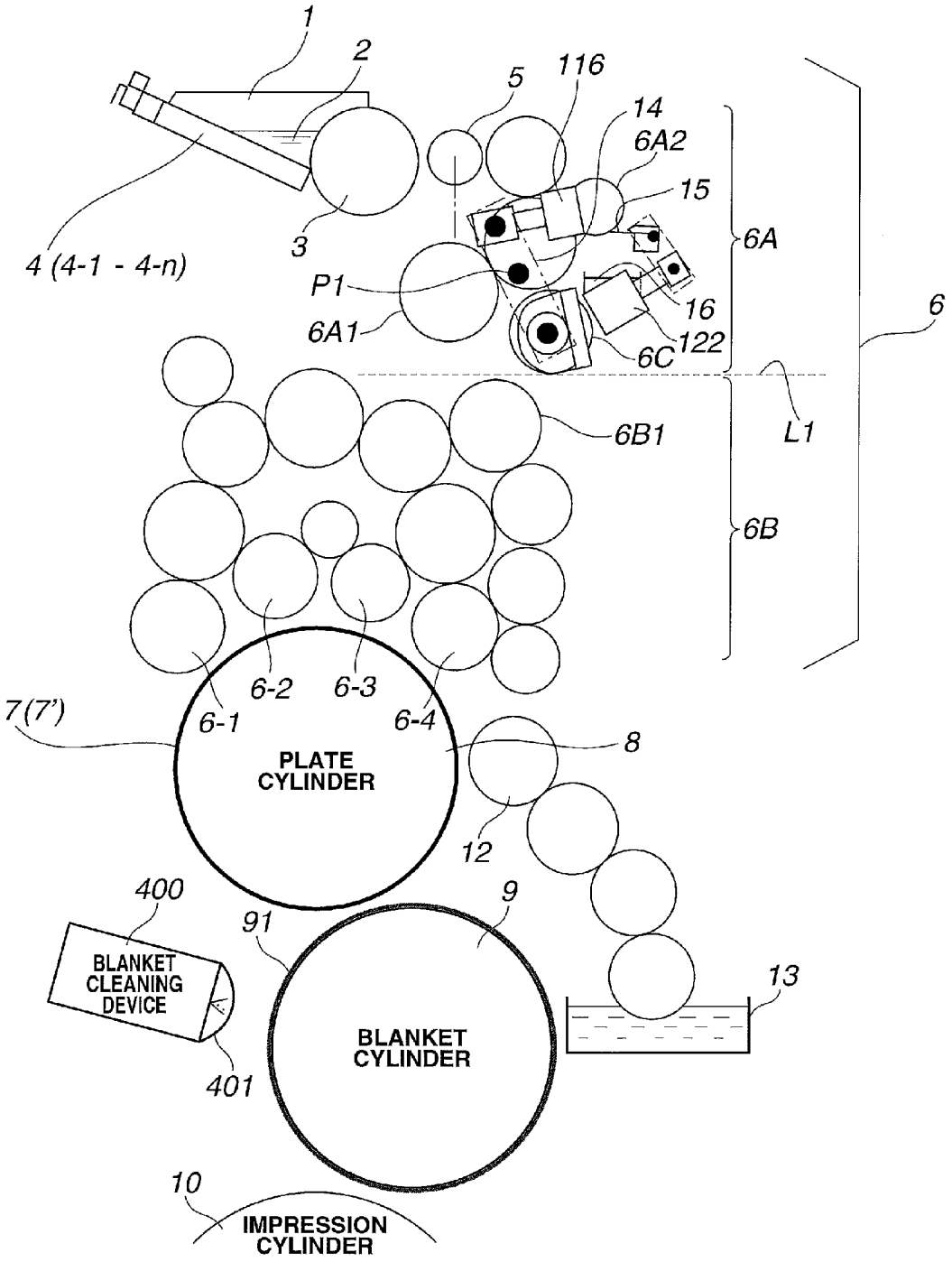
FIG. 4 is a view showing the main part of the ink supply device in the printing unit controlled by the print job switching control device (a state in which the ink roller group is divided, and ink in a roller subgroup on the upstream side is scraped by a blade)

The CPU 101 outputs a throw-on signal to the valve 123 for ink scraper blade on/off air cylinder (step S130). Accordingly, the ink scraper blade on/off air cylinder 122 retracts to bring the ink scraper blade 15 into contact with the outer surface of the roller 6A2, as shown in FIG. 4, and scraping of the ink (removal of the ink) in the roller subgroup 6A on the upstream side starts.

Figure 9F:
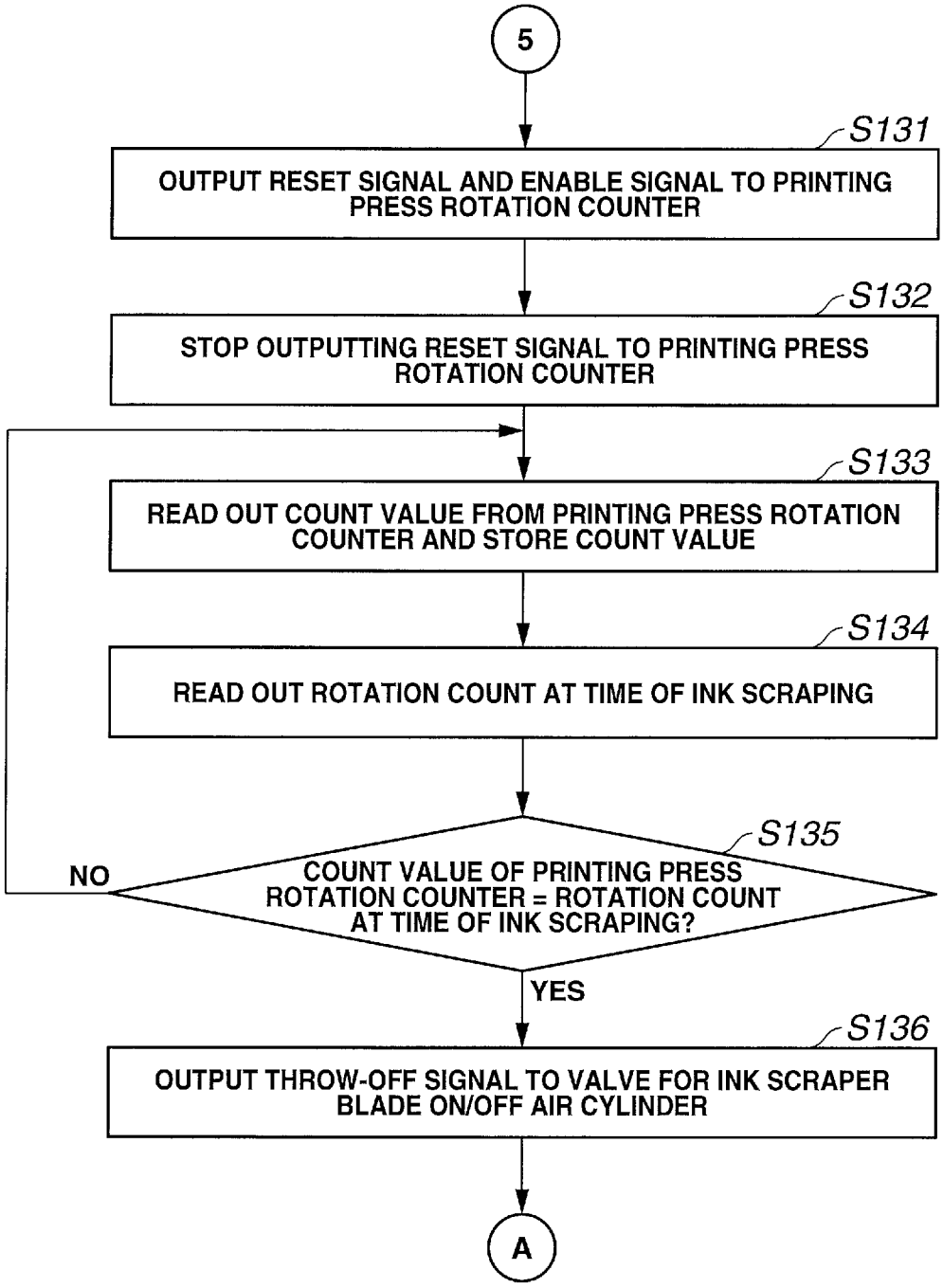

The CPU 101 continues the removal of the ink in the roller subgroup 6A on the upstream side until the rotation count of the printing press reaches the rotation count N1 at the time of ink scraping in the memory M7. That is, after outputting the throw-on signal to the valve 123 for ink scraper blade on/off air cylinder (step S130), the CPU 101 outputs a reset signal and an enable signal to the printing press rotation counter 114 (FIG. 9F: step S131), stops outputting the reset signal to the printing press rotation counter 114 (step S132), and causes the printing press rotation counter 114 to start the count operation from zero. The CPU 101 reads out the count value from the printing press rotation counter 114 and stores it in the memory M6 (step S133), reads out the rotation count N1 at the time of ink scraping in the memory M7 (step S134), and repeats the processing operation in steps S133 to S135 until the count value of the printing press rotation counter 114 reaches the rotation count N1 at the time of ink scraping (YES in step S135).

When the count value of the printing press rotation counter 114 reaches the rotation count N1 at the time of ink scraping (YES in step S135), the CPU 101 outputs a throw-off signal to the valve 123 for ink scraper blade on/off air cylinder (step S136), thereby completing the removal of the ink in the roller subgroup 6A on the upstream side.

Accordingly, the ink film thickness distribution McA on the roller subgroup 6A on the upstream side becomes almost zero, as indicated by step S4 in FIG. 6. At this time, the ink film thickness distribution on the roller subgroup 6B on the downstream side is evened by the rotation count N1 at the time of ink scraping and changes to the flat ink film thickness distribution McB'.

[Calculation and Correction of Opening Amounts of Ink Fountain Keys Corresponding to Image on Printing Plate of Next Print Job and Setting to Corrected Opening Amounts (Opening Amounts in Pre-Inking)]

Figure 9G:
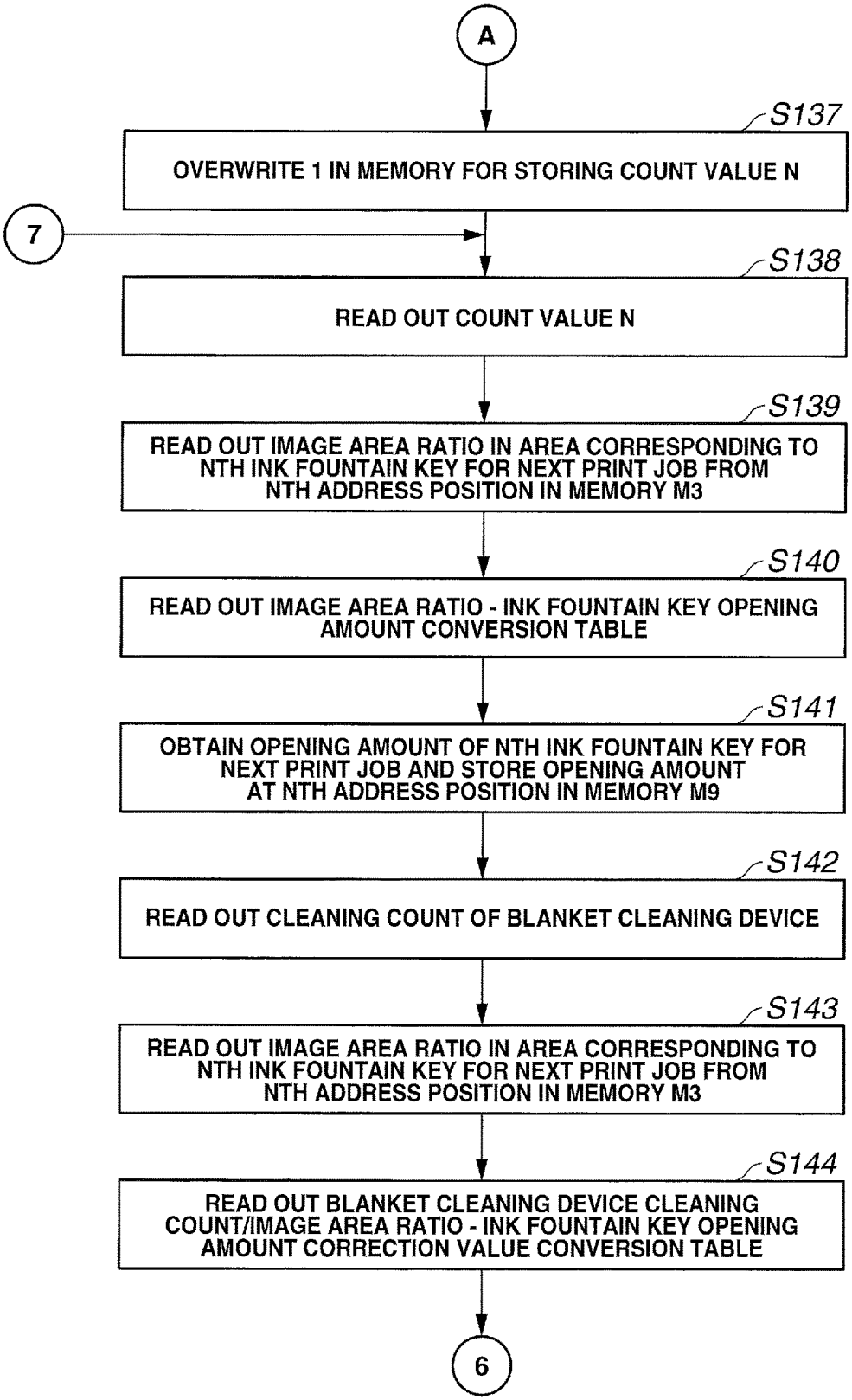

Next, the CPU 101 sets the count value N in the memory M2 to 1 (FIG. 9G: step S137), reads out the count value N from the memory M2 (step S138), and reads out the image area ratio in the range corresponding to the Nth ink fountain key for the next print job from the address position for the Nth ink fountain key in the memory M3 (step S139).

The CPU 101 then reads out the image area ratio-ink fountain key opening amount conversion table in the memory M8 (step S140). Using the image area ratio-ink fountain key opening amount conversion table, the CPU 101 obtains the opening amount of the Nth ink fountain key for the next print job (the opening amount of the Nth ink fountain key corresponding to the image of the printing plate 7' of the next print job) from the image area ratio in the range corresponding to the Nth ink fountain key for the next print job, and stores the obtained opening amount of the Nth ink fountain key for the next print job at an address position for the Nth ink fountain key in the memory M9 (step S141).

Figure 9H:
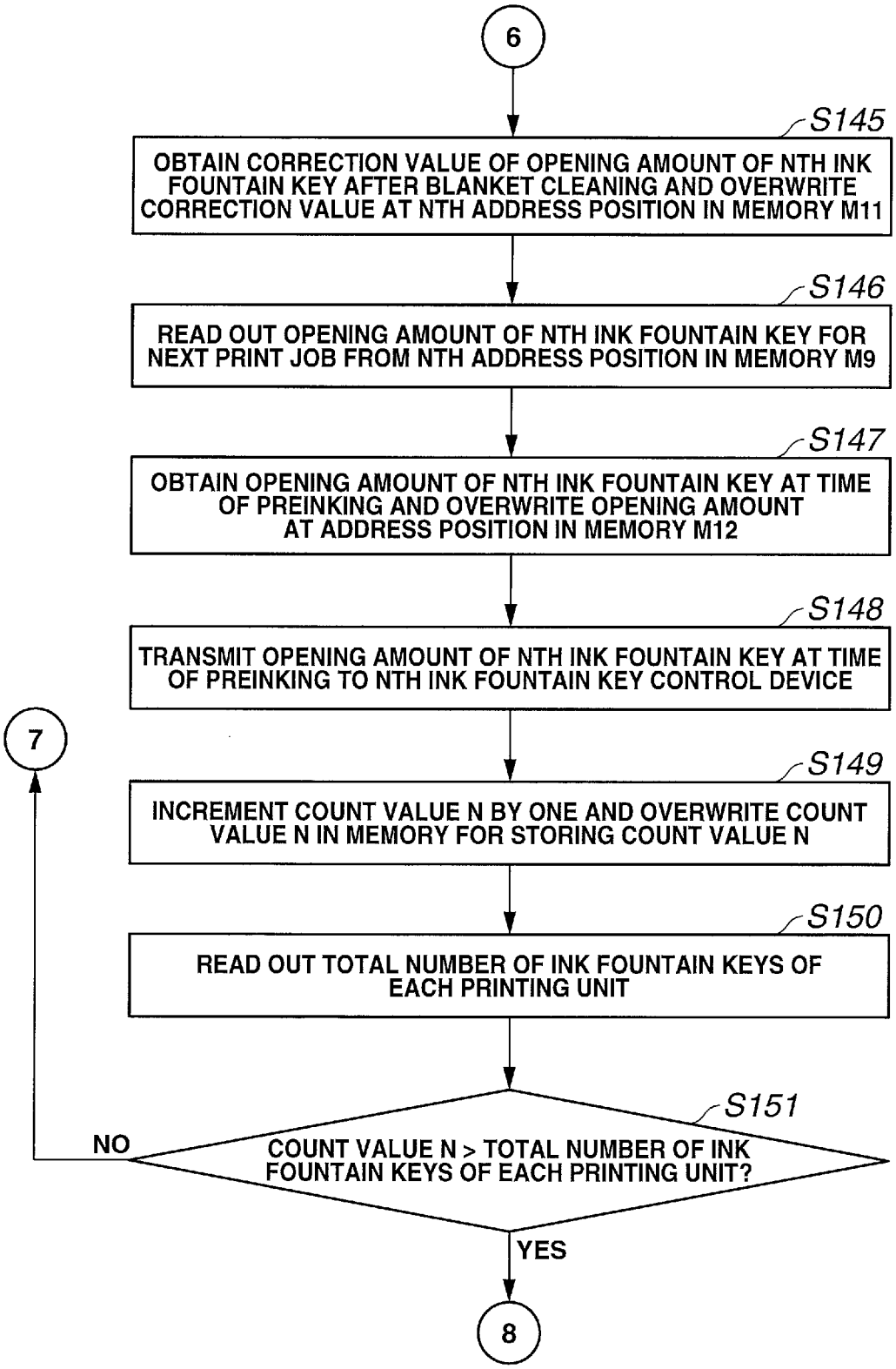

The CPU 101 reads out the cleaning count X of the blanket cleaning device in the memory M1 (step S142), reads out the image area ratio in the range corresponding to the Nth ink fountain key for the next print job from the Nth address position in the memory M3 (step S143), and reads out the blanket cleaning device cleaning count/image area ratio-ink fountain key opening amount correction value conversion table in the memory M10 (step S144). Using the blanket cleaning device cleaning count/image area ratio-ink fountain key opening amount correction value conversion table, the CPU 101 obtains the correction value of the opening amount of the Nth ink fountain key after blanket cleaning from the cleaning count X of the blanket cleaning device and the image area ratio in the range corresponding to the Nth ink fountain key for the next print job, and stores the correction value at the Nth address position in the memory M11 (FIG. 9H: step S145).

Next, the CPU 101 reads out the opening amount of the Nth ink fountain key for the next print job from the Nth address position in the memory M9 (step S146), adds the correction value of the opening amount of the Nth ink fountain key after blanket cleaning to the opening amount of the Nth ink fountain key for the next print job to obtain the opening amount of the Nth ink fountain key at the time of pre-inking, stores the opening amount at the Nth address position in the memory M12 (step S147), and also transmits it to the Nth ink fountain key control device 300 (step S148). The CPU 101 increments the count value N in the memory M2 by one (step S149), reads out the total number n of ink fountain keys from the memory M4 (step S150), and repeats the processing operation in steps S138 to S151 until the count value N exceeds the total number n of ink fountain keys (YES in step S151).

The opening amounts of the ink fountain keys 4-1 to **4-*n* corresponding to the image of the printing plate 7' corresponding to the ink fountain keys 4-1 to 4-*n* are thus obtained. The opening amounts are corrected by the correction values of the opening amounts of the ink fountain keys after blanket cleaning, and stored in the memory M12 as corrected opening amounts and transmitted to the ink fountain key control devices 300-1 to 300-*n***.

[Confirmation of Completion of Setting of Opening Amounts of Ink Fountain Keys]

Figure 9I:
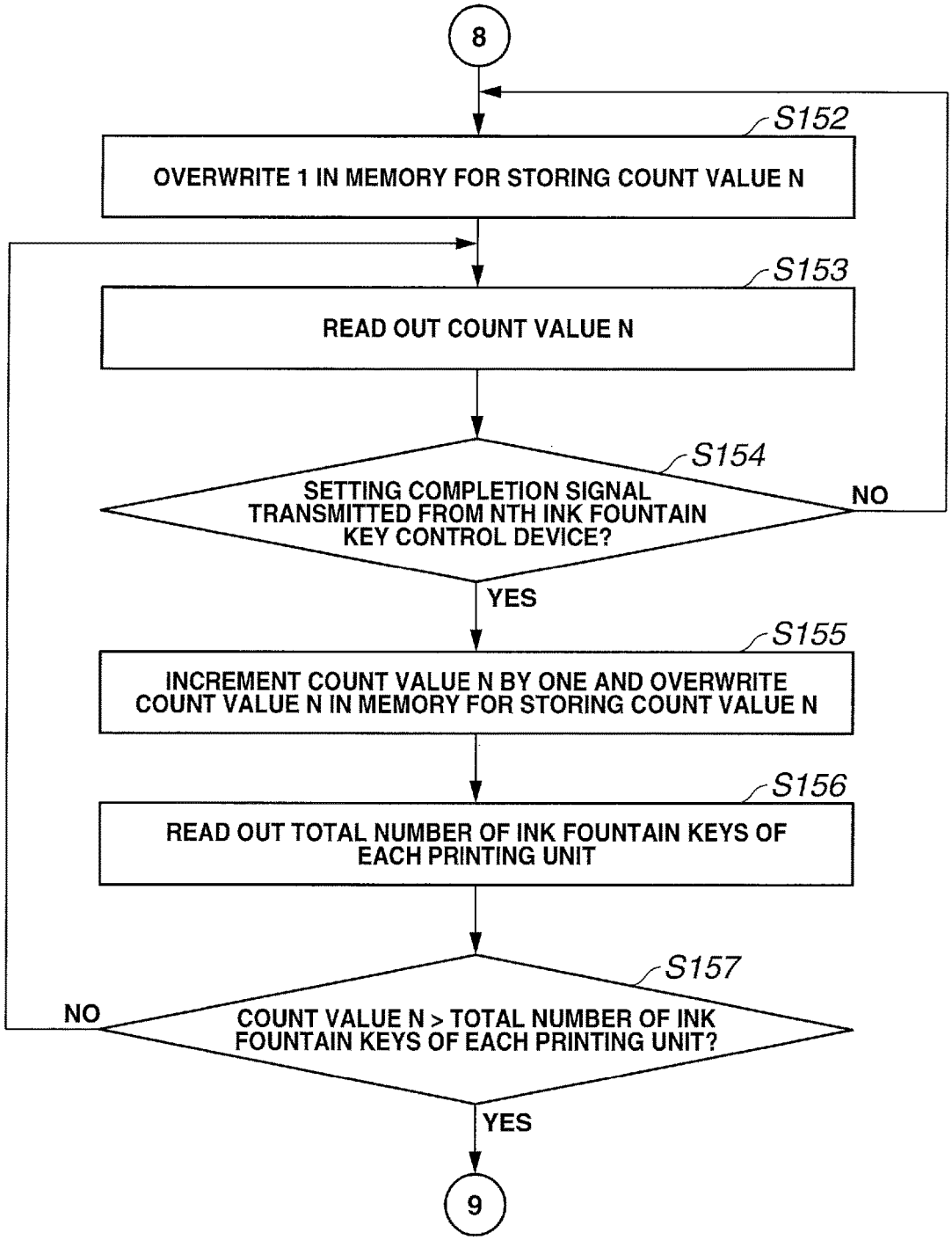

Next, the CPU 101 sets the count value N in the memory M2 to 1 (FIG. 9I: step S152), reads out the count value N from the memory M2 (step S153), and confirms the presence/absence of an ink fountain key opening amount setting completion signal from the Nth ink fountain key control device 300 (step S154).

If the ink fountain key opening amount setting completion signal is not transmitted from the Nth ink fountain key control device 300 (NO in step S154), the process returns to step S152 to set the count value N in the memory M2 to 1, and steps S153 and S154 are repeated.

If the ink fountain key opening amount setting completion signal is transmitted from the Nth ink fountain key control device 300 (YES in step S154), the CPU 101 increments the count value N in the memory M2 by one (step S155), reads out the total number n of ink fountain keys from the memory M4 (step S156), and compares the count value N with the total number n of ink fountain keys (step S157).

Figure 9J:
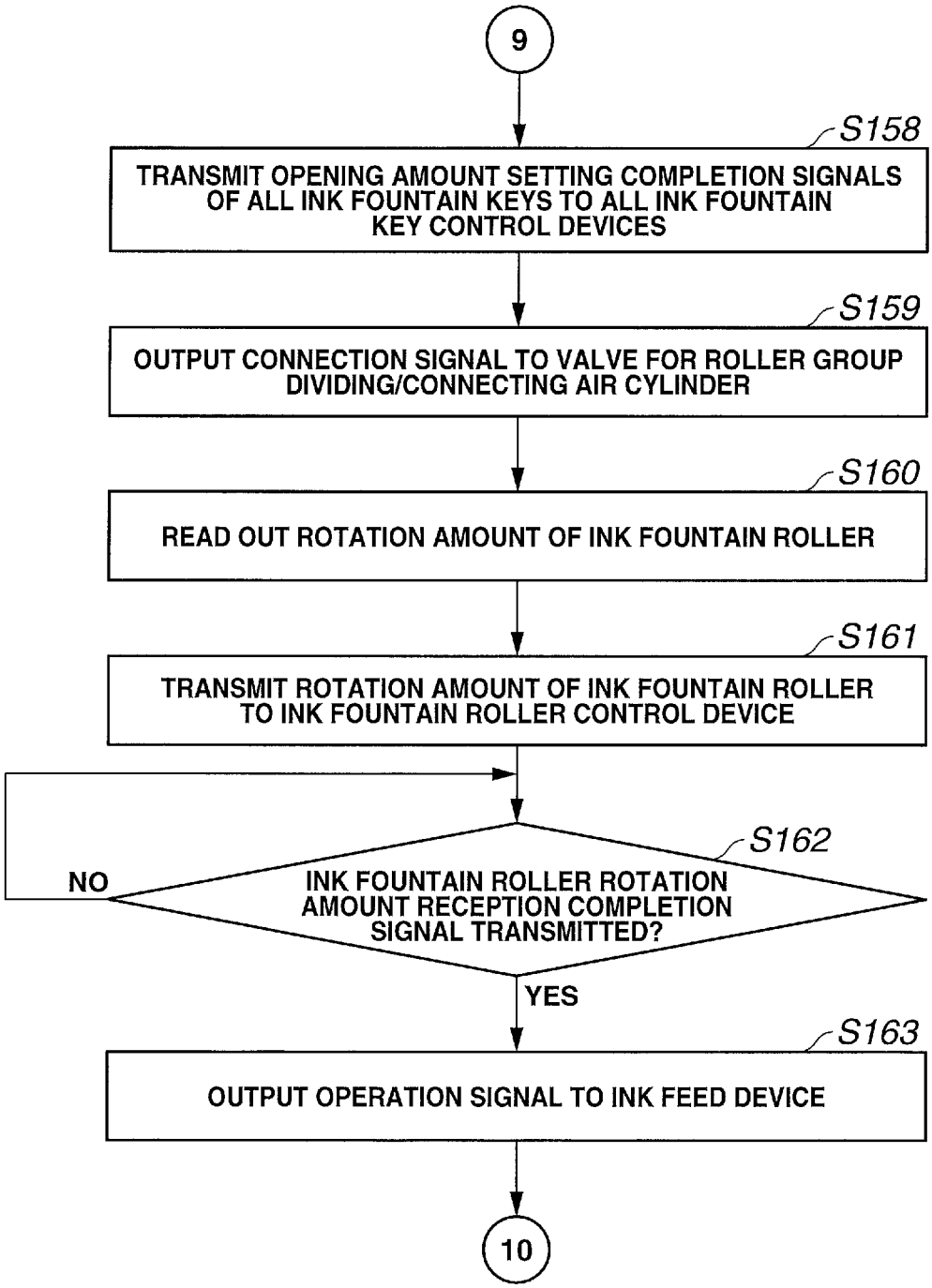

The CPU 101 repeats the processing operation in steps S153 to S157 until the count value N matches the total number n of ink fountain keys. If the count value N exceeds the total number n of ink fountain keys (YES in step S157), that is, upon confirming that the setting completion signals are transmitted from all the ink fountain key control devices 300, the CPU 101 determines that the setting of the opening amounts of the ink fountain keys is completed, and transmits the opening amount setting completion signals of all ink fountain keys to all the ink fountain key control devices 300 (300-1 to **300-*n*) (FIG. 9J: step S158**).

[Connection of Ink Roller Group]

Next, the CPU 101 outputs a connection signal to the valve 117 for roller group dividing/connecting air cylinder (step S159) to connect the roller subgroup 6A on the upstream side and the roller subgroup 6B on the downstream side to restore the ink roller group 6 (FIG. 6: step S5).

[Pre-Inking in Inking Device (Formation of Ink Film Thickness Distribution)]

Figure 9K:
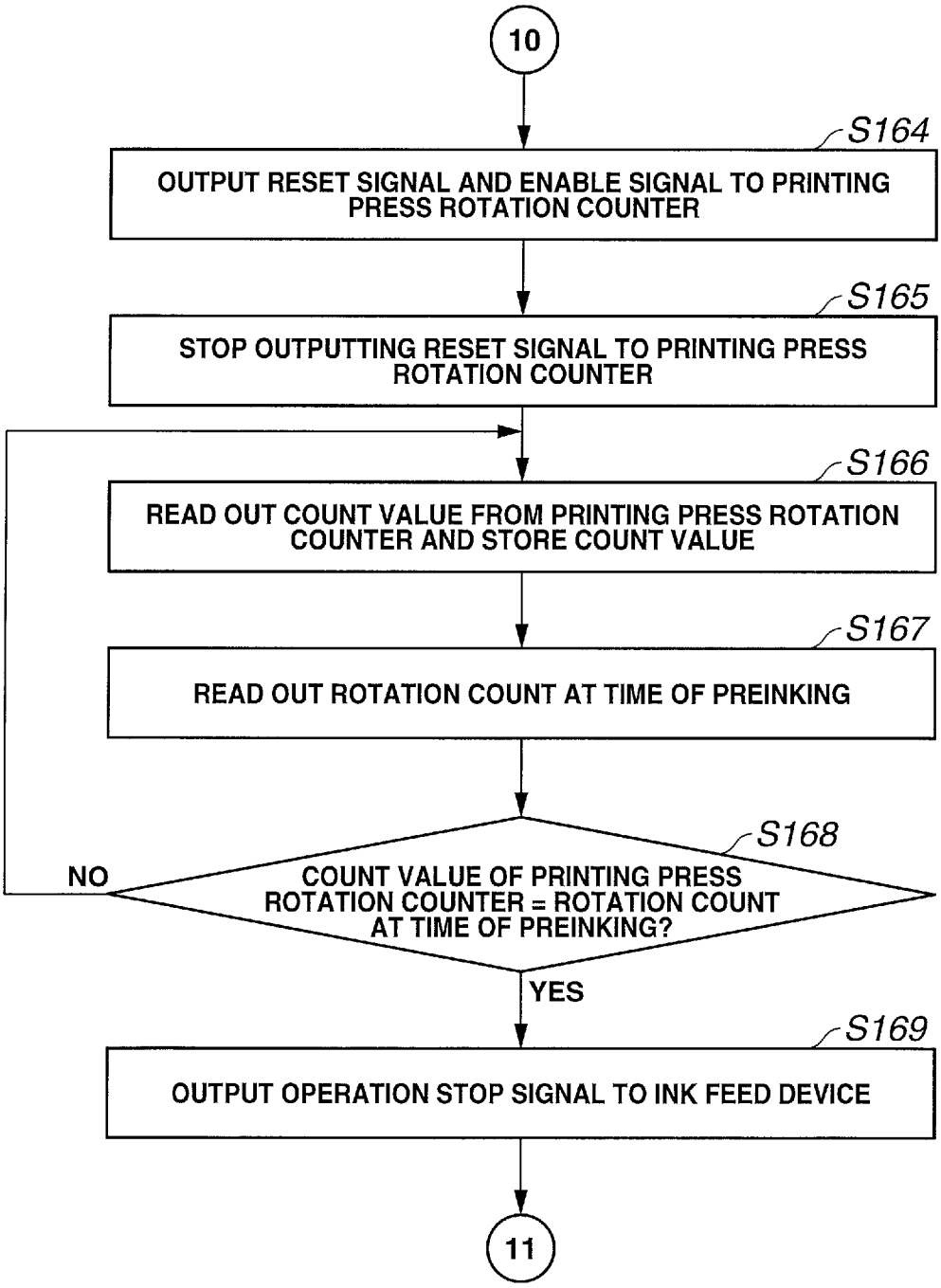

Next, the CPU 101 reads out the rotation amount of the ink fountain roller stored in the memory M13 (step S160), and transmits the readout rotation amount of the ink fountain roller to the ink fountain roller control device 200 (step S161). Upon receiving an ink fountain roller rotation amount reception completion signal from the ink fountain roller control device 200 (YES in step S162), the CPU 101 outputs an operation signal to the ink feed device 115 (step S163) to start the feed operation of the ink ductor roller 5. The CPU 101 continues the feed operation of the ink ductor roller 5 until the rotation count of the printing press reaches the rotation count N2 at the time of pre-inking in the memory M14 (FIG. 9K: steps S164 to S168).

That is, the CPU 101 outputs a reset signal and an enable signal to the printing press rotation counter 114 (step S164), stops outputting the reset signal to the printing press rotation counter 114 (step S165), and causes the printing press rotation counter 114 to start the count operation from zero. The CPU 101 reads out the count value from the printing press rotation counter 114 and stores it in the memory M6 (step S166), reads out the rotation count N2 at the time of pre-inking in the memory M14 (step S167), and repeats the processing operation in steps S166 to S168 until the count value of the printing press rotation counter 114 reaches the rotation count N2 at the time of pre-inking (YES in step S168).

When the count value of the printing press rotation counter 114 reaches the rotation count N2 at the time of pre-inking (YES in step S168), the CPU 101 outputs an operation stop signal to the ink feed device 115 to stop the feed operation of the ink ductor roller 5 (step S169).

Accordingly, the corrected ink film thickness distribution Md corresponding to the image of the printing plate 7' of the next print job is formed on the ink roller group 6 (FIG. 6: step S6).

[Setting to Opening Amounts of Ink Fountain Keys Corresponding to Image on Printing Plate of Next Print Job]

Figure 9L:
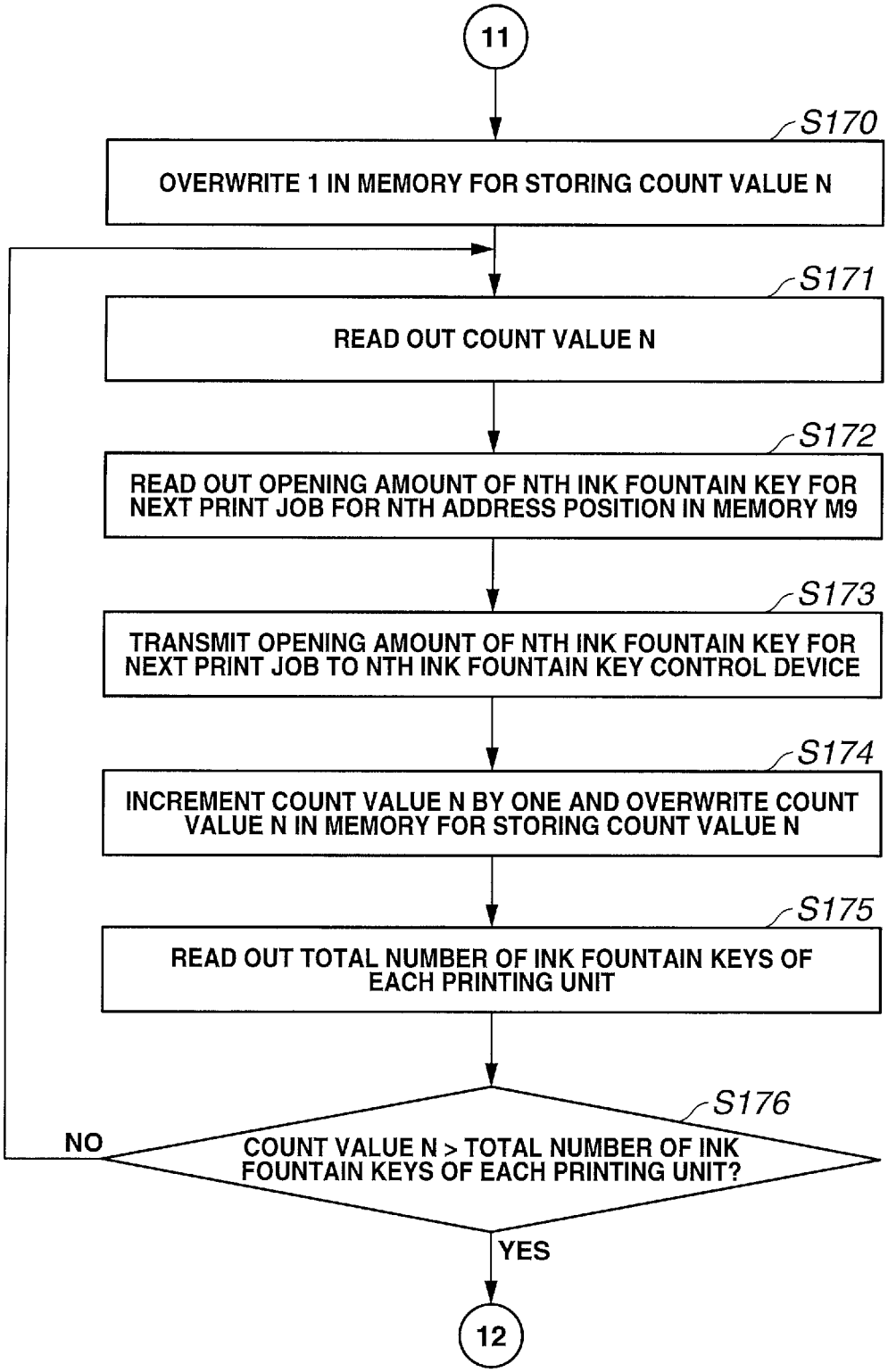

Next, the CPU 101 sets the count value N in the memory M2 to 1 (FIG. 9L: step S170), reads out the count value N from the memory M2 (step S171), reads out the opening amount of the Nth ink fountain key for the next print job from the address position for the Nth ink fountain key in the memory M9 (step S172), and transmits it to the Nth ink fountain key control device 300 (step S173). The CPU 101 increments the count value N in the memory M2 by one (step S174), reads out the total number n of ink fountain keys from the memory M4 (step S175), and repeats the processing operation in steps S171 to S176 until the count value N exceeds the total number n of ink fountain keys (YES in step S176).

The opening amounts of the ink fountain keys 4-1 to **4-*n* corresponding to the image of the printing plate 7' of the next print job in the ranges corresponding to the ink fountain keys 4-1 to 4-*n* are thus transmitted to the ink fountain key control devices 300-1 to 300-*n***.

[Confirmation of Completion of Setting of Opening Amounts of Ink Fountain Keys]

Figure 9M:
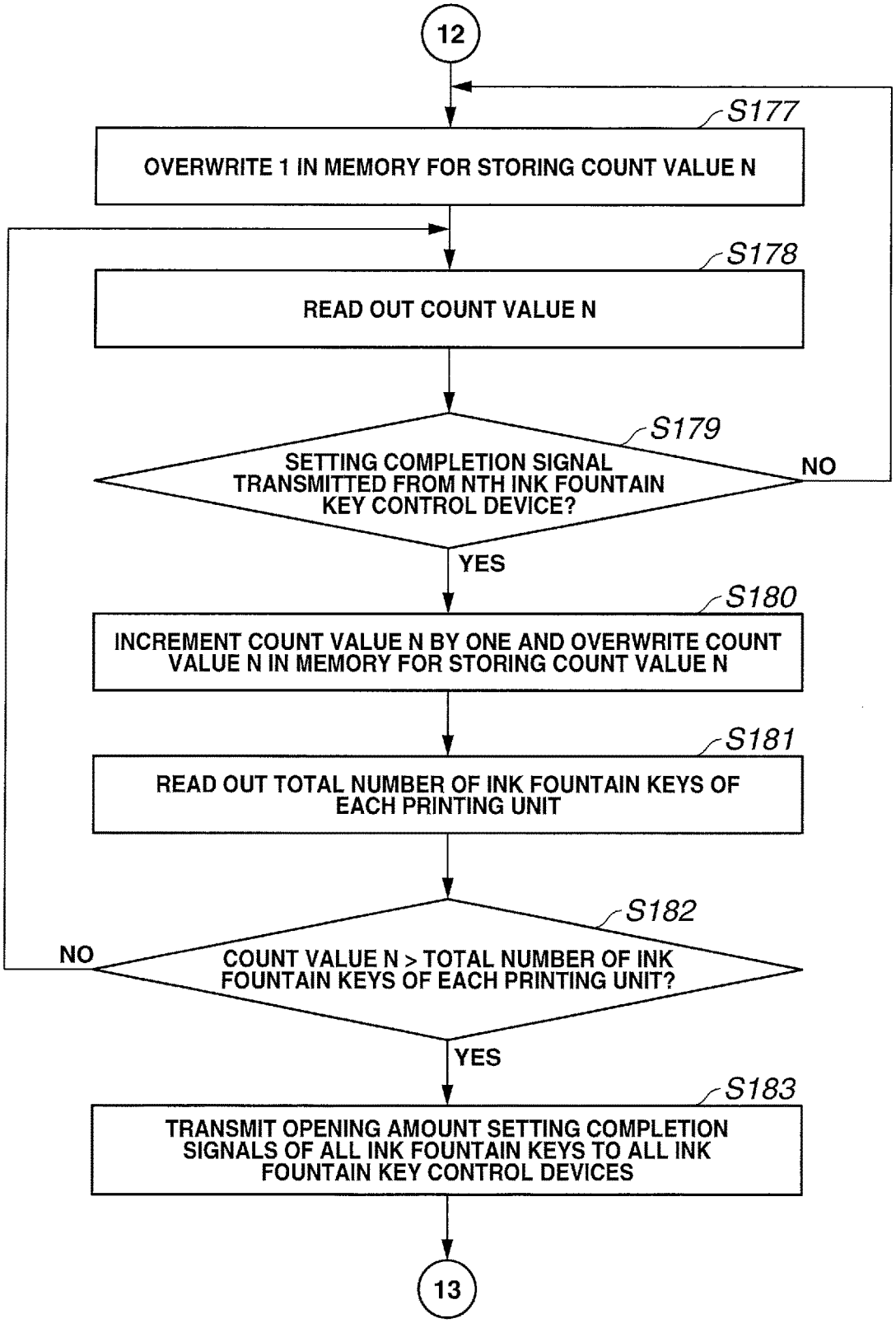

Next, the CPU 101 sets the count value N in the memory M2 to 1 (FIG. 9M: step S177), reads out the count value N from the memory M2 (step S178), and confirms the presence/absence of an ink fountain key opening amount setting completion signal from the Nth ink fountain key control device 300 (step S179).

If the ink fountain key opening amount setting completion signal is not transmitted from the Nth ink fountain key control device 300 (NO in step S179), the process returns to step S177 to set the count value N in the memory M2 to 1, and steps S178 and S179 are repeated.

If the ink fountain key opening amount setting completion signal is transmitted from the Nth ink fountain key control device 300 (YES in step S179), the CPU 101 increments the count value N in the memory M2 by one (step S180), reads out the total number n of ink fountain keys from the memory M4 (step S181), and compares the count value N with the total number n of ink fountain keys (step S182).

The CPU 101 repeats the processing operation in steps S178 to S182 until the count value N matches the total number n of ink fountain keys. If the count value N exceeds the total number n of ink fountain keys (YES in step S182), that is, upon confirming that the setting completion signals are transmitted from all the ink fountain key control devices 300, the CPU 101 determines that the setting of the opening amounts of the ink fountain keys is completed, and transmits the opening amount setting completion signals of all ink fountain keys to all the ink fountain key control devices 300 (300-1 to **300-*n*) (step S183**).

[Division of Ink Roller Group (Roller Group Redivision)]

Figure 3:
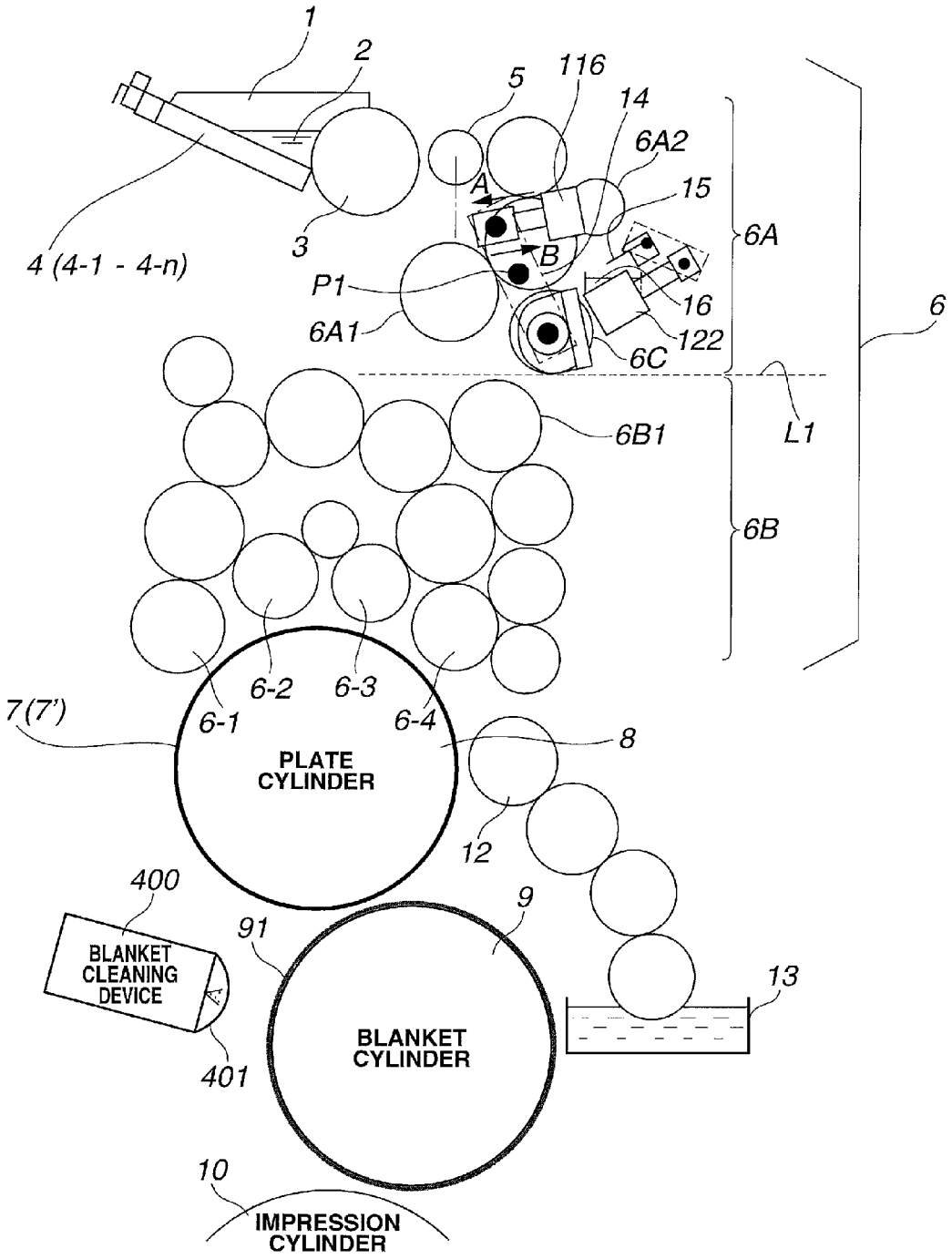
FIG. 3 is a view showing the main part of the ink supply device in the printing unit controlled by the print job switching control device (a state in which the ink roller group is divided)
Figure 9N:
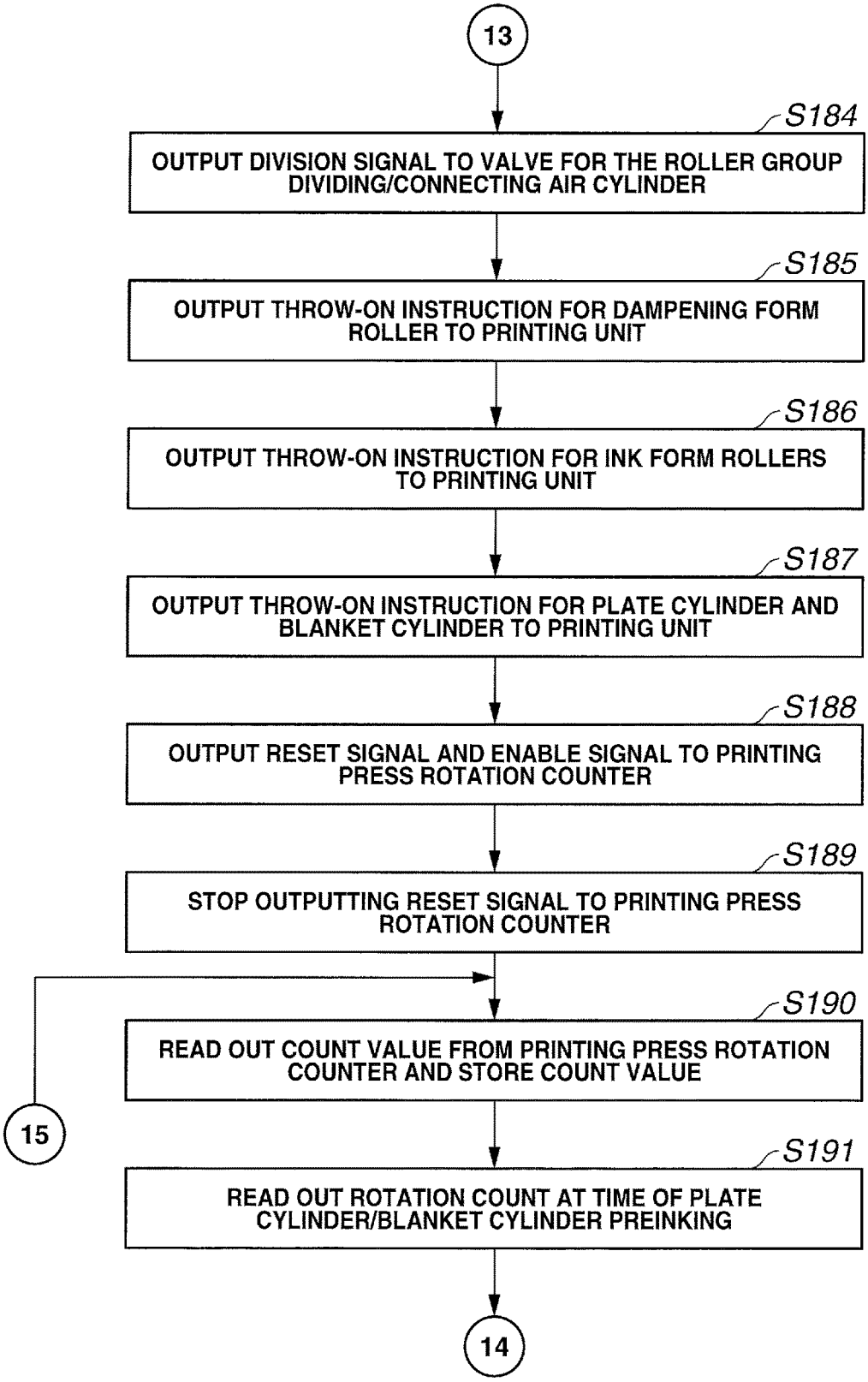

Then, the CPU 101 outputs a division signal to the valve 117 for roller group dividing/connecting air cylinder (FIG. 9N: step S184) to redivide the ink roller group 6 into the roller subgroup 6A on the upstream side and the roller subgroup 6B on the downstream side (see FIG. 3).

The ink film thickness distribution Md on the ink roller group 6 is thus divided into the ink film thickness distribution MdA on the roller subgroup 6A on the upstream side and the ink film thickness distribution MdB on the roller subgroup 6B on the downstream side, as indicated by step S7 in FIG. 6.

[Setting of Roller Subgroup on Downstream Side, Plate Cylinder, and Blanket Cylinder in Throw-On State]

Next, the CPU 101 outputs a throw-on instruction for the dampening form roller, a throw-on instruction for the ink form rollers, and a throw-on instruction for the plate cylinder and the blanket cylinder to the printing unit 125 (steps S185, S186, and S187). That is, the dampening form roller 12 is thrown on and brought into contact with the printing plate 7' based on the throw-on instruction for the dampening form roller. The ink form rollers 6-1 to 6-4 are thrown on and brought into contact with the printing plate 7' based on the throw-on instruction for the ink form rollers. Additionally, only the plate cylinder 8 and the blanket cylinder 9 are set in the throw-on state based on the throw-on instruction for the plate cylinder and the blanket cylinder. That is, the blanket cylinder 9 is thrown on to only the plate cylinder 8. The roller subgroup 6B on the downstream side, the plate cylinder 8, and the blanket cylinder 9 are thus set in the throw-on state (FIG. 6: step S8).

[Plate Cylinder/Blanket Cylinder Pre-Inking (Supply of Ink to Plate Cylinder/Blanket Cylinder)]

Figure 9O:
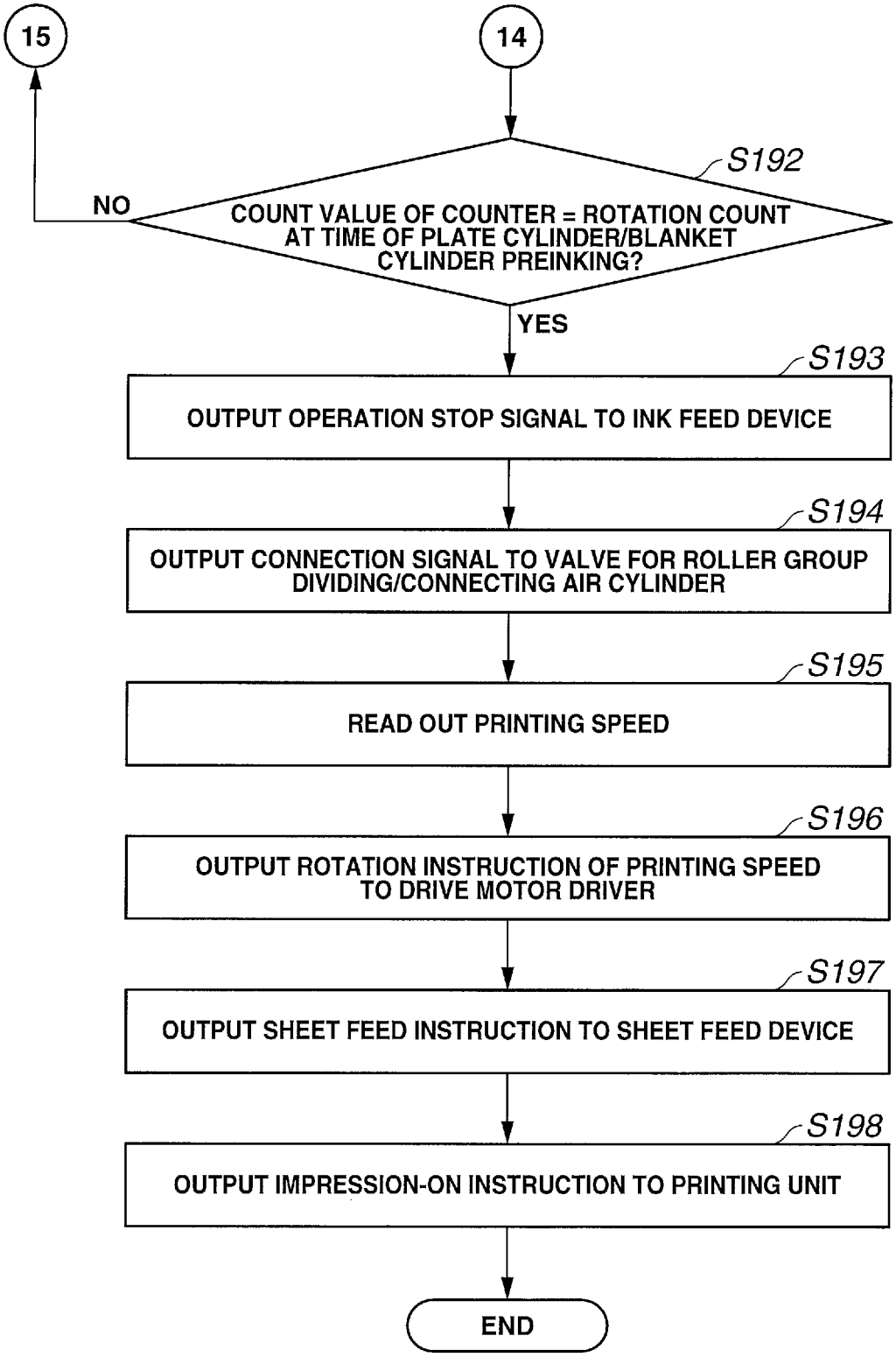

In this state, the CPU 101 rotates the printing press until the rotation count of the printing press reaches the rotation count N3 at the time of plate cylinder/blanket cylinder pre-inking in the memory M15 (steps S188 (FIG. 9N) to S192 (FIG. 9O)).

That is, the CPU 101 outputs a reset signal and an enable signal to the printing press rotation counter 114 (FIG. 9N: step S188), stops outputting the reset signal to the printing press rotation counter 114 (step S189), and causes the printing press rotation counter 114 to start the count operation from zero. The CPU 101 reads out the count value from the printing press rotation counter 114 and stores it in the memory M6 (step S190), reads out the rotation count N3 at the time of plate cylinder/blanket cylinder pre-inking in the memory M15 (step S191), and repeats the processing operation in steps S190 to S192 until the count value of the printing press rotation counter 114 reaches the rotation count N3 at the time of plate cylinder/blanket cylinder pre-inking (FIG. 9O: YES in step S192).

The ink in the roller subgroup 6B on the downstream side is thus supplied to the printing plate 7' mounded on the plate cylinder 8 and the blanket cylinder 9 (FIG. 6: step S9). In this case, only the ink of the relatively thin ink film thickness distribution MdB in the roller subgroup 6B on the downstream side is supplied to the printing plate 7' and the blanket cylinder 9. This prevents the ink film thickness distribution on the printing plate 7' and the blanket cylinder 9 from becoming too thick.

[Printing of Next Print Job (Printing Start)]

[Connection of Ink Roller Group]

When the count value of the printing press rotation counter 114 reaches the rotation count N3 at the time of plate cylinder/blanket cylinder pre-inking (YES in step S192), the CPU 101 outputs an operation signal to the ink feed device 115 (step S193) to start the feed operation of the ink ductor roller 5.

The CPU 101 outputs a connection signal to the valve 117 for roller group dividing/connecting air cylinder (step S194) to connect the roller subgroup 6A on the upstream side and the roller subgroup 6B on the downstream side (see FIG. 2) to restore the ink roller group 6 (FIG. 6: step S10).

[Sheet Feed & Impression-On]

Then, the CPU 101 reads out the printing speed Vp from the memory M16 (step S195), and outputs a rotation instruction of the printing speed Vp to the drive motor driver 110 via the D/A converter 112 (step S196) to set the speed of the printing press to the printing speed Vp. The CPU 101 outputs a sheet feed instruction to the sheet feed device 124 (step S197) to start sheet feed to the printing press. The CPU 101 outputs an impression-on instruction (a throw-on instruction for the impression cylinder and the blanket cylinder) to the printing unit 125 (step S198) to set the blanket cylinder 9 in a throw-on state with respect to the impression cylinder 10 as well. That is, an impression-on state in which the plate cylinder 8, the blanket cylinder 9, and the impression cylinder 10 are in contact is obtained (see FIG. 2). Printing of the next print job using the printing plate 7' is thus started.

In this case, the ink film thickness distribution (the ink film thickness distribution in final printing) at the time of printing of the next print job is created during printing. At this time, since the ink film thickness distribution MdB' in the roller subgroup 6B on the downstream side, the plate cylinder 8, and the blanket cylinder 9 is thin, the ink quickly flows from the upstream side to the downstream side, and the ink film thickness distribution Me during final printing is quickly formed on the ink roller group 6, the plate cylinder 8, and the blanket cylinder 9 (FIG. 6: step S11).

[Ink Fountain Roller Control Device]

Figure 10:
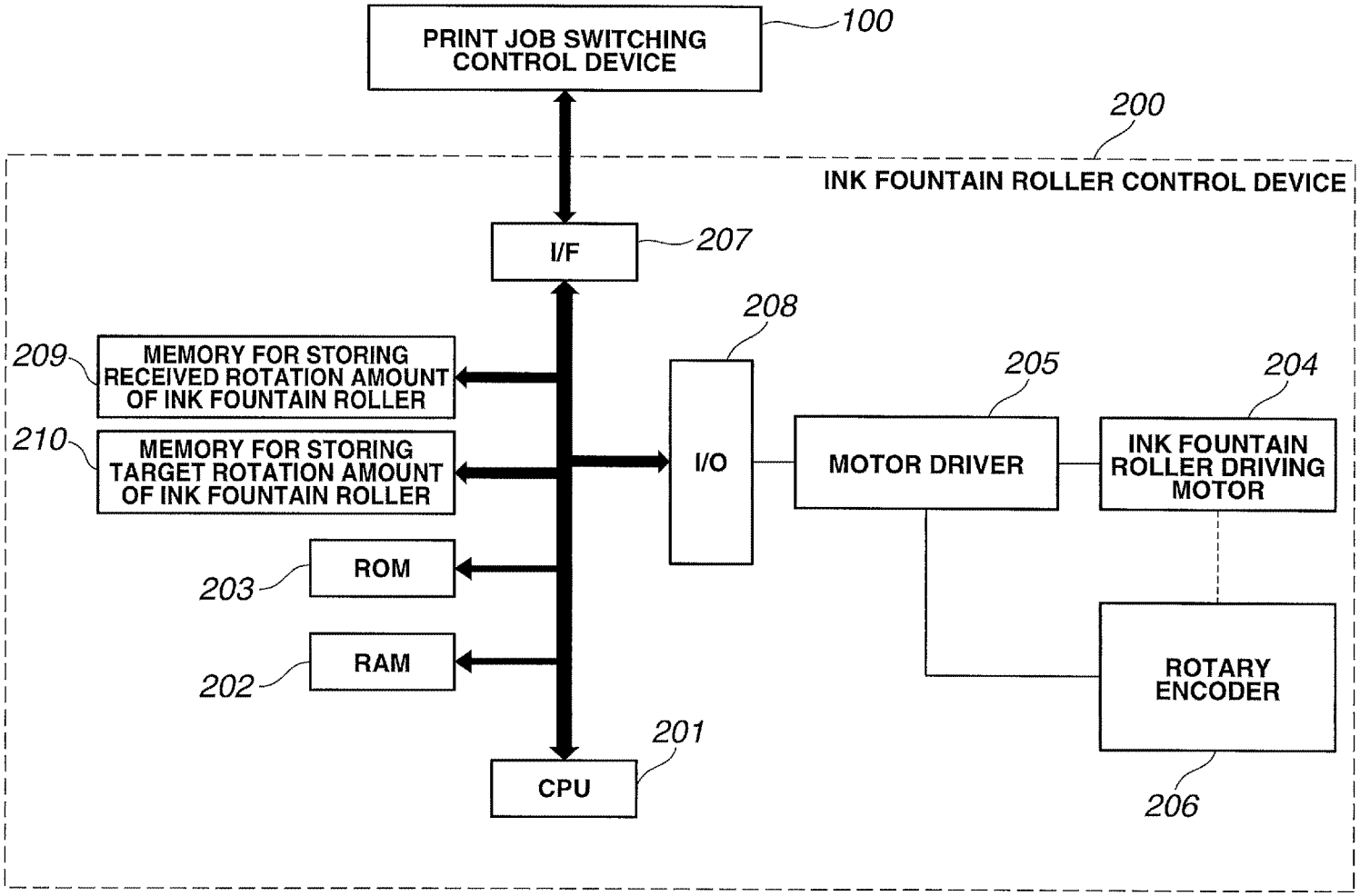
FIG. 10 is a block diagram showing the outline of the internal arrangement of an ink fountain roller control device.

FIG. 10 shows the outline of the internal arrangement of the ink fountain roller control device 200. The ink fountain roller control device 200 includes a CPU 201, a RAM 202, a ROM 203, an ink fountain roller driving motor 204, an ink fountain roller driving motor driver 205, a rotary encoder 206 for ink fountain roller driving motor, input/output interfaces (an I/O and an I/F) 207 and 208, and memories 209 and 210, and is connected to the print job switching control device 100 via the interface 207. The memory 209 stores a received rotation amount of the ink fountain roller. The memory 210 stores a target rotation amount of the ink fountain roller.

Figure 11:
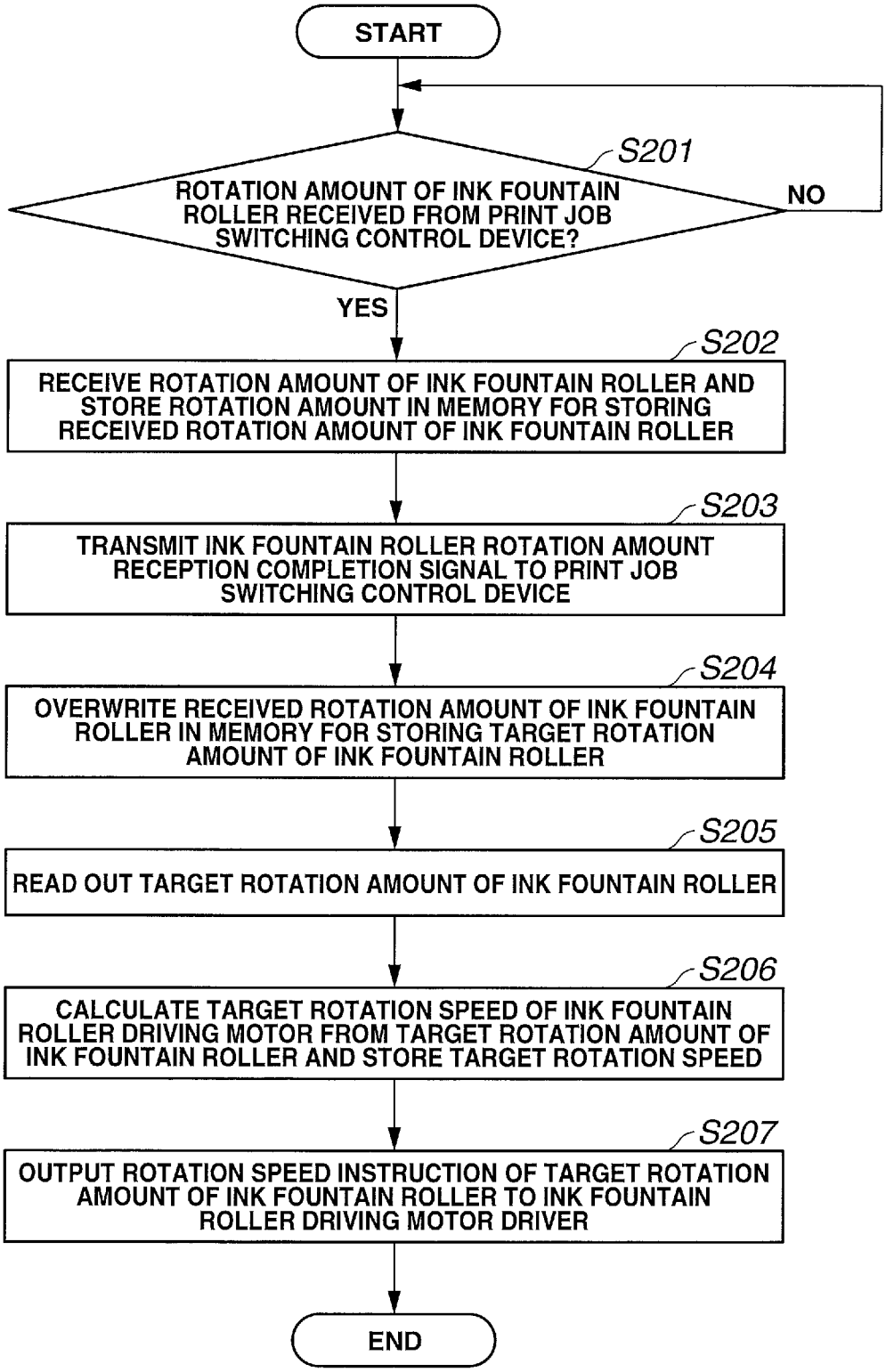
FIG. 11 is a flowchart showing the processing operation of the ink fountain roller control device.

When the rotation amount of the ink fountain roller is transmitted from the print job switching control device 100 (FIG. 11: YES in step S201), the CPU 201 stores the received rotation amount in the memory 209 (step S202). The CPU 201 also transmits an ink fountain roller rotation amount reception completion signal to the print job switching control device 100 (step S203). The CPU 201 stores the received rotation amount of the ink fountain roller in the memory 210 as the target rotation amount (target rotation amount) of the ink fountain roller (step S204). The CPU 201 reads out the target rotation amount from the memory 210 (step S205), calculates the target rotation speed of the ink fountain roller driving motor 204 from the target rotation amount (step S206), and sends the target rotation speed to the ink fountain roller driving motor driver 205 and adjusts the rotation amount of the ink fountain roller to the target rotation amount (step S207).

[Ink Fountain Key Control Device]

Figure 12:
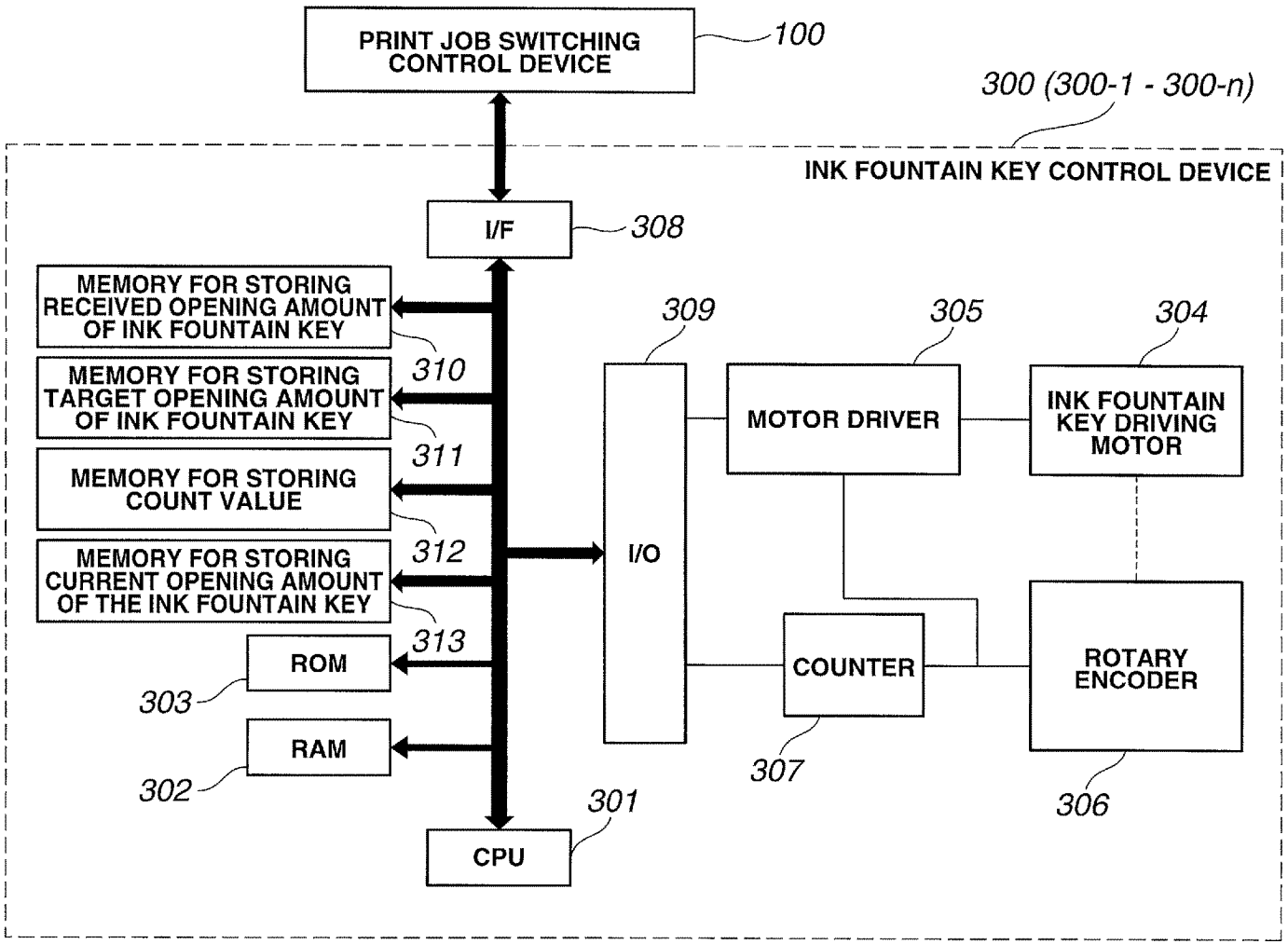
FIG. 12 is a block diagram showing the outline of the internal arrangement of an ink fountain key control device.

FIG. 12 shows the outline of the internal arrangement of the ink fountain key control device 300 (300-1 to **300-*n*). The ink fountain key control device 300 includes a CPU 301, a RAM 302, a ROM 303, an ink fountain key driving motor 304, an ink fountain key driving motor driver 305, a rotary encoder 306 for ink fountain key driving motor, a counter 307, input/output interfaces (an I/O and an I/F) 308 and 309, and memories 310 to 313, and is connected to the print job switching control device 100 via the interface 308. The memory 310 stores received opening amounts of ink fountain keys. The memory 311 stores target opening amounts of the ink fountain keys. The memory 312 stores the count value of the counter 307. The memory 313** stores the current opening amounts of the ink fountain keys.

Figure 13A:
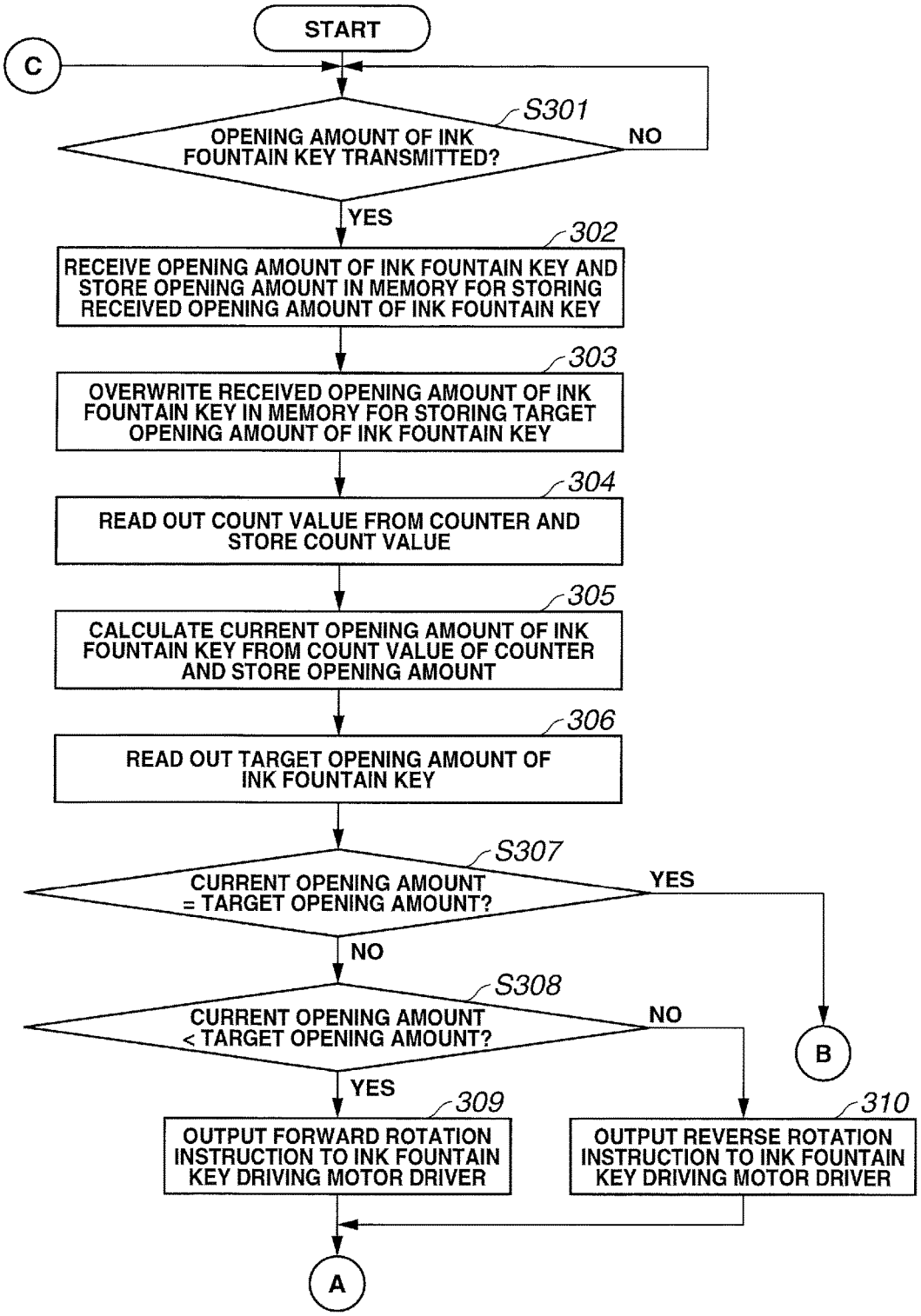
FIGS. 13A and 13B are flowcharts showing the processing operation of the ink fountain key control device.

When the opening amount of an ink fountain key is transmitted from the print job switching control device 100 (FIG. 13A: YES in step S301), the CPU 301 stores the received opening amount in the memory 310 (step S302), and stores the received opening amount of the ink fountain key in the memory 311 as the target opening amount (step S303).

Figure 13B:
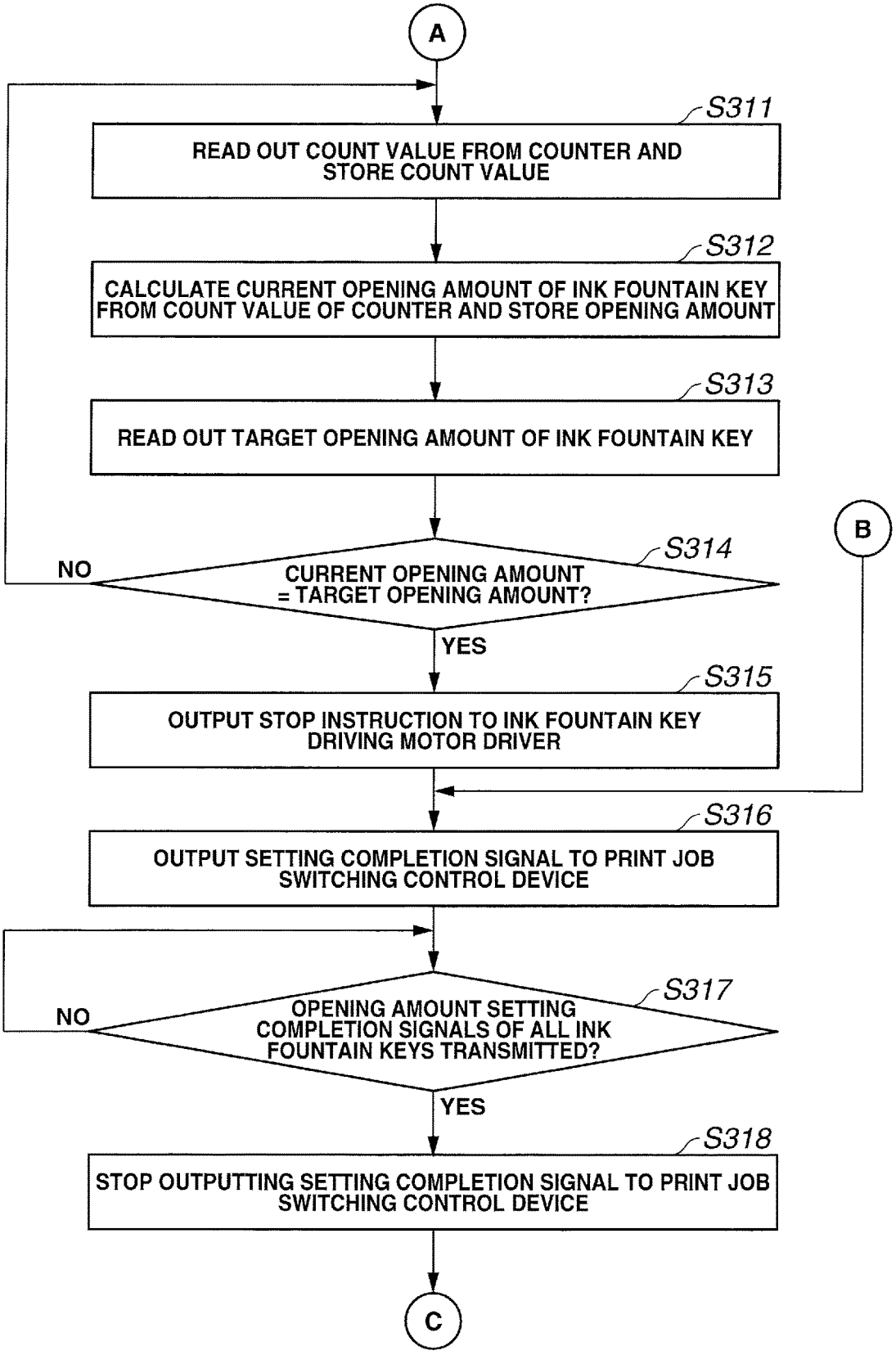

The CPU 301 reads out the count value from the counter 307 and stores it in the memory 312 (step S304), obtains the current opening amount of the ink fountain key from the read count value of the counter 307 and stores it in the memory 313 (step S305), and reads out the target opening amount of the ink fountain key from the memory 311 (step S306). If the current opening amount of the ink fountain key equals the target opening amount (YES in step S307), the process directly advances to step S316 (FIG. 13B) to output an ink fountain key opening amount setting completion signal to the print job switching control device 100.

If the current opening amount of the ink fountain key does not equal the target opening amount (NO in step S307), the ink fountain key driving motor 304 is driven until the current opening amount of the ink fountain key equals the target opening amount (steps S308 to S315 (FIG. 13B)). After that, an ink fountain key opening amount setting completion signal is output to the print job switching control device 100 (step S316).

That is, if the current opening amount of the ink fountain key is smaller than the target opening amount (YES in step S308), the CPU 301 sends a forward rotation instruction to the ink fountain key driving motor driver 305 (step S309), reads out the count value from the counter 307 (step S311), calculates the current opening amount of the ink fountain key from the read count value (step S312), and reads out the target opening amount of the ink fountain key from the memory 311 (step S313). The processing operation in steps S311 to S314 is repeated until the current opening amount of the ink fountain key matches the target opening amount of the ink fountain key (YES in step S314).

If the current opening amount of the ink fountain key is larger than the target opening amount (NO in step S308), the CPU 301 sends a reverse rotation instruction to the ink fountain key driving motor driver 305 (step S310), reads out the count value from the counter 307 (step S311), calculates the current opening amount of the ink fountain key from the read count value (step S312), and reads out the target opening amount of the ink fountain key from the memory 311 (step S313). The processing operation in steps S311 to S314 is repeated until the current opening amount of the ink fountain key matches the target opening amount of the ink fountain key (YES in step S314).

If the current opening amount of the ink fountain key matches the target opening amount of the ink fountain key (YES in step S314), the CPU 301 outputs a stop instruction to the ink fountain key driving motor driver 305 (step S315), and outputs an ink fountain key opening amount setting completion signal to the print job switching control device 100 (step S316).

After the ink fountain key opening amount setting completion signal is output to the print job switching control device 100 (step S316), upon receiving the opening amount setting completion signals of all ink fountain keys from the print job switching control device 100 (YES in step S317), the CPU 301 stops outputting the ink fountain key opening amount setting completion signal to the print job switching control device 100 (step S318).

Figure 14:
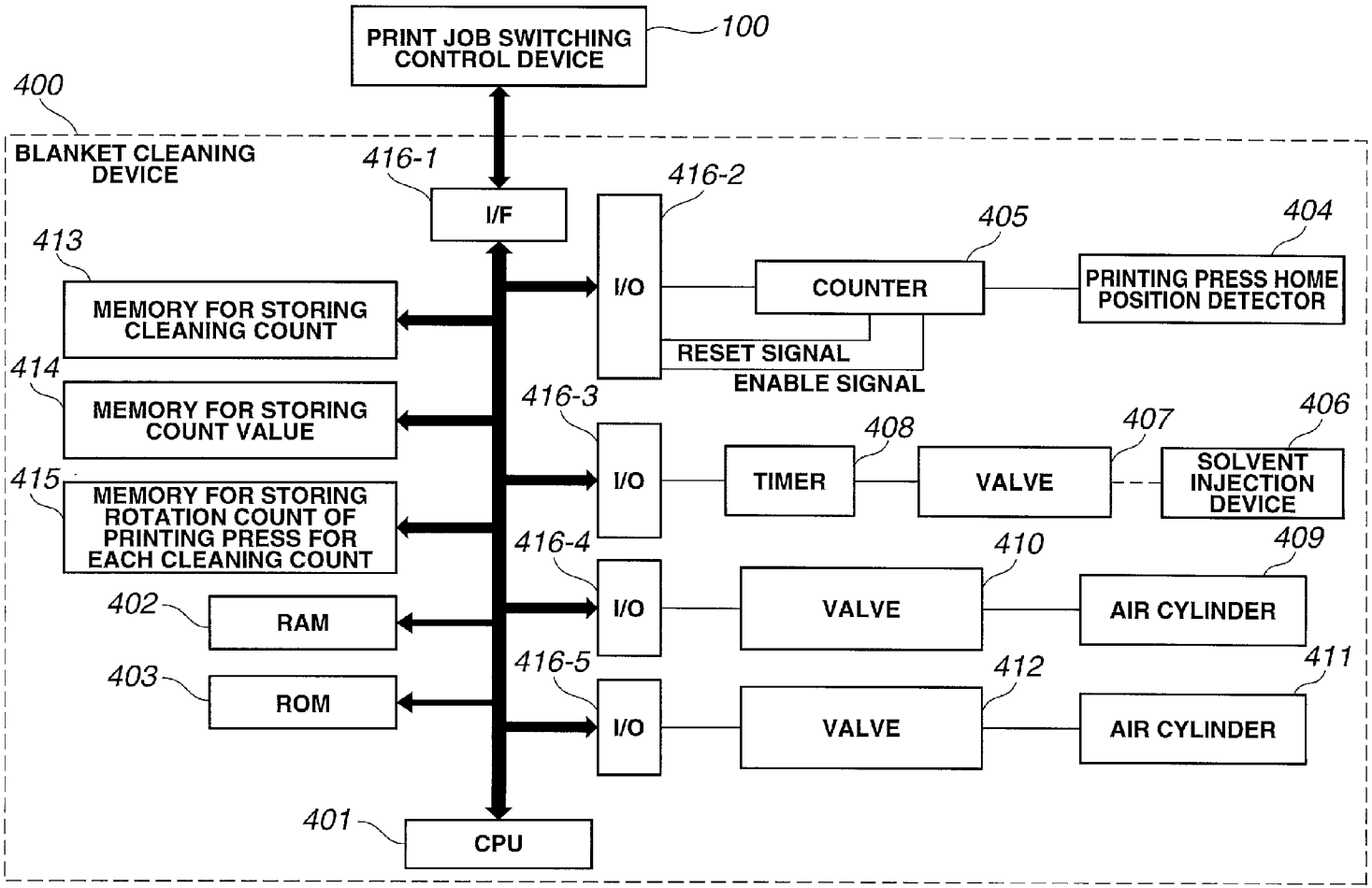
FIG. 14 is a block diagram showing the outline of the internal arrangement of a blanket cleaning device.

FIG. 14 shows the outline of the internal arrangement of the blanket cleaning device 400. The blanket cleaning device 400 includes a CPU 401, a RAM 402, a ROM 403, a printing press home position detector 404, a printing press rotation counter 405, a solvent injection device 406, a valve 407 for solvent injection nozzle, a timer 408, a cleaning cloth feeding air cylinder 409, a valve 410 for cleaning cloth feeding air cylinder, a blade on/off air cylinder 411, a valve 412 for blade on/off air cylinder, memories 413 to 415, and input/output interfaces (I/Os and an I/F) 416-1 to 416-5, and is connected to the print job switching control device 100 via the interface 416-1. The memory 413 stores the cleaning count of the blanket cleaning device. The memory 414 stores the count value of the printing press rotation counter 405. The memory 415 stores the rotation count of the printing press for each cleaning count.

Figure 15A:
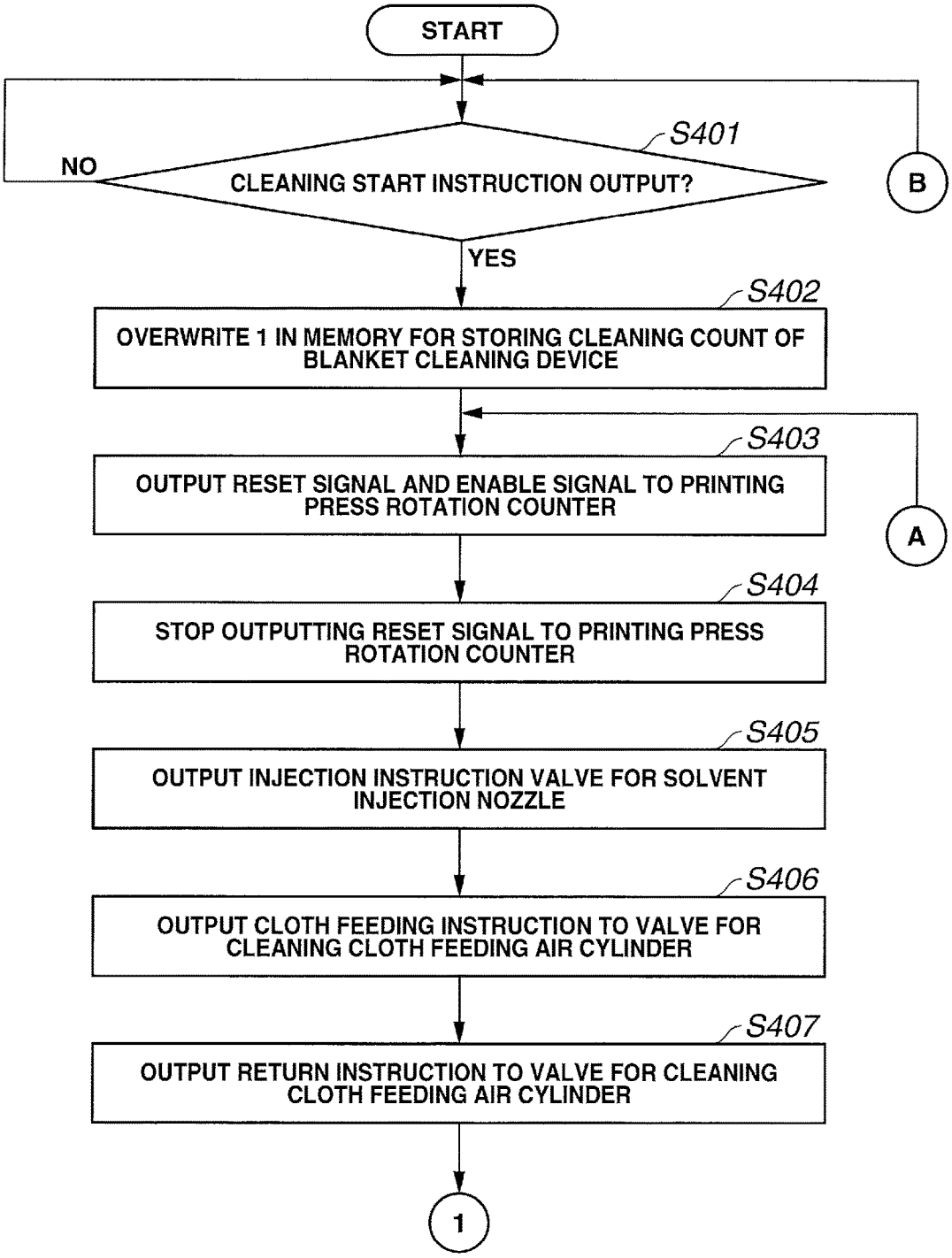
FIGS. 15A to 15C are flowcharts showing the processing operation of the blanket cleaning device.

When a cleaning start instruction is transmitted from the print job switching control device 100 (FIG. 15A: YES in step S401), the CPU 401 sets the cleaning count in the memory 413 to 1 (step S402), outputs a reset signal and an enable signal to the printing press rotation counter 405 (step S403), stops outputting the reset signal to the printing press rotation counter 405 (step S404), and causes the printing press rotation counter 405 to start the count operation from zero.

Figure 15B:
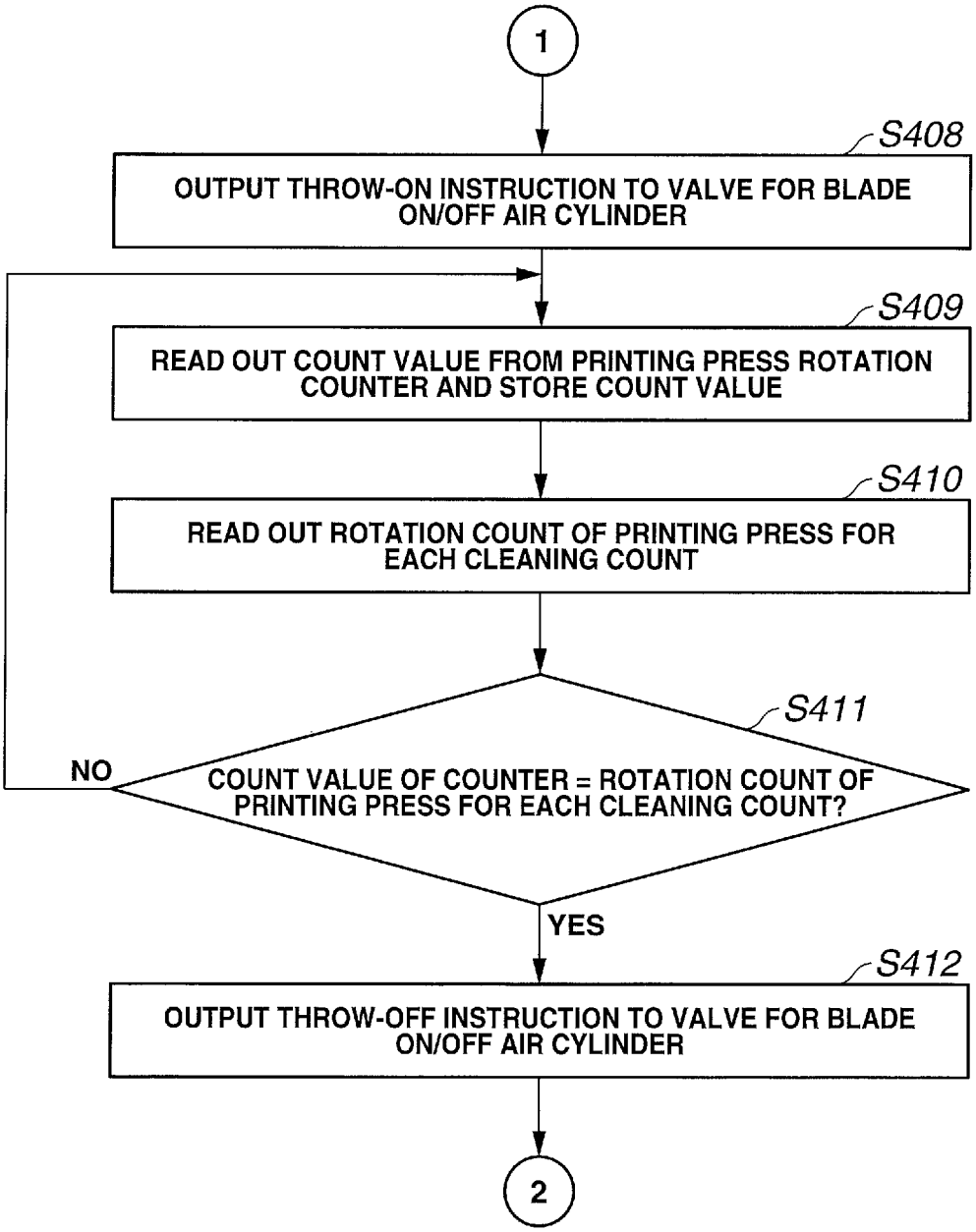

The CPU 401 outputs an injection instruction to the valve 407 for solvent injection nozzle (step S405), outputs a cloth feeding instruction to the valve 410 for cleaning cloth feeding air cylinder (step S406), outputs a return instruction to the valve 410 for cleaning cloth feeding air cylinder (step S407), outputs a throw-on instruction to the valve 412 for blade on/off air cylinder (FIG. 15B: step S408), and presses the cleaning cloth 401 with the injected solvent against the blanket 91 on the blanket cylinder 9 while feeding the cleaning cloth 401.

Figure 15C:
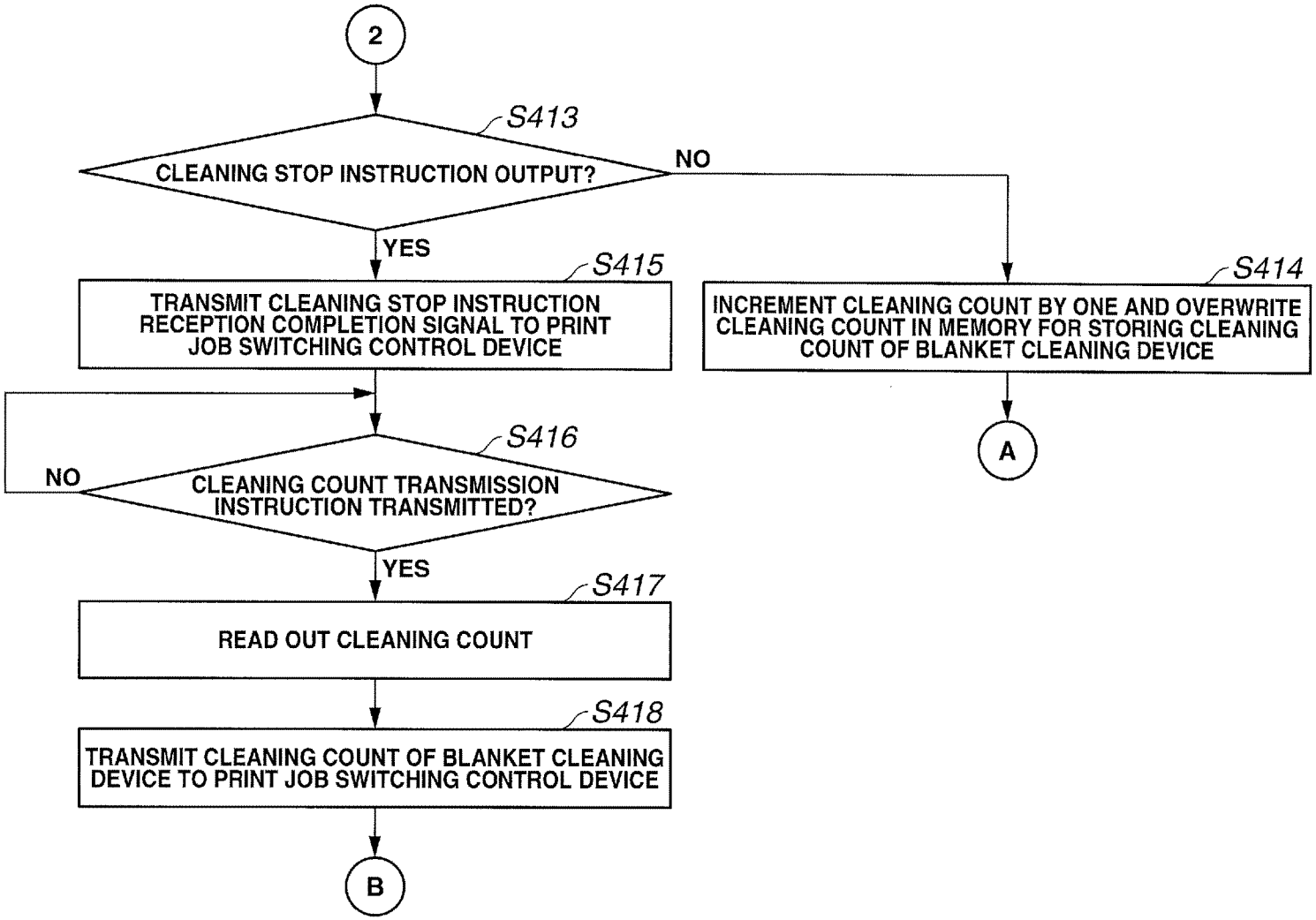

The CPU 401 reads out the count value from the printing press rotation counter 405 and stores it in the memory 414 (step S409), and reads out the rotation count of the printing press for each cleaning count in the memory 415 (step S410). If the count value of the printing press rotation counter 405 equals the rotation count of the printing press for each cleaning count (YES in step S411), the CPU 401 outputs a throw-off instruction to the valve 412 for blade on/off air cylinder (step S412). The CPU 401 repeats the processing operation in steps S403 to S413 while confirming the presence/absence of a cleaning stop instruction from the print job switching control device 100 (FIG. 15C: step S413). During the repeat of the processing operation in steps S403 to S413, the CPU 401 increments the cleaning count of the blanket cleaning device in the memory 413 by one every time the processing operation is repeated once (step S414).

If a cleaning stop instruction is transmitted from the print job switching control device 100 during the repeat of the processing operation in steps S403 to S413 (YES in step S413), the CPU 401 transmits a cleaning stop instruction reception completion signal to the print job switching control device 100 (step S415), receives a cleaning count transmission instruction sent from the print job switching control device 100 that has received the cleaning stop instruction reception completion signal (YES in step S416), reads out the cleaning count of the blanket cleaning device in the memory 413 (step S417), and transmits the readout cleaning count of the blanket cleaning device to the print job switching control device 100 (step S418).

As described above, in this embodiment, as the processing operation of the CPU 101, the step of cleaning the blanket 91 mounted on the blanket cylinder 9 after the end of a print job (steps S108 to S113), the step of calculating the opening amounts of the ink fountain keys 4-1 to **4-*n* corresponding to the image of the printing plate 7' of the next print job (steps S139 to S141), the step of correcting the calculated opening amounts of the ink fountain keys 4-1 to 4-*n* with correction values in consideration of the influence of cleaning of the blanket 91 (steps S142 to S147), and the step of performing the feed operation of the ink ductor roller 5 a predetermined number of times in a state in which the opening amounts of the ink fountain keys 4-1 to 4-*n* have been set to the corrected opening amounts, thereby forming a corrected ink film thickness distribution corresponding to the image of the printing plate 7' of the next print job on the ink roller group 6 (steps S160 to S169) are executed (see steps S2 to S6 shown in FIG. 6). The opening amounts of the ink fountain keys 4-1 to 4-*n* have thus been set to the corrected opening amounts obtained by correcting the opening amounts with the correction values in consideration of the influence of cleaning of the blanket 91, and the corrected ink film thickness distribution corresponding to the image of the printing plate 7' of the next print job is formed on the ink roller group 6. By the corrected ink film thickness distribution, a little large amount of ink is supplied, and a lightly printed product is prevented from being produced due to the influence of the solvent remaining on the blanket 91**.

In this embodiment, the correction values of the opening amounts of the ink fountain keys 4-1 to **4-*n* considering the influence of cleaning of the blanket 91 are values corresponding to the image of the printing plate 7' of the next print job and values corresponding to the operation count of the blanket cleaning device 400 (steps S142 to S145). The opening amounts of the ink fountain keys 4-1 to 4-*n* are set to the opening amounts corrected by the correction values of the opening amounts of the ink fountain keys 4-1 to 4-*n* considering the influence of cleaning of the blanket 91, and the corrected ink film thickness distribution corresponding to the image of the printing plate 7' of the next print job is formed on the ink roller group 6 (steps S160 to S169). After that, the opening amounts of the ink fountain keys 4-1 to 4-*n* are set to the opening amounts corresponding to the image of the printing plate of the next print job (steps S170 to S176). Note that the correction values of the opening amounts of the ink fountain keys 4-1 to 4-*n* considering the influence of cleaning of the blanket 91 may be only values corresponding to the image of the printing plate 7' of the next print job or only values corresponding to the operation count of the blanket cleaning device 400**.

In this embodiment, the ink roller group 6 is divided into the roller subgroup 6A on the upstream side and the roller subgroup 6B on the downstream side, and the ink in the roller subgroup 6A on the upstream side out of the separated roller subgroups 6A and 6B is scraped by the ink scraper blade 15 and removed (removing, steps S130 to S136). In this case, the ink in the roller subgroup 6A on the upstream side cannot be returned to the fountain because the feed operation of the ink ductor roller 5 is stopped. In addition, since the roller subgroup 6A on the upstream side is disconnected from the roller subgroup 6B on the downstream side, the ink cannot be removed by blank sheet printing. In this embodiment, the ink in the roller subgroup 6A on the upstream side is removed not by "ink return to fountain" or blank sheet printing but by scraping the ink by the ink scraper blade 15.

Note that the ink film thickness control method described in patent literature 1 (ink decrease+pre-inking 2), since blank sheet printing is performed when leaving the ink film thickness distribution Ma on the ink roller group 6, paper is wasted. In the ink film thickness control method described in patent literature 2 (ink return to fountain+pre-inking 1), since the ink on the ink roller group 6 is wholly returned to the ink fountain 1, and the corrected ink film thickness distribution (Ma+Mb) is formed from zero, a long time is needed. Additionally, in this method, since emulsified ink (ink blended with dampening water) is returned to the ink fountain 1, a printing failure occurs, and printing materials are wasted.

In this embodiment, after the end of a print job, the ink roller group 6 is divided into the roller subgroup 6A on the upstream side and the roller subgroup 6B on the downstream side, and the ink in the roller subgroup 6A out of the separated roller subgroups 6A and 6B is scraped by the ink scraper blade 15 and removed. Hence, when switching a print job, the ink film thickness distribution formed on the ink roller group 6 can be corrected in a short time without blank sheet printing or ink return to fountain.

Note that in this embodiment, the ink roller group 6 is divided into two subgroups, that is, the roller subgroup 6A on the upstream side and the roller subgroup 6B on the downstream side. However, the number of subgroups is not limited to two, and may be any number of two or more. That is, in the above-described embodiment, the ink roller group 6 is divided into two subgroups, that is, the roller subgroup 6A on the upstream side and the roller subgroup 6B on the downstream side (strictly speaking, three subgroups including the roller 6C). However, the ink roller group 6 may be divided into more subgroups, for example, three subgroups or four subgroups.

When the ink roller group 6 is divided into two or more roller subgroups, at least the roller subgroup on the most downstream side out of the separated roller subgroups, the plate cylinder 8 on which the printing plate 7' to be used to print the next print job is mounted, and the blanket cylinder 9 are set in the throw-on state. When the ink roller group 6 is divided into two or more roller subgroups, ink in one or some roller subgroups out of the plurality of separated roller subgroups is removed. The one or some roller subgroups may include a plurality of roller subgroups. In addition, the member (ink scraping member) used to scrape the ink is not limited to a blade. The ink in one or some roller subgroups out of the plurality of separated roller subgroups is removed. The ink in one or some roller subgroups out of the plurality of separated roller subgroups may be removed using a scraper or the like as the ink scraping member.

In this embodiment, after the ink in the roller subgroup 6A is removed, in a state in which the separated roller subgroups 6A and 6B have been connected to restore the ink roller group 6 (step S159) and in a state in which the opening amounts of the ink fountain keys 4-1 to **4-*n* have been set to the corrected opening amounts (steps S142 to S147), the feed operation of the ink ductor roller 5 is performed a predetermined number of times, thereby forming the corrected ink film thickness distribution corresponding to the image of the printing plate 7' of the next print job on the restored ink roller group 6 (steps S160 to S169**).

The ink roller group 6 on which the corrected ink film thickness distribution corresponding to the image of the printing plate 7' of the next print job is formed is divided into the roller subgroup 6A on the upstream side and the roller subgroup 6B on the downstream side (step S184). The roller subgroup 6B on the most downstream side out of the roller subgroups 6A and 6B and the plate cylinder 8 on which the printing plate 7' to be used in the next print job is mounted are set in the throw-on state, and the plate cylinder 8 and the blanket cylinder 9 are set in the throw-on state (steps S185 to S187). The plate cylinder 8, the roller subgroup 6B, and the blanket cylinder 9, which are in the throw-on state, are rotated predetermined number of times, thereby supplying the ink in the roller subgroup 6B to the blanket cylinder 9 and the printing plate 7' mounted on the plate cylinder 8 (steps S188 to S192). In this case, only the ink of the relatively thin ink film thickness distribution in the roller subgroup 6B on the downstream side is supplied to the printing plate 7' and the blanket cylinder 9. This prevents the ink film thickness distribution on the plate cylinder 8 and the blanket cylinder 9 from becoming too thick.

Note that in the ink film thickness control method described in patent literature 1 (ink decrease+pre-inking 2) or the ink film thickness control method described in patent literature 2 (ink return to fountain+pre-inking 1), after the ink film thickness distribution corresponding to the image of the printing plate of the next print job is superimposed on the minimum ink film thickness distribution formed on the ink roller group and needed during printing, the ink form rollers are thrown on, and the ink in the ink roller group is supplied to the exchanged printing plate of the next print job and the cleaned blanket cylinder to start printing. For this reason, printing of the next print job starts from a state in which no ink exists on the plate cylinder and the blanket cylinder at all. It is impossible to obtain a normal printed product until an ink film thickness distribution for final printing is formed on the plate cylinder, the blanket cylinder, and the ink roller group during printing. Hence, much waste paper is generated, and printing materials are wasted.

In addition, after the ink film thickness distribution corresponding to the image of the printing plate of the next print job is superimposed on the minimum ink film thickness distribution formed on the ink roller group and needed during printing, before the start of printing of the next print job, the ink form rollers, the dampening form roller, the plate cylinder, and the blanket cylinder may be brought into contact, and the printing press may be rotated a predetermined number of times to supply the ink to the plate cylinder and the blanket cylinder as well (see, for example, patent literature 4). In this case, however, since all ink in the ink supply device is evened in the ink roller group, the plate cylinder, and the blanket cylinder, an excessive amount of ink is supplied to the plate cylinder and the blanket cylinder, and the ink film thickness distribution on the plate cylinder and the blanket cylinder becomes too thick. Hence, much waste paper is generated until the excessively supplied ink is consumed. On the other hand, in this embodiment, since only the ink of the relatively thin ink film thickness distribution in the roller subgroup 6B on the downstream side is supplied to the printing plate 7' and the blanket cylinder 9, the above-described problem does to arise.

In this embodiment, after the ink in the roller subgroup 6B is supplied to the blanket cylinder 9 and the printing plate 7' mounted on the plate cylinder 8, the separated roller subgroups 6A and 6B are connected to restore the ink roller group 6 (step S194). Then, printing of the next print job is started using the printing plate 7' mounted on the plate cylinder 8 (steps S195 to S198). Accordingly, after the ink in the roller subgroup 6B on the downstream side is supplied to form an ink film thickness distribution on the plate cylinder 8 and the blanket cylinder 9, printing of the next print job is started in a state in which the roller subgroup 6A on the upstream side and the roller subgroup 6B on the downstream side have been connected to restore the ink roller group 6. In this case, the ink film thickness distribution (the ink film thickness distribution in final printing) at the time of printing of the next print job is created during printing. At this time, since the ink film thickness distribution MdB' in the roller subgroup 6B on the downstream side, the plate cylinder 8, and the blanket cylinder 9 is thin, the ink quickly flows from the upstream side to the downstream side, and the ink film thickness distribution during final printing is quickly formed on the ink roller group 6, the plate cylinder 8, and the blanket cylinder 9.

Figure 16:
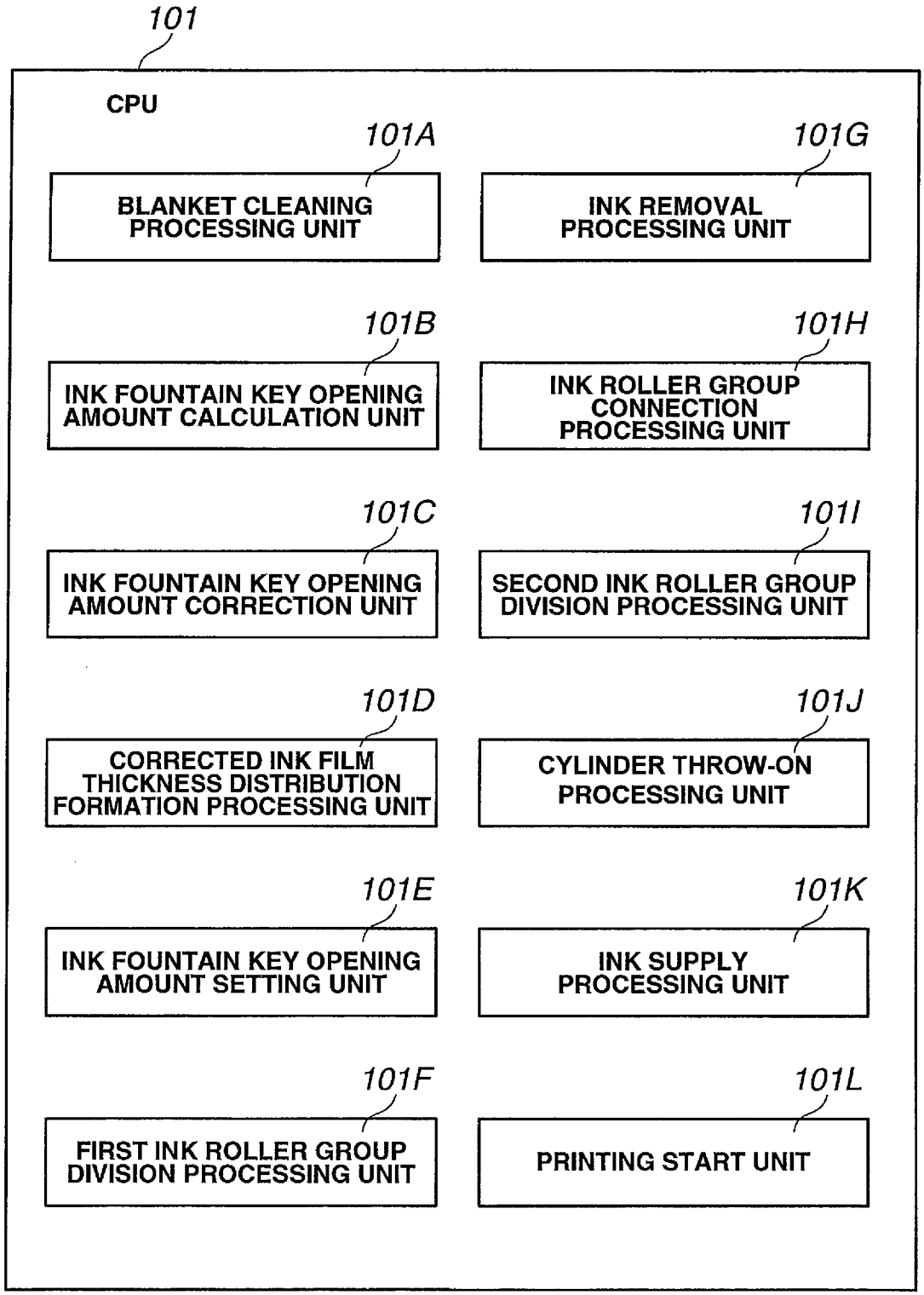
FIG. 16 is a block diagram showing the function of a main part implemented as the processing operation of a CPU in the print job switching control device.

FIG. 16 is a functional block diagram of a main part implemented as the processing operation of the CPU 101 in the print job switching control device 100 shown in FIG. 1. The CPU 101 implements the function of each unit shown in FIG. 16 as a processing operation in accordance with a program stored in the ROM 103 while accessing the RAM 102 or the memory 126.

The CPU 101 includes a blanket cleaning processing unit 101A, an ink fountain key opening amount calculation unit 101B, an ink fountain key opening amount correction unit 101C, a corrected ink film thickness distribution formation processing unit 101D, an ink fountain key opening amount setting unit 101E, a first ink roller group division processing unit 101F, an ink removal processing unit 101G, an ink roller group connection processing unit 101H, a second ink roller group division processing unit 101I, a cylinder throw-on processing unit 101J, an ink supply processing unit 101K, and a printing start unit 101L.

After the end of a print job, the blanket cleaning processing unit 101A causes the blanket cleaning device 400 to operate and clean the blanket 91 mounted on the blanket cylinder 9 (step S2 shown in FIG. 6, steps S108 to S113).

The ink fountain key opening amount calculation unit 101B calculates the opening amounts of the ink fountain keys 4-1 to **4-*n* corresponding to the image of the printing plate 7' of the next print job (steps S139 to S141**).

The ink fountain key opening amount correction unit 101C corrects the calculated opening amounts of the ink fountain keys 4-1 to **4-*n* with correction values in consideration of the influence of cleaning of the blanket (steps S142 to S147**).

In a state in which the opening amounts of the ink fountain keys 4-1 to **4-*n* have been set to the corrected opening amounts, the corrected ink film thickness distribution formation processing unit 101D causes the ink ductor roller 5 to perform the feed operation a predetermined number of times to form a corrected ink film thickness distribution corresponding to the image of the printing plate 7' of the next print job on the ink roller group 6 (step S6 shown in FIG. 6, steps S160 to S169**).

After the corrected ink film thickness distribution is formed, the ink fountain key opening amount setting unit 101E sets the opening amounts of the ink fountain keys 4-1 to **4-*n* to opening amounts corresponding to the image of the printing plate 7' of the next print job (steps S170 to S176**).

The first ink roller group division processing unit 101F divides the ink roller group 6 into the roller subgroups 6A and 6B (step S3 shown in FIG. 6, step S127).

The ink removal processing unit 101G removes the ink in the roller subgroup 6A out of the separated roller subgroups 6A and 6B by scraping it by the ink scraper blade 15 (step S4 shown in FIG. 6, steps S130 to S136).

After the ink in the roller subgroup 6A is removed, the ink roller group connection processing unit 101H connects the separated roller subgroups 6A and 6B to restore the ink roller group 6 (step S5 shown in FIG. 6, step S159).

The second ink roller group division processing unit 101I divides the ink roller group 6 on which the corrected ink film thickness distribution is formed into the roller subgroups 6A and 6B (step S7 shown in FIG. 6, step S184).

After the ink roller group 6 is divided, the cylinder throw-on processing unit 101J sets the roller subgroup 6B on the downstream side out of the roller subgroups 6A and 6B and the plate cylinder 8 on which the printing plate 7' to be used in the next print job is mounted in a throw-on state, and also sets the plate cylinder 8 and the blanket cylinder 9 used to transfer the ink supplied to the printing plate 7' mounted on the plate cylinder 8 to a target printing material in a throw-on state (step S8 shown in FIG. 6, steps S185 to S187).

Note that in the ink film thickness distribution formation process shown in FIG. 8, the cylinder throw-on processing unit 101J sets the roller subgroup 6B and the plate cylinder 8 on which the printing plate 7' to be used in the next print job is mounted in the throw-on state, and also sets the plate cylinder 8 and the blanket cylinder 9 used to transfer the ink supplied to the printing plate 7' mounted on the plate cylinder 8 to a target printing material in the throw-on state before the ink roller group 6 is divided (step S7 shown in FIG. 8).

In a state in which the ink roller group 6 has been divided and in a state in which the roller subgroup 6B and the plate cylinder 8 are in the throw-on state, and the plate cylinder 8 and the blanket cylinder 9 are in the throw-on state, the ink supply processing unit 101K rotates the plate cylinder 8, the roller subgroup 6B, and the blanket cylinder 9 a predetermined number of times to supply the ink in the roller subgroup 6B to the blanket cylinder 9 and the printing plate 7' mounted on the plate cylinder 8 (step S9 shown in FIG. 6, steps S188 to S192).

After the ink is supplied to the blanket cylinder 9 and the printing plate 7' mounted on the plate cylinder 8, the printing start unit 101L connects the separated roller subgroups 6A and 6B to restore the ink roller group 6 (step S10 shown in FIG. 6, step S194), and starts printing of the next print job using the printing plate 7' mounted on the plate cylinder 8 (step S11 shown in FIG. 6, steps S194 to S198).

Note that in the above-described embodiment, the ink roller group 6 is divided/connected using the swing arm 14. However, the mechanism used to divide/connect the ink roller group 6 is not limited to the mechanism using the swing arm.

In the above-described embodiment, when forming the ink film thickness distribution corresponding to the image of the printing plate of the next print job on the ink roller group 6, the ink roller group 6 is divided into the roller subgroup 6A on the upstream side and the roller subgroup 6B on the downstream side. However, the ink roller group 6 need not always be divided. That is, the present invention may be applied to an ink supply device without a mechanism to do division/connection.

Extension of Embodiment

The present invention has been described above with reference to the embodiments. However, the present invention is not limited to the above embodiments. Various changes and modifications understandable by those who are skilled in the art can be done for the arrangements and details of the present invention without departing the scope of the present invention.

INDUSTRIAL APPLICABILITY

The present invention can be used for various kinds of printing presses such as a web offset printing press as an ink supply method and an ink supply device for supplying, via an ink roller group, ink supplied to an ink fountain roller to a printing plate mounted on a plate cylinder by the feed operation of an ink ductor roller.

EXPLANATION OF THE REFERENCE NUMERALS AND SIGNS

1 . . . ink fountain, 2 . . . ink, 3 . . . ink fountain roller, 4 (4-1 to **4-*n*) . . . ink fountain key, 5 . . . ink ductor roller, 6 . . . ink roller group, 7, 7' . . . printing plate, 8 . . . plate cylinder, 9 . . . blanket cylinder, 10 . . . impression cylinder, 11 . . . printing paper (target printing material), 101 . . . CPU, 102 . . . RAM, 103 . . . ROM, 100 . . . print job switching control device, 200 . . . ink fountain roller control device, 300 (300-1 to 300-*n*) . . . ink fountain key control device, 400** . . . blanket cleaning device

The invention claimed is:

1. An ink supply method comprising the steps of:

cleaning the blanket mounded on the blanket cylinder after an end of a print job including adjusting an amount of ink supplied from an ink fountain to an ink fountain roller by adjusting an opening amount of an ink fountain key, supplying the ink supplied to the ink fountain roller to a printing plate via an ink roller group by a feed operation of an ink ductor roller, and supplying the ink to a blanket which is mounted on a blanket cylinder and used to transfer the ink supplied to the printing plate to a target printing material;

calculating the opening amount of the ink fountain key corresponding to an image of a printing plate of a next print job;

correcting the calculated opening amount of the ink fountain key with a correction value in consideration of an influence of cleaning of the blanket; and forming, on the ink roller group, a corrected ink film thickness distribution corresponding to the image of the printing plate of the next print job by performing the feed operation of the ink ductor roller a predetermined number of times in a state in which the opening amount of the ink fountain key has been set to the corrected opening amount.

2. The ink supply method according to claim 1, wherein the step of correcting with the correction value includes the step of correcting the calculated opening amount of the ink fountain key using, as the correction value, a value corresponding to the image of the printing plate of the next print job.

3. The ink supply method according to claim 1, wherein the step of correcting with the correction value includes the step of correcting the calculated opening amount of the ink fountain key using, as the correction value, a value corresponding to an operation count of a blanket cleaning device configured to clean the blanket.

4. The ink supply method according to claim 1, further comprising the step of setting the opening amount of the ink fountain key to the opening amount corresponding to the image of the printing plate of the next print job after the corrected ink film thickness distribution is formed.

5. The ink supply method according to claim 1, further comprising the steps of:

dividing the ink roller group into a plurality of roller subgroups; and removing ink in one or some roller subgroups out of the plurality of separated roller subgroups by scraping the ink with an ink scraping member.

6. The ink supply method according to claim 5, further comprising the step of, after the ink in the one or some roller subgroups is removed, connecting the plurality of separated roller subgroups to restore the one ink roller group, wherein the step of forming the corrected ink film thickness distribution includes the step of forming, on the ink roller group restored to one ink roller group, the corrected ink film thickness distribution corresponding to the image of the printing plate of the next print job by performing the feed operation of the ink ductor roller the predetermined number of times in a state in which the ink roller group has been restored to one ink roller group and in the state in which the opening amount of the ink fountain key has been set to the corrected opening amount.

7. The ink supply method according to claim 1, further comprising the steps of:

dividing the ink roller group on which the corrected ink film thickness distribution is formed into a plurality of roller subgroups;

after or before the ink roller group is divided, setting at least a roller subgroup on a most downstream side out of the plurality of roller subgroups and the plate cylinder on which the printing plate to be used in the next print job is mounted in a throw-on state, and setting the plate cylinder and the blanket cylinder used to transfer the ink supplied to the printing plate mounted on the plate cylinder to the target printing material in a throw-on state; and in a state in which the ink roller group has been divided and in a state in which at least the roller subgroup on the most downstream side out of the plurality of roller subgroups and the plate cylinder have been set in the throw-on state, and in a state in which the plate cylinder and the blanket cylinder have been set in the throw-on state, rotating the plate cylinder, the roller subgroup, and the blanket cylinder in the throw-on state a predetermined number of times to supply the ink in the roller subgroup to the blanket cylinder and the printing plate mounted on the plate cylinder.

8. The ink supply method according to claim 7, further comprising the step of, after the ink is supplied to the blanket cylinder and the printing plate mounted on the plate cylinder, connecting the plurality of separated roller subgroups to restore the one ink roller group and starting printing of the next print job using the printing plate mounted on the plate cylinder.

9. An ink supply device comprising:

an ink fountain key configured to adjust an amount of ink supplied from an ink fountain to an ink fountain roller;

an ink ductor roller configured to feed the ink supplied to the ink fountain roller;

an ink roller group configured to supply the ink fed by the ink ductor roller to a printing plate;

a blanket cylinder on which a blanket used to transfer the ink supplied to the printing plate to a target printing material is mounted;

a blanket cleaning device configured to clean the blanket mounted on the blanket cylinder;

a blanket cleaning processing unit configured to cause the blanket cleaning device to operate and clean the blanket mounted on the blanket cylinder after an end of a print job;

an ink fountain key opening amount calculation unit configured to calculate an opening amount of the ink fountain key corresponding to an image of a printing plate of a next print job;

an ink fountain key opening amount correction unit configured to correct the calculated opening amount of the ink fountain key with a correction value in consideration of an influence of cleaning of the blanket; and a corrected ink film thickness distribution formation processing unit configured to cause the ductor roller to perform a feed operation a predetermined number of times, in a state in which the opening amount of the ink fountain key has been set to the corrected opening amount, to form a corrected ink film thickness distribution corresponding to the image of the printing plate of the next print job on the ink roller group.

10. The ink supply device according to claim 9, wherein the ink fountain key opening amount correction unit corrects the calculated opening amount of the ink fountain key using, as the correction value, a value corresponding to the image of the printing plate of the next print job.

11. The ink supply device according to claim 9, wherein the ink fountain key opening amount correction unit corrects the calculated opening amount of the ink fountain key using, as the correction value, a value corresponding to an operation count of the blanket cleaning device configured to clean the blanket.

12. The ink supply device according to claim 9, further comprising:

a first ink roller group division processing unit configured to divide the ink roller group into a plurality of roller subgroups; and an ink removal processing unit configured to remove ink in one or some roller subgroups out of the plurality of separated roller subgroups by scraping the ink by an ink scraping member.

13. The ink supply device according to claim 12, further comprising an ink roller group connection processing unit configured to, after the ink in the one or some roller subgroups is removed, connect the plurality of separated roller subgroups to restore the one ink roller group, wherein the corrected ink film thickness distribution formation processing unit forms, on the ink roller group restored, the corrected ink film thickness distribution corresponding to the image of the printing plate of the next print job by performing the feed operation of the ink ductor roller the predetermined number of times in a state in which the ink roller group has been restored to one ink roller group and in the state in which the opening amount of the ink fountain key has been set to the corrected opening amount.

14. The ink supply device according to claim 9, further comprising:

a second ink roller group division processing unit configured to divide the ink roller group on which the corrected ink film thickness distribution is formed into a plurality of roller subgroups;

a cylinder throw-on processing unit configured to, after or before the ink roller group is divided, set at least a roller subgroup on a most downstream side out of the plurality of roller subgroups and a plate cylinder on which the printing plate to be used in the next print job is mounted in a throw-on state and set the plate cylinder and the blanket cylinder used to transfer the ink supplied to the printing plate mounted on the plate cylinder to the target printing material in a throw-on state; and an ink supply processing unit configured to, in a state in which the ink roller group has been divided and in a state in which at least the roller subgroup on the most downstream side out of the plurality of roller subgroups and the plate cylinder have been set in the throw-on state, and the plate cylinder and the blanket cylinder are set in the throw-on state, rotate the plate cylinder, the roller subgroup, and the blanket cylinder in the throw-on state a predetermined number of times to supply the ink in the roller subgroup to the blanket cylinder and the printing plate mounted on the plate cylinder.

15. The ink supply device according to claim 14, further comprising:

an ink fountain key opening amount setting unit configured to set the opening amount of the ink fountain key to an opening amount corresponding to the image of the printing plate of the next print job after the corrected ink film thickness distribution is formed; and a printing start unit configured to, after the ink is supplied to the blanket cylinder and the printing plate mounted on the plate cylinder, connect the plurality of separated roller subgroups to restore the one ink roller group and start printing of the next print job using the printing plate mounted on the plate cylinder.

* * * * *